US009852896B2

(12) United States Patent
Badu-Tawiah et al.

(10) Patent No.: US 9,852,896 B2
(45) Date of Patent: Dec. 26, 2017

(54) METHOD AND APPARATUS FOR CONTAINED-ELECTROSPRAY FOR USE IN MASS SPECTROMETRY AND DROPLET REACTIONS

(71) Applicant: Ohio State Innovation Foundation, Columbus, OH (US)

(72) Inventors: Abraham Kwame Badu-Tawiah, Columbus, OH (US); Dmytro Kulyk, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 15/147,005

(22) Filed: May 5, 2016

(65) Prior Publication Data

US 2016/0329198 A1 Nov. 10, 2016

Related U.S. Application Data

(60) Provisional application No. 62/157,429, filed on May 5, 2015, provisional application No. 62/257,469, filed on Nov. 19, 2015.

(51) Int. Cl.
*H01J 49/04* (2006.01)
*H01J 49/16* (2006.01)

(52) U.S. Cl.
CPC ..... *H01J 49/045* (2013.01); *H01J 49/0404* (2013.01)

(58) Field of Classification Search
CPC ..... H01J 49/045; H01J 49/0404; H01J 49/167
USPC ..... 250/281, 282, 283, 288
See application file for complete search history.

(56) References Cited

U.S. PATENT DOCUMENTS

2009/0294660 A1* 12/2009 Whitehouse ..... H01J 49/045 250/288

OTHER PUBLICATIONS

Ahlf, et al., "Developing top down proteomics to maximize proteome and sequence coverage from cells and tissues", Curr. Opinion Chem. Biol. vol. 17 No. 5, 2013, 15 pages.
Al-Warhi, et al., "Recent development in peptide coupling reagents", J. Saudi Chem. Soc. vol. 16 No. 2, 2012, 97-116.
Badu-Tawiah, et al., "Accelerated carbon-carbon bond-forming reactions in preparative electrospray", Angew. Chem. Int. Ed. 51, 2012, 11832-11835.

(Continued)

*Primary Examiner* — Nicole Ippolito
(74) *Attorney, Agent, or Firm* — Meunier Carlin & Curfman LLC

(57) ABSTRACT

Provided herein are apparatuses that can comprise an electrospray emitter comprising a sample capillary extending from a sample inlet to a sample outlet and an element comprising a conduit coaxially disposed around the electrospray emitter thereby forming a chamber extending between the conduit and the sample capillary and terminating in a gas outlet. The element can further comprise, in some examples, a carrier gas inlet fluidly connected to the chamber, and a working gas inlet fluidly connected to the chamber, wherein the chamber is configured to provide a path for fluid flow from the carrier gas inlet and the working gas inlet to the gas outlet. Also disclosed herein are methods of use of the apparatuses. In some examples discussed herein are methods and apparatuses for contained-electrospray, for example for use in mass spectrometry and/or droplet reactions.

23 Claims, 36 Drawing Sheets

(56) References Cited

OTHER PUBLICATIONS

Badu-Tawiah, et al., "Accelerated C—N bond formation in dropcast thin films on ambient surfaces", J. Am. Soc. Mass Spectrom. 23, 2012, 1461-1468.
Badu-Tawiah, et al., "Ambient ion soft landing", Anal. Chem. 83, 2011, 2648-2654.
Badu-Tawiah, et al., "Peptide cross-linking at ambient surfaces by reactions of nanosprayed molecular cations", Angew. Chem. Int. Ed., 2012, 9417-9421.
Badu-Tawiah, et al., "Reactions of micro-solvated organic compounds at ambient surfaces: droplet velocity, charge state and solvent effects", J. Am. Soc. Mass Spectrom. 23, 2012, 1077-1084.
Badu-Tawiah, et al., "Reactions of organic ions at ambient surfaces in a solvent-free environment", J. Am. Soc. Mass Spectrom. 23, 2012, 842-849.
Banerjee, et al., "Toward development of new photolabile protecting groups that can rapidly release bioactive-compounds upon photolysis with visible-light", J. Org. Chem. vol. 68 No. 22, 2003, 8361-8367.
Barbara, et al., "Reactive desorption electrospray ionization for rapid screening of guests for supramolecular inclusion complexes", Rapid Commun. Mass Spectrom. vol. 22, 2008, 4121-28.
Bell, et al., "Just Do It? Impact of a Science Apprenticeship Program on High School Students' Understandings of the Nature of Science and Scientific Inquiry", J. Res. Sci. Teaching 40, 2003, 487-509.
Benigna, "Photoelectron Spectroscopy in Advanced Placement Chemistry", J. Chem. Educ. vol. 91 No. 9, 2014, 1299-1305.
Berg, et al., "In Vivo Photo-Cross-Linking Approach Reveals a Homodimerization Domain of Aha1 in *S. cerevisiae*.", PLoS ONE vol. 9 No. 3, 2014, e89436.
Cerecedo, "Mapping of the IgE and IgG4 sequential epitopes of milk allergens with a peptide microarray-based immunoassay", J. Allergy Clin. Immunol. 122, 2008, 589-594.
Chen, "Manipulation of charge states of biopolymer ions by atmosphericpressure ion/molecule reactions implemented in an extractive electrospray ionization source", Eur. J. Mass Spectrom. 13, 2007, 273-279.
Collins, et al., "High-Efficiency Solid Phase Peptide Synthesis (HE-SPPS)", Org. Lett. 16, 2014, 940-943.
Cooks, et al., "Creativity through Instrumentation", Anal. Chem. 57, 1985, 823A-843A.
Dawson, et al., "Synthesis of Proteins by Native Chemical Ligation", Science, 266:, 1994, 776-779.
Ebeling, et al., "Corona discharge in charge reduction electrospray mass spectrometry", Anal. Chem. 72, 2000, 5158-5161.
Etkina, et al., "Pushing to the Edge: Rutgers Astrophysics Institute Motivates Talented High School Students", J. Res. Sci. Teaching 40, 2003, 958-985.
Franchetti, et al., "Landing of Ions as a Means of Surface Modification", Int. J. Mass Spectrom. Ion Processes 23, 1977, 29-35.
Garcia-Amoros, et al., "Influence of the photo-active azo cross-linker spacer on the opto-mechanics of polysiloxane elastomer actuators", J. Mater. Chem. 21, 2011, 1094-1101.
Hogan, et al., "Charge State Dependent Collision-Induced Dissociation of Native and Reduced Porcine Elastase.",J. Mass Spectrom. 38, 2003, 245-256.
Huang, et al., "Rapid Screening of Anabolic Steroids in Urine by Reactive Desorption Electrospray Ionization", Anal. Chem. vol. 79 No. 21, 2007, 8327-8332.
Hunt, et al., "Characterization of peptides bound to the class I MHC molecule HLA-A2.1 by mass spectrometry Science", Science 255, 1992, 1261-1263.
Karas, et al., "Laser Desorption Ionization Mass Spectrometry of Large Biomolecules", Trends in Anal. Chem. vol. 9 No. 10, 1990, 321-325.
Kharlamova, "Electrospray droplet exposure to gaseous acids for reduction of metal counterions in nucleic acid ions", nt. J. Mass. Spectrom. 300, 2011, 158-166.
Kharlamova, et al., "Electrospray droplet exposure to gaseous acids for the manipulation of protein charge state distributions", Anal. Chem. 82, 2010, 7422-7429.
Kharlamova, et al., "Negative electrospray droplet exposure to gaseous bases for the manipulation of protein charge state distributions", Anal. Chem. 83, 2011, 431-439.
Kim, et al., "Purification of a novel anticancer peptide from enzymatic hydrolysate of Mytilus coruscus", J Microbiol Biotechnol. vol. 22 No. 10, 2012, 1381-1387.
Knutson, et al., "Architecture of the *Saccharomyces cerevisiae* RNA polymerase I Core Factor complex", Nat. Struct. Mol. Biol. vol. 21 No. 9, 2014, 810-816.
Laskin, et al., "Soft-landing of peptide ions onto self-assembled monolayer surfaces: an overview", Phys. Chem. Chem. Phys. vol. 10 No. 8, 2008, 1079-90.
Lee, et al., "Controlled Formation of Peptide Bonds in the Gas Phase", J. Am. Chem. Soc. 133, 2011, 1583-1537.
Leszyk, et al., "Cross-linking of rabbit skeletal muscle troponin with the photoactive reagent 4-maleimidobenzophenone: identification of residues in troponin I that are close to cysteine-98 of troponin C", Biochemistry. vol. 26 No. 22, 1987, 7042-7.
Li, et al., "Green chemistry for chemical synthesis", Proc. Natl. Acad. Sci. vol. 105 No. 36, 2008, 13197-13202.
Mabrouk. "Introducing Summer High School Student-Researchers to Ethics in Scientific Research", J. Chem. Educ. 84, 2007, 952-954.
McGee, "Efficient and Directed Peptide Bond Formation in the Gas Phase via Ion/Ion Reaction", Proc. Nat. Acad. Sci. 111, 2014, 1288-1292.
McLuckey, et al., "Ion/ion chemistry of high-mass multiply charged ions", Mass Spectrom Rev. vol. 17 No. 6, 1998, 369-407.
McLuckey, et al., "Oligonucleotide mixture analysis via electrospray and ion/ion reactions in a quadrupole ion trap", Anal Chem. vol. 74 No. 5, 2002, 976-84.
McLuckey, et al., "Reactions of dimethylamine with multiply charged ions of cytochrome c", J. Am. Chem. Soc. 112, 1990, 5668-5670.
Mentinova, et al., "Covalent Modification of Gaseous Peptide Ions with N-Hydroxysuccinimide Ester Reagent Ions", J. Am. Chem. Soc. 132, 2010, 18248-18257.
Mentinova, "Intra- and Inter-Molecular Cross-Linking of Peptide Ions in the Gas-Phase: Reagents and Conditions", J. Am. Soc. Mass Spectrom. 22, 2011, 912-921.
Mitchell. "The Use of Girard T Reagent in a Rapid and Sensitive Method for Measuring Glyoxal and Certain Other alpha-dicarbonyl Compounds", Anal. Biochem. 81, 1977, 47-56.
Mommen, et al., "Expanding the detectable HLA peptide repertoireusing electron-transfer/higher-energy collision dissociation (EThcD)", Proc. Natl. Acad. Sci. vol. 111 No. 12, 2014, 4507-4512.
Moore, "Advanced High School Chemistry", J. Chem. Educ. vol. 79 No. 8, 2002, 903.
Muddiman, et al., "Charge state reduction with improved signal intensity of oligonucleotides in electrospray ionization mass spectrometry", J. Am. Soc. Mass Spectrom. 7, 1996, 697-706.
Muller, et al., "Cleavable Cross-Linker for Protein Structure Analysis: Reliable Identification of Cross-Linking Products by Tandem MS", Anal. Chem. vol. 82 No. 16, 2010, 6958-6968.
Nakamichi, et al., "Activated carbon-promoted oxidative aromatization of Hantzsch 1,4-dihydropyridines and 1,3,5-trisubstituted pyrazolines using molecular oxygen", Synthesis 7, 2004, 1015-1020.
Pan, et al., "The Effect of Small Cations on the Positive Electrospray Responses of Proteins at Low pH", Anal. Chem. 75, 2003, 5468-5474.
Park, et al., "The novel vaccine peptide GV1001 effectively blocks β-amyloid toxicity by mimicking the extra-telomeric functions of human telomerase reverse transcriptase", Neurobiology Aging 35, 2014, 1255-1274.
Patring, et al., "Application of liquid chromatography-electrospray ionisation mass spectrometry for determination of dietary folates: effects of buffer nature and mobile phase composition on sensitivity and selectivity", J Chromatogr A. 1143, 2007, 72-82.
Pattabiraman, et al., "Rethinking amide bond synthesis", Nature 480, 2011, 471-479.

(56) References Cited

OTHER PUBLICATIONS

Perry, et al., "Capturing fleeting intermediates in a catalytic C—H amination reaction cycle", Proc. Natl. Acad. Sci. 1207600106, 2012, 5 pages.
Perry, et al., "Detecting reaction intermediates in liquids on the millisecond time scale using desorption electrospray ionization", Angew. Chem. Int. Ed. Engl. 50, 2011, 250-254.
Perry, et al., "Transient Ru-methyl formate intermediates generated with bifunctional transfer hydrogenation catalysts.", Proc. Natl. Acad. Sci. vol. 109 No. 7, 2012, 2246-50.
Rauschenbach, et al., "Electrospray Ion Beam Deposition: Soft-Landing and Fragmentation of Functional Molecules at Solid Surfaces", ACS Nano vol. 3 No. 10, 2009, 2901-2910.
Samalikova, et al., "Protein charge-state distributions in electrospray-ionization mass spectrometry do not appear to be limited by the surface tension of the solvent.", J Am Chem Soc. 125 No. 44, 2003, 13352-3.
Savaryn, et al., "The emergence of top-down proteomics in clinical research", Genome Medicine vol. 5 No. 53, 2013, 8 pages.
Scalf, et al., "Controlling charge states of large ions.", Science 283, 1999, 194-197.
Seehan, et al., "Synthetic Peptide Models of Enzyme Active Sites. III. Stereoselective Esterase Models", J. Am. Chem. Soc. vol. 88 No. 14, 1966, 3455-3456.
Sinz, "Chemical cross-linking and mass spectrometry to map three-dimensional protein structures and protein-protein interactions", Mass Spectrom. Rev. vol. 25 No. 4, 2006, 663-682.
Sinz, et al., "Isotope-labeled photoaffinity reagents and mass spectrometry to identify protein-ligand interactions", Angew. Chem. Int. Ed. vol. 45 No. 5, 2007, 660-2.
Spanggord, et al., "Site-specific modification and RNA crosslinking of the RNA-binding domain of PKR", Nucleic Acids Res. vol. 28 No. 9, 2000.
Sparrapan, et al., "Ambient Eberlin Reactions Via Desorption Electrospray Ionization Mass Spectrometry", J. Mass Spectrom vol. 41 No. 9, 2006, 1242-1264.
Sterling, et al., "Effects of buffer loading for electrospray ionization mass spectrometry of a noncovalent protein complex that requires high concentrations of essential salts", J Am Soc Mass Spectrom. vol. 21 No. 6, 2010, 1045-9.
Takats, et al., "Electrosonic Spray Ionization. A Gentle Technique for Generating Folded Proteins and Protein Complexes in the Gas Phase and for Studying Ion-Molecule Reactions at Atmospheric Pressure", Anal. Chem. 76, 2004, 4050-4058.
Thomas, "Assessing High School Student Learning on Science Outreach Lab Activities", J. Chem. Educ. 89, 2014, 1259-1263.
Tomatsu, et al., "Novel angiotensin I-converting enzyme inhibitory peptides derived from soya milk", Food Chem. vol. 136 No. 2, 2013, 612-616.
Valkevich, et al., "Forging Isopeptide Bonds Using Thiol-Ene Chemistry: Site-Specific Coupling of Ubiquitin Molecules for Studying the Activity of Isopeptidases", J. Am. Chem. Soc. 134, 2012, 6916-6919.
Wang, et al., "Covalent Immobilization of Peptides on Self-Assembled Monolayer Surfaces Using Soft-Landing of Mass-Selected Ions", J. Am. Chem. Soc. 129, 2007, 8682-8683.
Wang, et al., "Helical Peptide Arrays on Self-Assembled Monolayer Surfaces through Soft and Reactive Landing of Mass-Selected Ions", Angew Angew. Chem. Int. Ed. 47, 2008, 6678-6680.
Wheeler, et al., "Notes—Formation of Girard-T Derivatives", J. Org. Chem. 26, 1961, 3537-3538.
Wincel, et al., "Peptide bond formation in gas-phase ion/molecule reactions of amino acids: a novel proposal for the synthesis of prebiotic oligopeptides", Rapid Commun. Mass Spectrom. 41, 2000, 135-140.
Wu, et al., "Rapid, Direct Analysis of Cholesterol by Charge Labeling in Reactive Desorption Electrospray Ionization", Anal. Chem. vol. 81 No. 18, 2009, 7618-7624.
Xia, et al., "Evolution of Instrumentation for the Study of Gas-Phase Ion/Ion Chemistry via Mass Spectrometry", J. Am. Soc. Mass Spectrom. vol. 19, 2008, 173-189.
Yan, et al., "Photo-Assisted Peptide Enrichment in Protein Complex Cross-Linking Analysis of a Model Homodimeric Protein Using Mass Spectrometry", Proteomics. vol. 11 No. 20, 2011, 4109-4115.
Zhang, et al., "Mass spectrometry for structural characterization of therapeutic antibodies", Mass Spectrom. Rev. 28(1), 2009, 147-76.

* cited by examiner (A)
Conventional ESI $xGT^+ + yMH^+$ (B)
Contained-ES
(Low Pressure)

$xMH^+ + yGT^+$

METHOD AND APPARATUS FOR CONTAINED-ELECTROSPRAY FOR USE IN MASS SPECTROMETRY AND DROPLET REACTIONS

CROSS-REFERENCE TO RELATED APPLICATIONS

This application claims the benefit of priority to U.S. Provisional Application No. 62/157,429, filed May 5, 2015, and U.S. Provisional Application No. 62/257,469, filed Nov. 19, 2015, which are both hereby incorporated by reference herein in their entireties.

BACKGROUND

There is an increasing need for better sensitivity of electrospray ionization (ESI) to accurately quantify different types of analytes in complex mixtures. However, quantitative analyses of mixtures by ESI-MS is often complicated by differences in ionization response for different compounds (e.g., among polar, non-polar, and ammonium cations). There are often significant suppression effects among the analytes and the resultant mass spectrum from such a mixture displays only surface active analytes. The apparatuses, systems, and methods discussed herein address these and other needs.

SUMMARY

Discussed herein are apparatuses that can comprise an electrospray emitter comprising a sample capillary extending from a sample inlet to a sample outlet; and a voltage source conductively coupled to the sample capillary and configured to apply a voltage to the sample capillary. In some examples, the voltage applied to the sample capillary can be from 4 kV to 5 kV. In some examples, the sample capillary can be formed from fused silica.

The apparatus can further comprise an element comprising a conduit coaxially disposed around the electrospray emitter thereby forming a chamber extending between the conduit and the sample capillary and terminating in a gas outlet. In some examples, the conduit can be formed from fused silica.

The element can further comprise, in some examples, a carrier gas inlet fluidly connected to the chamber, and a working gas inlet fluidly connected to the chamber, wherein the chamber is configured to provide a path for fluid flow from the carrier gas inlet and the working gas inlet to the gas outlet. In some examples, the carrier gas inlet is integrally formed with the conduit. In some examples, the working gas inlet is integrally formed with the conduit. In some examples, the element further comprises an auxiliary gas inlet fluidly connected to the chamber. In some examples, the auxiliary gas inlet is integrally formed with the conduit.

In some examples the sample capillary is in an extended position wherein the sample outlet of the sample capillary extends beyond the gas outlet such that the sample outlet is disposed outside of the conduit. In some examples, the sample capillary is in a retracted position wherein the conduit extends beyond the sample outlet of the sample capillary such that the sample outlet is disposed within the chamber. In some examples, the sample capillary can be translocated between a retracted position and an extended position.

In some examples, the sample capillary is in a retracted position wherein the conduit extends beyond the sample outlet of the sample capillary such that the sample outlet is disposed within the chamber, and the element further comprises a working fluid source terminating in a working fluid outlet. In some examples, the working fluid outlet is fluidly connected to the chamber and the working fluid outlet is located between the sample outlet and the gas outlet. In some examples, the working fluid outlet is fluidly connected to the gas outlet. In some examples, the working fluid source can comprise a non-volatile working fluid, for example ammonium acetate.

In some examples, the apparatus further comprises a liquid chromatographer positioned to inject a sample into the sample inlet.

In some examples, the apparatus further comprises an analyzer positioned to receive a sample from the sample outlet. The analyzer can, in some examples, comprise a mass spectrometer.

Also disclosed herein are apparatuses comprising: an electrospray emitter comprising (i) a sample capillary extending from a sample inlet to a sample outlet and (ii) a voltage source conductively coupled to the sample capillary and configured to apply a voltage to the sample capillary; and an element comprising (i) a conduit coaxially disposed around the electrospray emitter thereby forming a chamber extending between the conduit and the sample capillary and terminating in a gas outlet, wherein the sample capillary is in a retracted position wherein the conduit extends beyond the sample outlet of the sample capillary such that the sample outlet is disposed within the chamber; (ii) a carrier gas inlet fluidly connected to the chamber, wherein the chamber is configured to provide a path for fluid flow from the carrier gas inlet to the gas outlet; and (iii) a working fluid source terminating in a working fluid outlet. In some examples, the working fluid outlet can be fluidly connected to the chamber and the working fluid outlet can be located between the sample outlet and the gas outlet. In some examples, the working fluid outlet can be fluidly connected to the gas outlet.

Also disclosed herein are methods comprising injecting a liquid sample into the sample inlet of any of the apparatuses described herein. In some examples, the liquid sample comprises a solvent and an analyte. The solvent, for example, can comprise water, methanol, or a combination thereof. In some examples, the liquid sample can comprise a biological sample (e.g., serum, proteins). In some examples, the analyte comprises a protein. The analyte can comprise an analyte with any relative proton affinity (e.g., a high proton affinity, a low proton affinity, etc.). In some examples, the liquid sample is injected from a liquid chromatographer. In some examples, the liquid sample can be injected at a flow rate of from 2 μL/min to 5 μL/min.

The method can further comprise forming a droplet of the liquid sample at the sample outlet, and injecting a working gas into the working gas inlet and a carrier gas into the carrier gas inlet, thereby contacting the droplet with the working gas and the carrier gas. In some examples, the working gas can comprise an acid, a base, an oxidizer, or a combination thereof. Examples of acids include, but are not limited to, acetic acid, HCl, and combinations thereof. In some examples, the carrier gas is selected from nitrogen, helium, argon, hydrogen, oxygen, air, or a combination thereof. In some examples, the droplet is contacted with the working gas for from 1 second to 60 seconds.

In some examples, the method can further comprise translocating the sample capillary between a retracted position and an extended position.

In some examples, the methods can further comprise ejecting the droplet from the sample outlet. In some examples, the ejected droplet comprises an ionized form of the analyte. In some examples, ejecting the droplet comprises adjusting a pressure at which the working gas is injected, adjusting a pressure at which the carrier gas is injected, adjusting a flow rate at which the liquid sample is injected, adjusting the voltage applied to the sample capillary, or a combination thereof. In some examples, the method can further comprise collecting the ejected droplet on a surface. In some examples, the method can further comprise exposing the ejected droplet to electromagnetic radiation. In some examples, the methods can further comprise exposing the droplet to electromagnetic radiation prior to ejecting the droplet. The electromagnetic radiation can, for example, be selected from wavelengths of visible light, UV light, infrared light, or a combination thereof.

In some examples, the methods can further comprise injecting the ejected droplet into an analyzer. The analyzer can, for example, comprise a mass spectrometer.

Also disclosed herein are methods comprising injecting a liquid sample into the sample inlet of any of the apparatuses described herein; forming a droplet of the liquid sample at the sample outlet; injecting a working fluid into the working fluid source and a carrier gas into the carrier gas inlet; and ejecting the droplet from the sample outlet. In these methods the droplet can be contacted with the carrier gas, the working fluid, or a combination thereof prior to ejection from the sample outlet, after ejection from the sample outlet, or a combination thereof. The working fluid, for example, can comprise a non-volatile working fluid, such as ammonium acetate. In some examples, ejecting the droplet can comprise adjusting a pressure at which the working fluid is injected, adjusting a pressure at which the carrier gas is injected, adjusting a flow rate at which the liquid sample is injected, adjusting the voltage applied to the sample capillary, or a combination thereof. In some examples, the method can further comprise translocating the sample capillary to adjust the relative position of the sample outlet with respect to the working fluid outlet and the gas outlet.

DETAILED DESCRIPTION

Mass spectrometry (MS) has emerged as an important analytical tool, and continues to show potential in many fields not only because of its specificity and sensitivity in chemical analysis but also because it can be used as a tool for studying chemical reactions. One of the focuses of analytical mass spectrometry is molecular structural characterization. Traditionally, this has been achieved in three steps: (1) ion generation, (2) precursor ion selection, and (3) fragmentation or reaction of mass-selected precursor ions with specific neutral reagents under the high vacuum environment. A more recent set of MS techniques have been developed in which ion generation and reaction occur simultaneously in a single stage MS experiment. These techniques (e.g., reactive desorption electrospray ionization) have typically been used to enhance the detection (and sometimes imaging) of analytes with low proton affinities, and for the studies of reaction intermediates.

More recently still, has been the use of MS as a tool for studying chemical changes is the ability to generate intact molecular ions, focus and use them as ordinary reagents for organic reactions at ambient surface, outside the mass spectrometer.

Apparatuses

Figure 1:
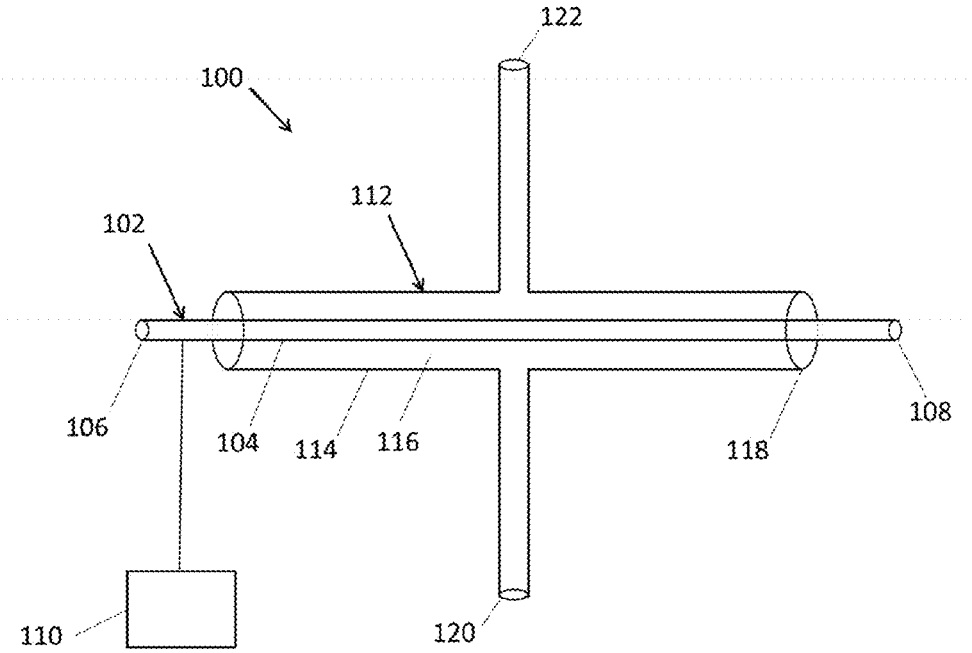
FIG. 1 is a schematic representation of an example apparatus in the extended position.

Discussed herein are apparatuses. Referring now to FIG. 1, in some examples the apparatus 100 can comprise an electrospray emitter 102 comprising a sample capillary 104 extending from a sample inlet 106 to a sample outlet 108; and a voltage source 110 conductively coupled to the sample capillary 104 and configured to apply a voltage to the sample capillary 104.

In some examples, the voltage applied to the sample capillary 104 can be 4 kV or more (e.g., 4.1 kV or more, 4.2 kV or more, 4.3 kV or more, 4.4 kV or more, 4.5 kV or more, 4.6 kV or more, 4.7 kV or more, 4.8 kV or more, or 4.9 kV or more). In some examples, the voltage applied to the sample capillary 104 can be 5 kV or less (e.g., 4.9 kV or less, 4.8 kV or less, 4.7 kV or less, 4.6 kV or less, 4.5 kV or less, 4.4 kV or less, 4.3 kV or less, 4.2 kV or less, or 4.1 kV or less). The voltage applied to the sample capillary 104 can range from any of the minimum values described above to any of the maximum values described above, for example from 4 kV to 5 kV (e.g., from 4 kV to 4.5 kV, from 4.5 kV to 5 kV, from 4 kV to 4.2 kV, from 4.2 kV to 4.4 kV, from 4.4 kV to 4.6 kV, from 4.6 kV to 4.8 kV, from 4.8 kV to 5 kV, or from 4.2 kV to 4.8 kV).

The sample capillary 104 can be fabricated from any suitable material or combination of materials compatible with the apparatuses and methods described herein. In some examples, the sample capillary 104 is formed from a conductive material. Examples of suitable materials can include conductive polymers, conductive silicones, conductive glasses, metals, conductive ceramics, conductive inorganic materials, and combinations thereof. In some examples, the sample capillary 104 can be formed from fused silica. In some examples, the sample capillary 104 can be formed from a conductive transparent material.

The apparatus 100 can further comprise an element 112 comprising a conduit 114 coaxially disposed around the electrospray emitter 102 thereby forming a chamber 116 extending between the conduit 114 and the sample capillary 104 and terminating in a gas outlet 118.

The conduit 114 can be fabricated from any suitable material or combination of materials compatible with the apparatuses and methods described herein. Examples of suitable materials can include polymers, silicones, glasses, metals, ceramics, inorganic materials, and combinations thereof. In some examples, the conduit 114 can be formed from a transparent material. In some examples, the conduit 114 can be formed from fused silica.

In some examples, the element 112 can further comprise a carrier gas inlet 120 fluidly connected to the chamber 116, and a working gas inlet 122 fluidly connected to the chamber 116, wherein the chamber 116 is configured to provide a path for fluid flow from the carrier gas inlet 120 and the working gas inlet 122 to the gas outlet 118. In some examples, the carrier gas inlet 120 is integrally formed with the conduit 114. In some examples, the working gas inlet 122 is integrally formed with the conduit 114. In some examples, the element 112 further comprises an auxiliary gas inlet fluidly connected to the chamber 116. In some examples, the auxiliary gas inlet is integrally formed with the conduit 114.

In some examples the sample capillary 104 is in an extended position wherein the sample outlet 108 of the sample capillary 104 extends beyond the gas outlet 118 such that the sample outlet 108 is disposed outside of the conduit 114, for example as shown in FIG. 1.

Figure 2:
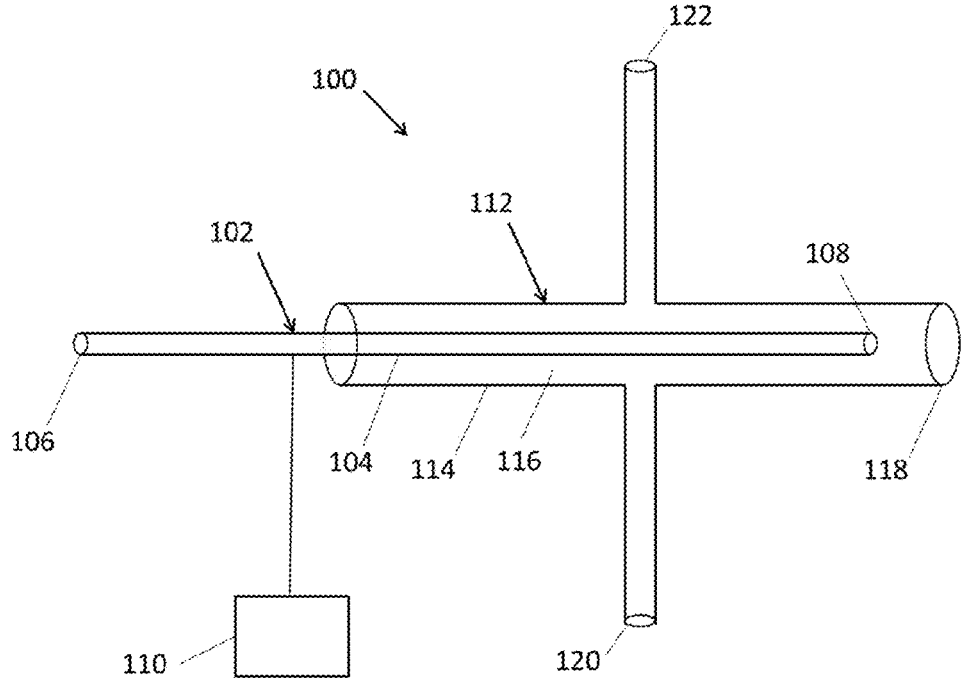
FIG. 2 is a schematic representation of an example apparatus in the retracted position.

Referring now to FIG. 2, in some examples, the sample capillary 104 is in a retracted position wherein the conduit 114 extends beyond the sample outlet 108 of the sample capillary 104 such that the sample outlet 108 is disposed within the chamber 116.

In some examples, the sample capillary 104 can be translocated between a retracted position and an extended position. Translocating the sample capillary 104 between a retracted position and an extended position can comprise, for example, adjusting the relative position of the sample outlet 108 with respect to the gas outlet 118.

Figure 22:
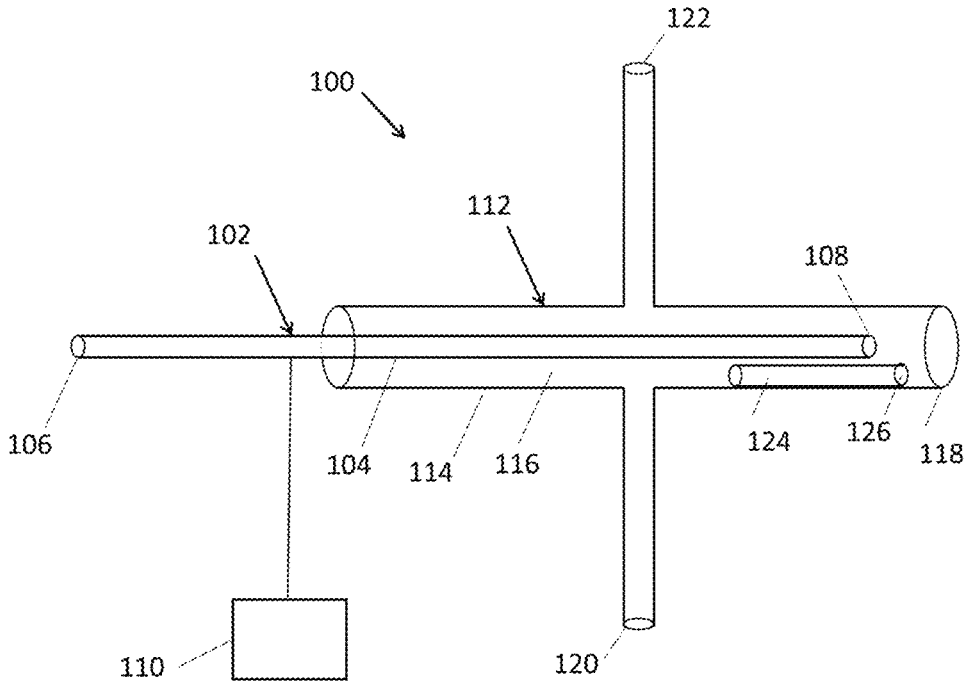
FIG. 22 is a schematic representation of an example apparatus with a working fluid source fluidly connected to the chamber.
Figure 23:
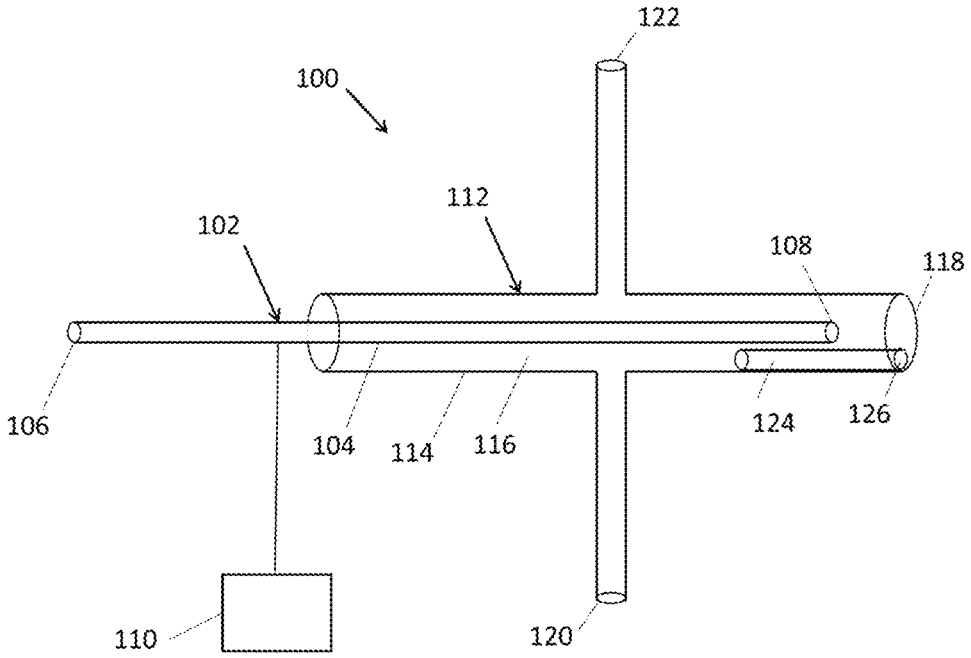
FIG. 23 is a schematic representation of an example apparatus with a working fluid source fluidly connected to the gas outlet.

Referring now to FIG. 22, in some examples the sample capillary 104 is in a retracted position wherein the conduit 114 extends beyond the sample outlet 108 of the sample capillary 104 such that the sample outlet 108 is disposed within the chamber 116, and the element 112 further comprises a working fluid source 124 terminating in a working fluid outlet 126. In some examples, the working fluid outlet 126 is fluidly connected to the chamber 116 and the working fluid outlet 126 is located between the sample outlet 108 and the gas outlet 118, for example as sown in FIG. 22. Referring now to FIG. 23, in some examples, the working fluid outlet 126 is fluidly connected to the gas outlet 118.

In some examples, the sample capillary 104 can be translocated to adjust the relative position of the sample outlet 108 with respect to the working fluid outlet 126 and the gas outlet 118. In some examples, the working fluid source 124 can comprise a non-volatile working fluid, for example ammonium acetate.

In some examples, the apparatus 100 further comprises a liquid chromatograph (LC) positioned to inject a sample into the sample inlet 106. For example, the outlet of the LC can be fluidly connected to the sample inlet.

In some examples, the apparatus 100 further comprises an analyzer positioned to receive a sample from the sample outlet 108. In some examples, the analyzer can comprise a mass spectrometer. The mass spectrometer can be any suitable mass spectrometer, including a tandem mass spectrometer.

Referring now to FIG. 22, also disclosed herein are apparatuses 100 comprising: an electrospray emitter 102 comprising (i) a sample capillary 104 extending from a sample inlet 106 to a sample outlet 108 and (ii) a voltage source 110 conductively coupled to the sample capillary and configured to apply a voltage to the sample capillary; and an element 112 comprising (i) a conduit 114 coaxially disposed around the electrospray emitter 102 thereby forming a chamber 116 extending between the conduit 114 and the sample capillary 104 and terminating in a gas outlet 118, wherein the sample capillary 104 is in a retracted position wherein the conduit 114 extends beyond the sample outlet 108 of the sample capillary 104 such that the sample outlet 108 is disposed within the chamber 116; (ii) a carrier gas inlet 122 fluidly connected to the chamber 116, wherein the chamber 116 is configured to provide a path for fluid flow from the carrier gas inlet 120 to the gas outlet 118; and (iii) a working fluid source 124 terminating in a working fluid outlet 126. In some examples, the working fluid outlet 126 can be fluidly connected to the chamber 116 and the working fluid outlet 126 can be located between the sample outlet 108 and the gas outlet 118 (for example, as shown in FIG. 22). In some examples, the working fluid outlet 126 can be fluidly connected to the gas outlet 118, for example as shown in FIG. 23.

Methods of Use

Also disclosed herein are methods comprising injecting a liquid sample into the sample inlet 106 of any of the apparatuses 100 described herein. In some examples, the liquid sample comprises a solvent and an analyte. The solvent, for example, can comprise water, methanol, or a combination thereof. In some examples, the liquid sample can comprise a biological sample (e.g., serum, proteins). In some examples, the analyte comprises a protein. The analyte can comprise an analyte with any relative proton affinity (e.g., a high proton affinity, a low proton affinity, etc.). In some examples, the liquid sample is injected from a liquid chromatographer.

In some examples, the liquid sample can be injected at a flow rate of 2 μL/min or more (e.g., 2.25 μL/min or more, 2.5 μL/min or more, 2.75 μL/min or more, 3 μL/min or more, 3.25 μL/min or more, 3.5 μL/min or more, 3.75 μL/min or more, 4 μL/min or more, 4.25 μL/min or more, 4.5 μL/min or more, or. 4.75 μL/min or more). In some examples, the liquid sample can be injected at a flow rate of 5 μL/min or less (e.g., 4.75 μL/min or less, 4.5 μL/min or less, 4.25 μL/min or less, 4 μL/min or less, 3.75 μL/min or less, 3.5 μL/min or less, 3.25 μL/min or less, 3 μL/min or less, 2.75 μL/min or less, 2.5 μL/min or less, or 2.25 μL/min or less). The flow rate that the liquid sample is injected at can range from any of the minimum values described above to any of the maximum values described above, for example from 2 μL/min to 5 μL/min (e.g., from 2 μL/min to 3.5 μL/min, from 3.5 μL/min to 5 μL/min, from 2 μL/min to 3 μL/min, from 3 μL/min to 4 μL/min, from 4 μL/min to 5 μL/min, or from 2.5 μL/min to 4.5 μL/min).

The method can further comprise forming a droplet of the liquid sample at the sample outlet 108, and injecting a working gas into the working gas inlet 122 and a carrier gas into the carrier gas inlet 120, thereby contacting the droplet with the working gas and the carrier gas. In some examples, the working gas can comprise an acid, a base, an oxidizer, or a combination thereof. Examples of acids include, but are not limited to, acetic acid, HCl, and combinations thereof. In some examples, the carrier gas is selected from nitrogen, helium, argon, hydrogen, oxygen, air, or a combination thereof.

In some examples, the sample capillary 104 can be in a retracted position, which can contain the droplet. The containment of the droplet can, for example, concentrate the droplet content (e.g., concentrate the liquid sample and/or analyte) in the chamber as a liquid thin film. Chemical reactions such as peptide synthesis and cross-linking can be performed in the resulting liquid film.

In some examples, a reaction can occur in the droplet. In these examples, the voltage applied to the sample capillary 104, the time for which the working gas is contacted with the droplet, the carrier gas, the pressure at which the carrier gas is injected, or a combination thereof can be selected to study the reaction occurring in the droplet (e.g., to study the reaction kinetics).

In some examples, contacting the droplet with the working gas can modify the pH of the droplet. In some examples, holding the droplet in the chamber at atmospheric pressure and applying a positive or negative potential to the sample capillary while contacting the droplet with a working gas comprising an acid or a base can substantially decrease or increase the pH of the droplet, respectively. In some examples, the pH of the droplet can be modified by adjusting the time for which the droplet is contacted with the working gas.

In some examples, the droplet is contacted with the working gas for 1 second or more (e.g., 5 seconds or more, 10 seconds or more, 15 seconds or more, 20 seconds or more, 25 seconds or more, 30 seconds or more, 35 seconds or more, 40 seconds or more, 45 seconds or more, 50 seconds or more, or 55 seconds or more). In some examples, the droplet is contacted with the working gas for 60 seconds or less (e.g., 55 seconds or less, 50 seconds or less, 45 seconds or less, 40 seconds or less, 35 seconds or less, 30 seconds or less, 25 seconds or less, 20 seconds or less, 15 seconds or less, 10 seconds or less, or 5 seconds or less). The amount of time the droplet is contacted with the working gas can range from any of the minimum values described above to any of the maximum values described above, for example from 1 second to 60 seconds (e.g., from 1 second to 30 seconds, from 30 seconds to 60 seconds, from 1 second to 20 seconds, from 20 seconds to 40 seconds, from 40 seconds to 60 seconds, or from 10 seconds to 50 seconds).

In some examples, the method can further comprise translocating the sample capillary 104 between a retracted position and an extended position.

In some examples, the methods can further comprise ejecting the droplet from the sample outlet 108.

In some examples, the ejected droplet comprises an ionized form of the analyte.

In some examples, ejecting the droplet comprises adjusting a pressure at which the working gas is injected, adjusting a pressure at which the carrier gas is injected, adjusting a flow rate at which the liquid sample is injected, adjusting the voltage applied to the sample capillary 104, or a combination thereof.

In some examples, the method can further comprise collecting the ejected droplet on a surface. In some examples, the ejected droplet can be collected on a surface at ambient conditions for subsequent use and/or analysis.

In some examples, the method can further comprise exposing the ejected droplet to electromagnetic radiation. The electromagnetic radiation can, for example, be selected from wavelengths of visible light, UV light, infrared light, or a combination thereof.

In some examples, the methods can further comprise exposing the droplet to electromagnetic radiation prior to ejecting the droplet. The electromagnetic radiation can, for example, be selected from wavelengths of visible light, UV light, infrared light, or a combination thereof.

In some examples, the methods can further comprise injecting the ejected droplet into an analyzer. In some examples, the analyzer can comprise a mass spectrometer. The mass spectrometer can be any suitable mass spectrometer, including a tandem mass spectrometer.

In some examples, the methods and apparatuses described herein can be used to analyze both polar and non-polar analytes in a single run.

Also disclosed herein are methods comprising injecting a liquid sample into the sample inlet 106 of any of the apparatuses 100 described herein; forming a droplet of the liquid sample at the sample outlet 108; injecting a working fluid into the working fluid source 124 and a carrier gas into the carrier gas inlet 120; and ejecting the droplet from the sample outlet 108. In these methods the droplet can be contacted with the carrier gas, the working fluid, or a combination thereof prior to ejection from the sample outlet, after ejection from the sample outlet, or a combination thereof. The working fluid, for example, can comprise a non-volatile working fluid, such as ammonium acetate. In some examples, ejecting the droplet can comprise adjusting a pressure at which the working fluid is injected, adjusting a pressure at which the carrier gas is injected, adjusting a flow rate at which the liquid sample is injected, adjusting the voltage applied to the sample capillary, or a combination thereof. In some examples, the method can further comprise translocating the sample capillary 104 to adjust the relative position of the sample outlet 108 with respect to the working fluid outlet and the gas outlet 118.

Applications

In some examples the apparatuses described herein can comprise an electrospray apparatus that can increase the residence time of reagents in a charged micro-droplet environment before they are released for collection and/or analysis, for example by forming a droplet at the sample outlet 108 of the sample capillary 104 while the sample capillary 104 is in the retracted position.

The apparatuses, systems and methods described herein can simplify mass spectrometry experiments by performing ion generation and reaction in a single step external to the mass spectrometer. Further, the samples can be accessible during the experiment, making it easy to collect reaction products for subsequent use, for characterization by various analytical methods, or a combination thereof, without the need to modify existing instruments.

The electrospray apparatus can offer high ion currents for situations in which sample volume is limited. In some examples, the electrospray apparatus can be used as an ion source for on-line mass spectrometric analysis, such as for enhancing electrospray ion yield and charge state for chemical components eluted from high pressure liquid chromatographic separation (HPLC). The apparatuses, systems, and methods described herein can, for example, be used to generate new techniques that can provide complementary information to those based on current mass spectrometric methods. The apparatuses, systems, and methods described herein can be used, for example, for accelerated green synthesis and modification of bio-molecules, reduction of waste and cost of wet chemical procedures, and the development of new tools for discovery and study of chemistry. The apparatuses, systems, and methods described herein can, for example, be used to perform chemical reactions, which can, for example, allow in-situ derivatization in a single stage MS experiment, green homogeneous catalysts in charged droplets with high atom economy (e.g., quantitative reaction).

Ionic species in a highly dispersed charged droplet environment at atmospheric pressure can resemble solution-phase reactions. The apparatuses, systems, and methods described herein can, for example, be used to obtain fundamental ion chemistry knowledge, which can, for example, increase the understanding of peptide/protein ion chemistry.

This apparatus can be used, for example, for bio-molecule charge state manipulation at atmospheric pressure, on-line manipulation of electrospray droplet content to enhance ion yield, peptide synthesis with limited number of protecting and activating steps, peptide cross-linking and bio-conjugation, and acceleration of organic reactions using mild starting conditions.

The systems and methods described herein can be useful in general for small-scale derivatization reactions and mechanistic studies. For example, the systems and methods described herein can be used in green chemistry reactions, meaning reactions performed under mild starting conditions (e.g., at room temperature and pressure, and the use of visible light) with minimal use of organic solvents and/or concentrated acid(s)/base(s).

The apparatuses, systems, and methods described herein can, in some examples, be used to study chemical reactions, for example reactions that are difficult to perform in the gas-phase and/or bulk solution-phase. Examples of chemical reactions that can be studied using the apparatuses, systems, and methods described herein include, but are not limited to, amide bond formation and acid catalyzed reactions involving the Girard T reagent with carbonyl compounds.

In some examples, the apparatuses, systems, and methods described herein can be used for performing ionic reactions in a charged micro-droplet environment. The apparatuses, systems, and methods described herein can provide insight into reaction mechanisms, access to new reaction pathways, and a greener means to increase reaction rates. Chemical reactions can be accelerated in a charged micro-droplet environment. New reaction pathways can also become available under the charged droplet reaction conditions, for example compared to the reaction pathway available in a bulk solution environment. In some examples, the reaction products can be collected for subsequent use or for characterization by various analytical methods such as mass spectrometry, nuclear magnetic resonance, surface enhanced Raman spectroscopy, etc.

In the apparatuses, systems, and methods discussed herein, molecular ions can be used as reagents for chemical reactions. The apparatuses, systems, and methods discussed herein can combine molecular ion generation and reaction in a single step, under ambient conditions. While previous studies in this area have focused on modification of rapidly moving electrospray droplets, the apparatuses, systems, and methods discussed herein focused on containing the droplets in a cavity, followed by in-situ chemical reactions through the exposure of the contained droplets/thin films with selected gaseous reagents, outside the analyzed (e.g., outside the mass spectrometer). The apparatuses, systems, and methods discussed herein can effectively control the reaction time for specific reactions. Coupled with tandem MS, these apparatuses, systems, and methods can be tools for structural characterization, allowing the study of chemical reactions, and for providing insight into existing chemical reaction mechanisms.

Many organic reactions occur through ionic intermediates. Traditionally, the formation of these ionic intermediates can be facilitated by the use of concentrated acid/base. Even under this acidic/basic condition, heating and long reaction times are often required to overcome the activation barrier, and to produce the desired reaction product in reasonable yield. In some examples, the apparatuses, systems, and methods discussed herein can achieve substantial pH changes in the absence of super acids because of the limited number of solvents in the reaction cavity (e.g., in the chamber when the sample capillary is in the retracted position). The charge state of molecules inside the droplets can be controlled by modifying the pH of the droplets. Holding the droplets in a cavity at atmospheric pressure and applying positive or negative DC potentials to the spray solution and using acid or base vapors can substantially decrease or increase the pH of the droplets, respectively. The droplet pH can be modified further by increasing the residence time of droplets in the cavity.

Moreover, the concentration of reagents in the thin-liquid film of the apparatuses, systems, and methods discussed herein can allow for effective collision of reactants. These factors can accelerate organic reactions that occur through ionic intermediates, but are difficult to achieve under bulk solution phase conditions. In other words, the apparatuses, systems, and methods discussed herein, can, in some examples, accelerate organic reactions that occur through ionic intermediates. In some examples, the apparatuses, systems, and methods discussed herein can accelerate the Borsche-Drechsel cyclization.

The isomerization of arenes can require harsh reaction conditions under traditional bulk-phase conditions. In some examples, the apparatuses, systems, and methods described herein can be used to study the isomerization of arenes, for example through phenyl shifts.

The high surface area of the droplets can, for example, enhance some physical processes in the apparatuses, systems, and methods described herein. For example, the high surface area of the droplets can enhance partitioning of gases into the droplet, which can, for example, allow for the effective use of gases in wet chemistry. For example, the apparatuses, systems, and methods described herein can be used for multi-component reactions, such as, for example, the Hantzsch dihydropyridine condensation, wherein ammonia gas can serve as the catalyst and the reactant.

In some examples, the apparatuses, systems, and methods described herein can be used to synthesize a variety of peptides with minimal use of protecting groups, and for intra- and inter-molecular cross-linking of peptides. The reaction products can, in some examples, be collected onto ambient surfaces for subsequent use and/or analysis. The apparatuses, systems, and methods described herein can, for example, be used for peptide/protein charge state manipulation and conjugation. The apparatuses, systems, and methods described herein can, for example, permit accelerated peptide bond formation, which can, for example, be used to generate peptide libraries for bio-medical research on a shorter time scale. The apparatuses, systems, and methods described herein can, for example, be used to study the effect of solvents on ion reactivity in a thin-liquid film/surface interface at atmospheric pressure, which can, for example, have implications in origin of life research. Also discuss herein are reactions under the charged micro-droplets environment that can be enhanced by a visible light, such as peptide/protein cross-linking and enzymatic reactions.

The modification of the droplet with an appropriate reagent (e.g., working gas or working fluid) can substantially eliminate any matrix effects, which can allow for direct analysis of complex samples. The apparatuses, systems, and methods described herein can, for example, overcome ion suppression effects, which, for example, can benefit quantitative ESI-MS and HPLC-ESI-MS techniques. The apparatuses, systems, and methods described herein can, for example, simplify ESI mass spectra for biopolymers, which is traditionally difficult to achieve at atmospheric pressures.

For example, the apparatuses, systems, and methods described herein can be used to explore and control peptide ion reactivity under ambient conditions. Peptides can play a role in numerous biological and physiological processes in living organisms; peptides can be used to prepare enzyme binding sites, epitope-specific antibodies, and to design enzymes, drugs and vaccines. Substantial activation energy can be required to form peptide bonds using protonated amine and activated carbonyl groups in the gas-phase (Wincel H et al. *Rapid Commun. Mass Spectrom.* 2000, 14, 135-140; McGee W M and McLuckey S A. *Proc. Nat. Acad. Sci.,* 2014, 111 1288-1292; Lee S et al. *J. Am. Chem. Soc.* 2011, 133, 1583-1537). This reaction can also be slow under conventional bulk-phase conditions (Al-Warhi T I et al. *J. Saudi Chem. Soc.* 2012, 16(2), 97-116; Pattabiraman V R and Bode J W. *Nature* 2011, 480(7378), 471-479; Dawson P E et al. *Science* 1994, 266(5186), 776-779). The methods of peptide synthesis and modification can be expensive, time consuming, and wasteful. Under the charged micro-droplet environment, however, the amine and the activated carbonyl group can react quickly and quantitatively to give a product. For such chemical systems, the accelerated micro-droplet reaction conditions can bridge the gap between bulk-phase and gas-phase reaction conditions.

Disclosed herein are methods of peptide synthesis and cross-linking which employ charged micro-droplets/thin films as reaction media. The electrospray apparatus described herein can be used as an ion source/reaction apparatus that can control the reaction conditions in the charged droplet/thin film environment. Protein synthesis or cross-linking methods using the electrospray apparatus can, for example, be completed in a few minutes. The methods described herein can be quantitative (e.g., yield ~100%), and can generate little or no by-products. Unlike vacuum-based preparative MS methods, the methods described herein can be performed at atmospheric pressure. In the vacuum-based mass spectrometric method of peptide reactions, the peptides ions are first mass-selected and allowed to react at surfaces through the ion soft landing experiment. In this case, the surface is modified with peptide ions through the formation of peptide bonds. In different MS experiments, the selected gas-phase peptide ions can be allowed to react with gaseous neutral molecules in ion/molecule reaction experiment or with oppositely charged ions in an ion/ion reaction experiment. The atmospheric pressure droplet reaction condition is different from the gas-phase ion/molecule or ion/ion reaction conditions in that no reactant activation is needed to achieve peptide bond formation, and the collection of resultant reaction products is straightforward.

A challenge in solution-phase peptide synthesis can be the connection of amino acids in the correct sequence. This is often achieved by protecting the nitrogen of one amino acid, the carboxyl group of another, and the reactive side groups in some amino acids such the ϵ-amine group in lysine. The number of steps including activation, protection, and deprotection quickly rises as peptide chain length is increased. The methods discussed herein can produce peptides in a rapid manner through reagent concentration and by reducing the number of protection/deprotection steps. In addition, control of the reaction conditions under the micro-droplet environment can achieve quantitative conversion of reactants into the desired reaction product, thereby minimizing the need for extensive product purification steps.

The apparatuses, systems and methods described herein can be used to perform cross-linking and analysis of peptides in a single stage MS experiment. Chemical cross-linking can allow higher resolution structural data to be generated where protein-protein interactions can be mapped to specific domains or amino acids. Further, cross-linking can allow non-covalent protein-protein interactions, which can be transient or dependent on specific physiological conditions, to be captured into long-lived covalent complexes that can maintain structural information during subsequent purification, enrichment, and analysis. The apparatuses, systems, and methods discussed herein can, for example be used for cross-linking of peptides using small volumes of samples, and, in some example, occurring rapidly (e.g., on a short time scale).

The apparatuses, systems, and methods discussed herein can be used for the analysis of a variety of mixture samples, for example in an on-line LC-MS format or through direct infusion experiments. For example, the apparatuses, systems, and methods described herein can be used for protein/peptide characterization using LC-ESI-MS(/MS). Current challenges in protein/peptide analysis using LC-ESI-MS include sample handling to prevent protein precipitation/aggregation during separation, and detection of various classes of proteins (membrane proteins, large vs. small protein, etc.) from a given sample in a single run. Generally, the selected buffer solution used for the separation step is not necessarily suited for ESI-MS analysis. The apparatuses, systems, and methods described herein can be used for optimization of an ESI-MS method that can be extended beyond the typical parameters such as cone/skimmer voltages, heated capillary temperature and buffer composition.

There is still a growing need for greater sensitivity for electrospray ionization to better detect, identify, and quantify biomolecules in proteomics. The apparatuses, systems, and methods described herein can, for example, benefit proteomics by contributing to structural characterization using mass spectrometric methods in an open laboratory environment (e.g., at atmospheric pressure). The apparatuses, systems, and methods discussed herein can be used for various types of biomolecules, including glycoproteins. Improvements in measurement sensitivity can enable different approaches, while extensions to the range of measurable proteins can facilitate identification of disease specific biomarkers.

The apparatuses, systems, and methods discussed herein can be used, for example, as an interface for LC and high resolution MS (e.g., FT-ICR or Orbitrap), for example for use in top-down proteomics. Currently, there are two complementary approaches in MS-based proteomics: bottom-up and top-down. With tremendous efforts dedicated to the development of hardware and software in the past decade, bottom-up shotgun proteomics serves as a workhorse in modern proteomics, with high throughput and automation. Nevertheless, because each protein is digested into many small peptide components, the overall complexity of the sample is increased. In contrast, the top-down proteomics, which identifies proteins based on intact molecular ions, is still in its early developmental stage and has yet to fully overcome its technical challenges in sample preparation, instrument sensitivity/detection limit, and throughput/automation. New technological developments are therefore needed to advance top-down proteomics for the analysis of complex samples of cell/tissue lysates and biological fluids like serum. The apparatuses, systems, and methods discussed herein can, for example, provide a high resolution instrument and the contained-ES ion source (capable of producing high singly-charged ion currents), which can provide a platform for rapid and sensitive detection of protein mixtures directly from solution.

The examples below are intended to further illustrate certain aspects of the systems and methods described herein, and are not intended to limit the scope of the claims.

EXAMPLES

The following examples are set forth below to illustrate the methods and results according to the disclosed subject matter. These examples are not intended to be inclusive of all aspects of the subject matter disclosed herein, but rather to illustrate representative methods and results. These examples are not intended to exclude equivalents and variations of the present invention which are apparent to one skilled in the art.

Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of reaction conditions, e.g., component concentrations, temperatures, pressures and other reaction ranges and conditions that can be used to optimize the product purity and yield obtained from the described process.

Example 1

Figure 3:
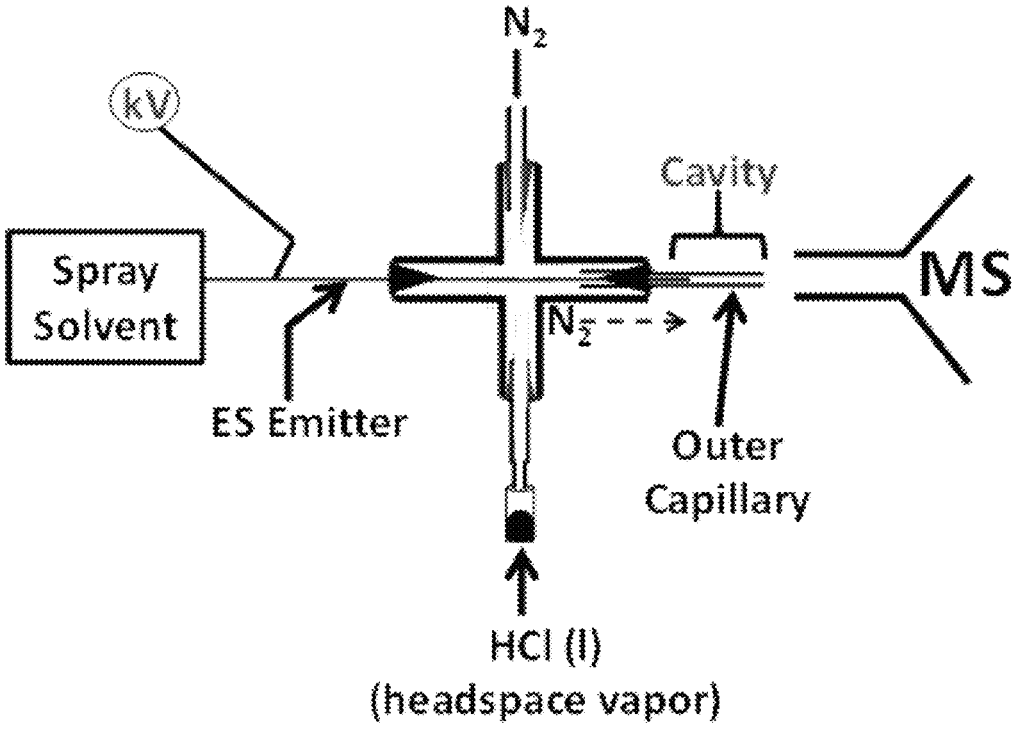
FIG. 3 is a schematic representation of the experimental apparatus for the contained electrospray (ES) process using type II operational set-up.

An apparatus for contained-electrospray was constructed (FIG. 3). To construct this apparatus, an electrospray (ES) emitter (100 μm ID fused silica (FS) capillary) was inserted into a second/outer capillary (250 μm ID FS capillary). The apparatus was created from a cross Swagelok element that allowed three inputs: (1) the sample or spray solvent, (2) $N_2$ nebulizer gas, and (3) headspace vapor of a reactive gas (e.g., HCl). The headspace vapor of a reactive gas was used for in-situ modification of the ES droplets that resulted after applying high DC voltage to the ES emitter. There is only one outlet, for all inputs, that allowed the release of the modified droplets. The nature of reactive gas used (e.g., acid, base, oxidant, etc.) and the mode of operation of the contained-ES apparatus determined the extent/type of droplet modification.

Figure 4:
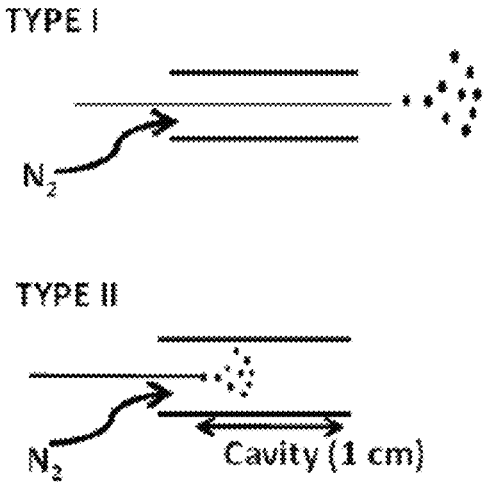
FIG. 4 is a schematic representation of the two operation modes of the ES apparatus: type I and type II.

The apparatus can be operated in two modes: type I and type II (FIG. 4). The function of the type I operation mode is similar to that of the conventional electrosonic spray ionization (ESSI), with the inner ES capillary pulled slightly (~1 mm) outside of the outer capillary. In the experiments herein, the droplets were modified in-situ with headspace vapor of a selected reagent (e.g., HCl). In type II operation mode, the electrospray emitter is pulled inside the outer capillary to create a cavity. This cavity allowed the resulting droplets to be contained for a selected time, and thus enhanced further modification, including covalent bond formation in the droplet.

Example 2

Figure 5:
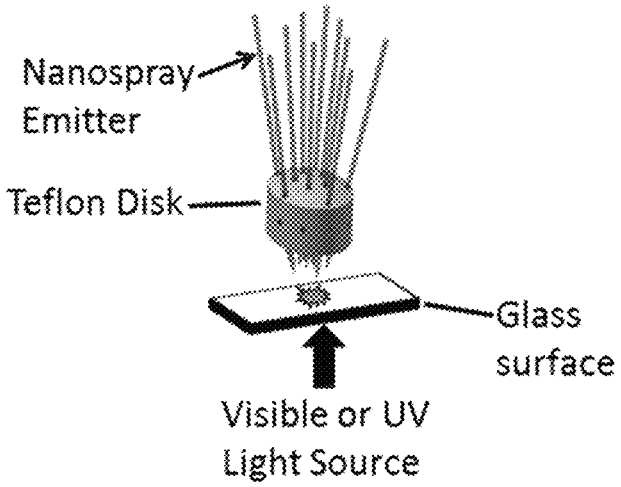
FIG. 5 is a schematic representation of a nanospray emitter array of ten glass capillaries held in a Teflon holder. The reaction surface is a glass slide, and the droplet reaction environment can be exposed to visible or ultraviolet (UV) light supplied from below the transparent glass surface.

A nano-electrospray (nanospray) array was created by arranging nanospray emitters in two or more concentric circles, all pointing towards a common area (FIG. 5). In this way, high currents (~0.6 μA) of nano-sprayed molecular cations/anions can be concentrated in a small area where chemical reactions can occur at the ambient surface, which can be pre-coated with reagents.

This nanospray array apparatus can be used with a wide variety of reagents, for example for peptide synthesis and bio-conjugation. The system can further include a light source, such as a visible or ultra violet light (FIG. 5).

This light-assisted system can be used, for example, for the modification, cross-linking and/or bio-conjugation of antibodies, antigens, and/or protein complexes. For example, peptide bond formation under in a charged droplet is spontaneous, which can result in exclusive intra-molecular peptide cross-linking. The cross-linking process itself was found to be quantitative, resulting in about 98% product yield within 60 seconds of surface reaction (Badu-Tawiah A K et al. *Angew. Chem. Int. Ed.* 2012, 51, 9417-9421).

Example 3

The contained-ES apparatus was used to concentrate electrospray droplets, and to modify their pH. The acid-catalyzed reaction of Girard T reagent and a carbonyl compound (e.g., cortisone) were chosen for this experiment because the reaction occurs slowly in solution conditions. Furthermore, steroids (e.g., cortisone) are difficult to analyze by ESI due to their low proton affinities, so this experiment also illustrates the capacity of the contained-ES apparatus to use chemical reactions for enhanced analyte detection in a single step.

Figure 6A:
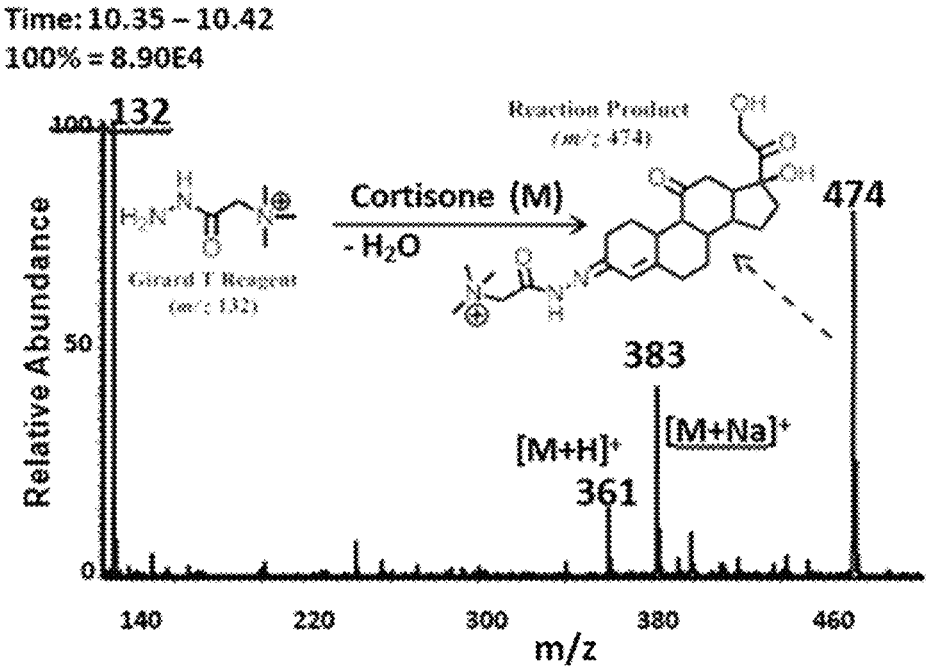
FIG. 6A shows the analysis of a reaction mixture of 10 ppm cortisone and 5 ppm Girard T reagent in methanol/water (50/50, v/v) after 60 s accumulation in the contained ES-MS. Neutral solutions were used before electrospray, but HCl vapor was introduced into the reaction cavity via the $N_2$ nebulizing gas (80 psi).
Figure 6B:
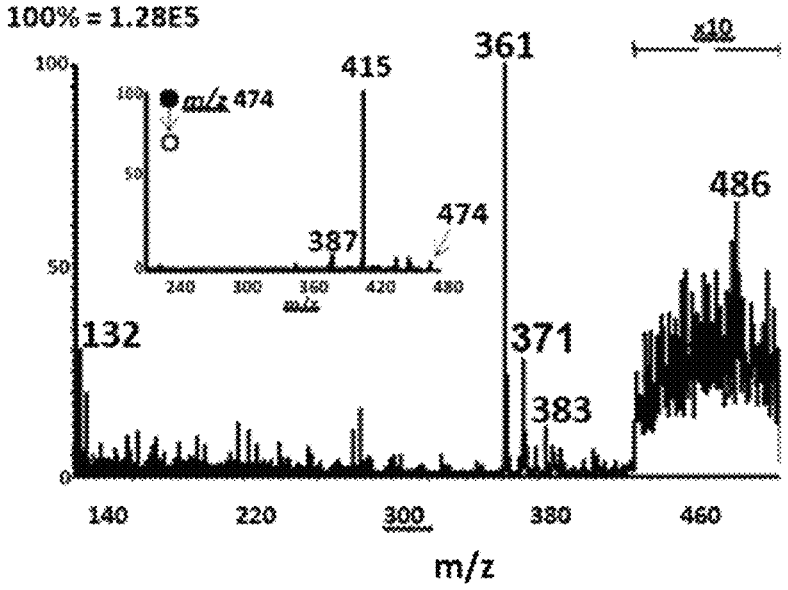
FIG. 6B shows the analysis of a reaction mixture of 10 ppm cortisone and 5 ppm Girard T reagent in methanol/water (50/50, v/v) after 60 s accumulation in the nanospray-MS of solution phase reaction mixture at pH 3.0, after 60 min of mixing shows mainly unreacted species (1.8 kV spray voltage). The insert is a typical $MS^2$ product ion spectrum of the m/z 474 via a loss of trimethylamine (MW 59), and illustrating the sensitivity of MS/MS.
Figure 6C:
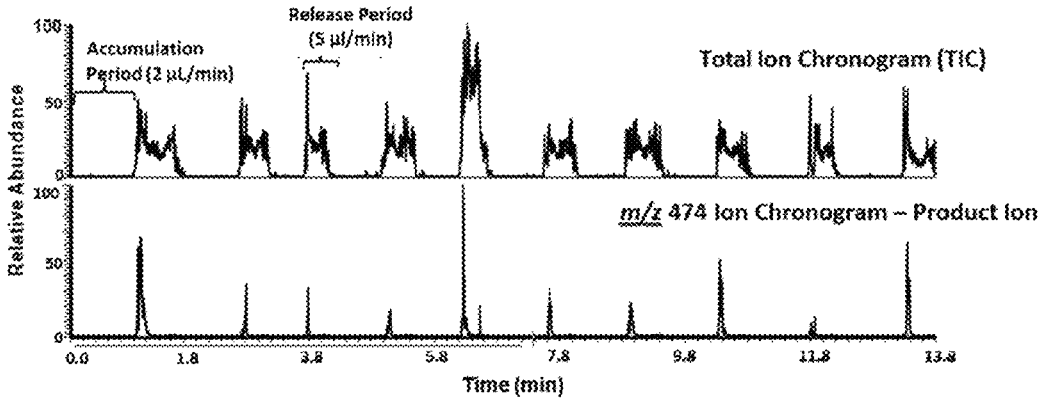
FIG. 6C shows a comparison of total ion chromatograms (TIC) and selected ion chromatogram for m/z 474 of a reaction mixture of 10 ppm cortisone and 5 ppm Girard T reagent in methanol/water (50/50, v/v) after 60 s accumulation showing the formation of product ions (m/z 474) relative to unreacted reagents. Neutral solutions were used before electrospray, but HCl vapor was introduced into the reaction cavity via the $N_2$ nebulizing gas (80 psi).

A reaction mixture consisting of 10 ppm cortisone and 5 ppm Girard T reagent in methanol/water (50/50, vol/vo.) was electrosprayed at a flow rate of 2 μL/min (5 kV spray voltage, and $N_2$ nebulizer gas pressure of 80 psi). The resultant charged droplets were accumulated for 60 s in the cavity created in the contained-ES apparatus (type II operation mode). During the accumulation period, the droplets/thin film was exposed to headspace vapor of HCl. After 60 s of droplet containment, the solvent flow rate was increased from 2 to 5 μL/min to trigger the release of reaction product from the cavity. The solvent flow rate was then kept at 5 μL/min for only 10 s before switching back to 2 μL/min to begin another cycle of droplet accumulation. The droplet accumulation and release was repeated 10 times. Results from this experiment indicated that reaction between cortisone and Girard T can be accelerated by containing the reaction mixture, in the form of charged liquid film, for only 60 seconds (FIG. 6A-FIG. 6C).

The contained-ES MS (FIG. 6A) was recorded after 60 s of reaction mixture accumulation by setting the apparatus in front of the mass spectrometer. This is the mass spectra recorded during the 8th accumulation/release period (time=10.35-10.53 minutes in FIG. 6C), which is representative of all the other cycles. Compared with 60 minutes of bulk solution-phase reaction time, at pH 3 and ambient temperature (FIG. 6B), the reaction yield is greatly enhanced when reagents are sprayed using the contained-ES apparatus even though the time scale is much shorter.

These results indicate that the contained-ES process can be used to enhance the efficiency of reaction systems.

Furthermore, the Girard T reaction with cortisone can be used to study the effect of operating conditions of the contained-ES apparatus on the reaction yield. Specifically, the effect of the solvent can be studied by using various solvents and comparing to the results. A balance is sought between solvents that can form stable electrospray, and those that allow rapid chemical reaction. In addition, the type and pressure of nebulizer gas can be varied to study their ability to carry headspace vapor of different acids, bases or oxidizing agents.

The results of the Girard T reaction with cortisone suggested that the primary charged droplets emerging from the ES emitter can be converted into thin liquid film in which the reactants can be accumulated and reacted. Further experimental designs can be used to probe into the actual reaction environment that exists during droplet containment. The use of a transparent glass outer capillary, for example, can allow for direct high speed imaging of the accumulation period.

Inclusion of pH indicators in the spray solvent can yield information about pH changes that occur during reaction.

In addition to changes in solvent flow rate to cause the release of the contained reaction products, other trigger mechanisms, such as changes in nebulizer gas pressure, can be used. Algorithms to control/automate accumulation and release steps can also be used.

Several factors can cause the reaction products to be formed during the contained-ES process, operated in the type II mode: (i) reactant concentration during accumulation, (ii) extreme pH changes in the cavity for acid/base catalyzed reactions, and (iii) rapid reagent mixing due to turbulence caused from the sudden change in solvent flow rates—from low (accumulation) to high (release). To investigate the effect of turbulence on product formation, the reaction mixture for an acid-catalyzed reaction can be sprayed at a low flow rate in the presence of the headspace vapor of an acid. The spray can be stopped without a release spray step, and the outer capillary can be removed and washed. The presence of reaction products in the outer capillary can indicate the reaction occurred during the accumulation period, and that turbulence is not important in product formation. Likewise, the same experiment can be performed with and without acid to access pH effects.

Example 4

As already explained, the contained-ES apparatus can be operated in two modes (FIG. 4). The difference is in the presence (type II operation mode) or absence (type I operation mode) of the cavity. Little to no chemical reactions/modifications are observed if a reaction mixture is electrosprayed using the type I operation mode. Instead, ion suppression effects (in the presence of endogenous or exogenous species) typically observed for mixture analysis using ESI can be eliminated.

Figure 7A:
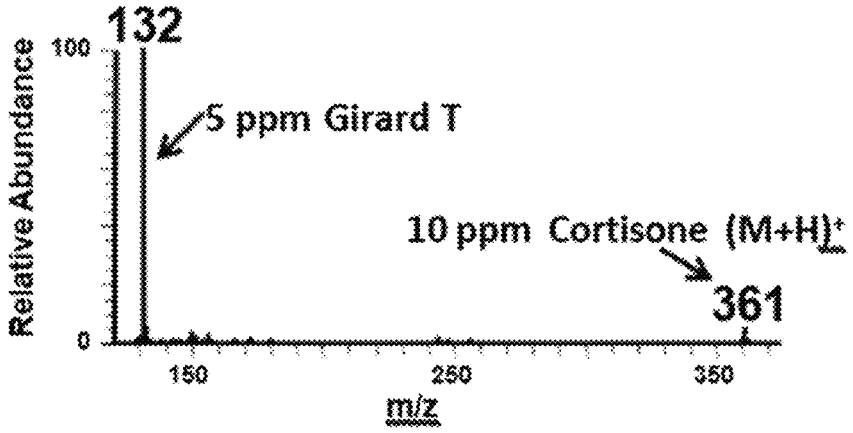
FIG. 7A shows the ESI-MS of a mixture comprising equal aliquots of 10 ppm cortisone (MW 360) and 5 ppm Girard T reagent (MW 132) recorded at 5 μl/min flow rate at a neutral pH (e.g., no acid used).
Figure 7B:
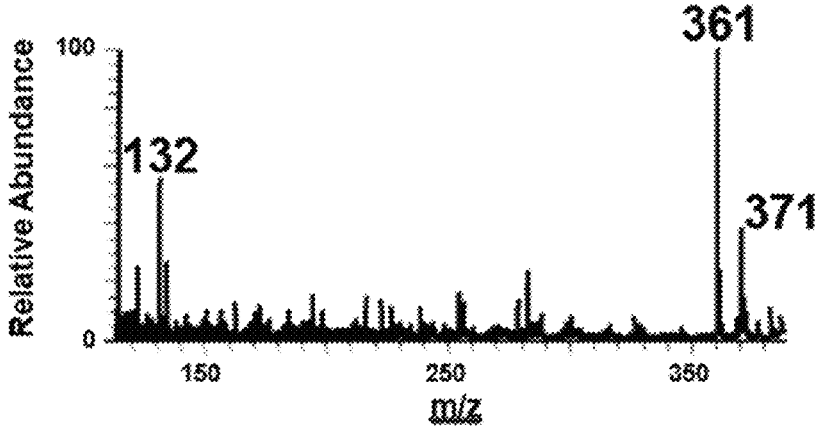
FIG. 7B shows the ESI-MS of a mixture comprising equal aliquots of 10 ppm cortisone (MW 360) and 5 ppm Girard T reagent (MW 132) recorded at 5 μl/min flow rate at pH 3.
Figure 7C:
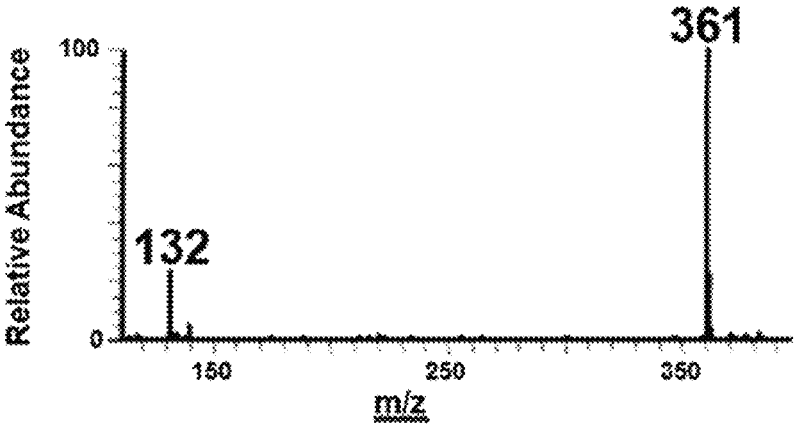
FIG. 7C shows the ESI-MS of a mixture comprising equal aliquots of 10 ppm cortisone (MW 360) and 5 ppm Girard T reagent (MW 132) recorded at 5 μl/min flow rate after exposure of the mixture prepared at neutral pH to headspace vapor of HCl.

For example, FIG. 7A shows a typical ESI-MS analysis of a mixture consisting of equal aliquots of 10 ppm cortisone (MW 360) and 5 ppm Girard T reagent (quaternary ammonium salt, MW 132) at neutral pH. The results showed significant suppression effect by the quaternary ammonium ion (Pan P and McLuckey S A. *Anal. Chem.* 2003, 75, 5468-5474). Improvement in ion suppression was observed when the mixture was prepared at pH 3 (FIG. 7B), with cortisone ions (m/z 361) showing higher abundance compared with ions from the Girard T reagent. In another experiment, the mixture at neutral pH was analyzed, but the derived electrospray droplets were briefly exposed to headspace vapor of HCl, using the contained-ES apparatus without the cavity. As can be observed from FIG. 7C, the signal-to-noise ratio of the ESI-MS spectrum was improved compared to when the pH of the starting solution was adjusted (FIG. 7B), and the ion intensities roughly corresponded to relative amounts of the analytes present in the mixture.

Example 5

Figure 8A:
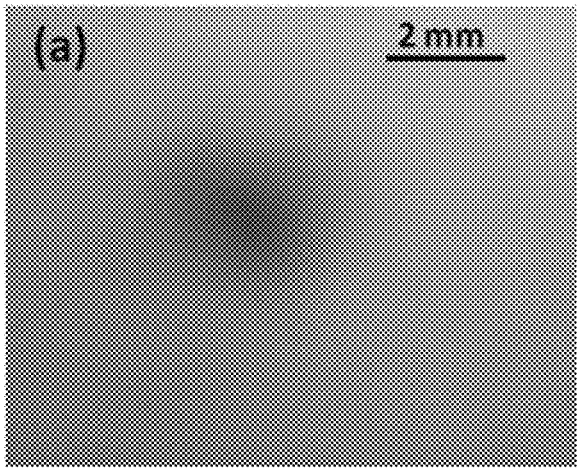
FIG. 8A shows the color change resulting from exposure of water sensitive paper with electrospray droplets for 30 seconds for traditional electrospray.
Figure 8B:
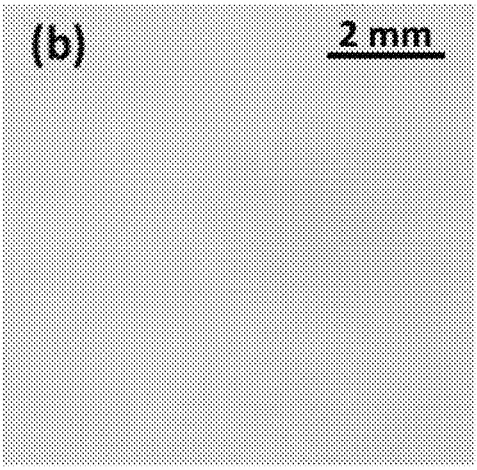
FIG. 8B shows the color change resulting from exposure of water sensitive paper with electrospray droplets for 20 minutes for contained-ES.
Figure 9:
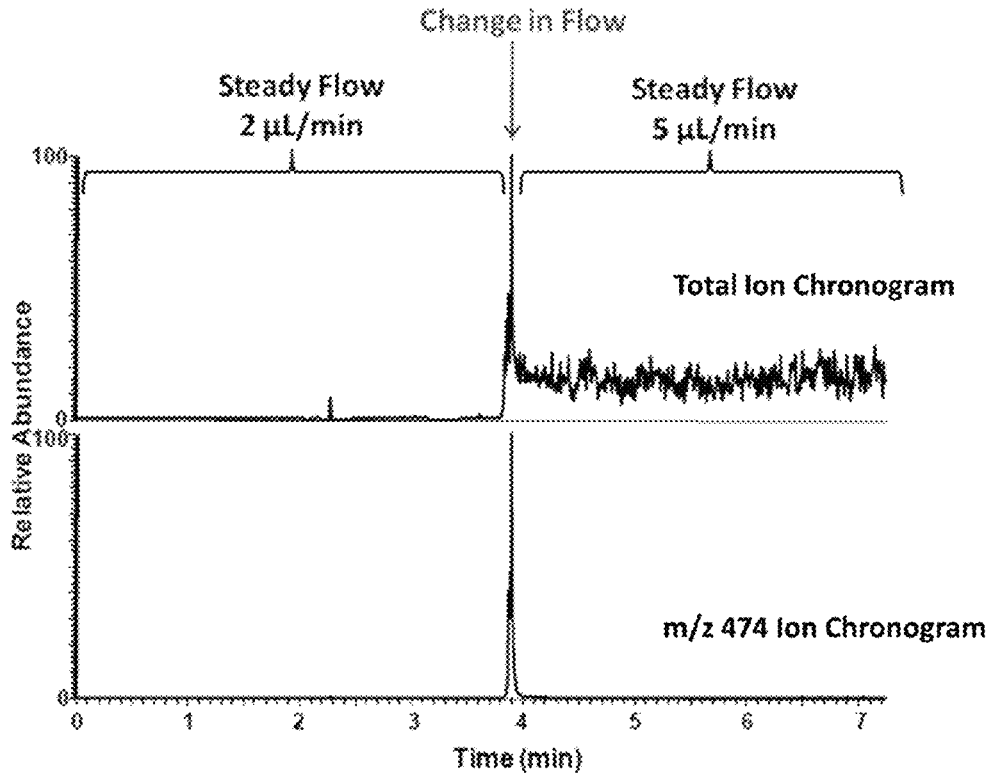
FIG. 9 shows the release of covalently modified reactants (product at m/z 474) after 4 minutes of Girard T and cortisone containment.

The contained electrospray (contained-ES) process can hold primary electrospray droplets for a given amount of time before their release for mass analysis (FIG. 8A and FIG. 8B). The containment process can result in liquid-thin-film formation, inside the outer capillary, that can serve as a chemical reactor, capable of hosting chemical reactions involving proton or electron transfer, and even covalent bond formation. For example, when a solution consisting of Girard T reagent and cortisone were electrosprayed using the contained-ES apparatus, at a flow rate of 2 μL/min, reactants were found to be contained until flow rate was increased from 2 to 5 μL/min (FIG. 9). Due to the low pH condition within the cavity during reagent containment, the reactants were effectively converted into product (m/z 474, see insert of FIG. 6A for reaction scheme).

Similarly, if a mixture of negatively charged protein ions are contained at low pH for a given time, effective protonation can be expected that may result in the generation of predominantly singly (or significantly reduced charge state) charged species. In this way, the problem of spectra overlap associated with typical ESI-MS recorded for mixtures may be solved. Controlled charged state manipulation has been a subject of ESI-MS for the past three decades. It has typically been performed under reduced pressure, and is only localized in few academic research groups. Performing this experiment at atmospheric pressure, employing a slightly modified ESI ion source, may open the door to a wide spread use of the method, and thus simplifying data interpretation. Droplet pH may be controlled in two ways: first, by varying the residence time of protein in the cavity, and second, by varying the pressure of the nitrogen nebulizer gas. The application of positive or negative voltage to a spray solution yields positively- and negatively-charged droplets, respectively, and exposure of these charged droplets to headspace vapor of acid or base can modify the pH of the droplets. Experiments can be performed in positive ion mode for proteins, and negative ion mode for nucleotides. Again, the contained-ES apparatus can serve as the ion source for mass analysis of analytes.

Example 6

Figure 10:
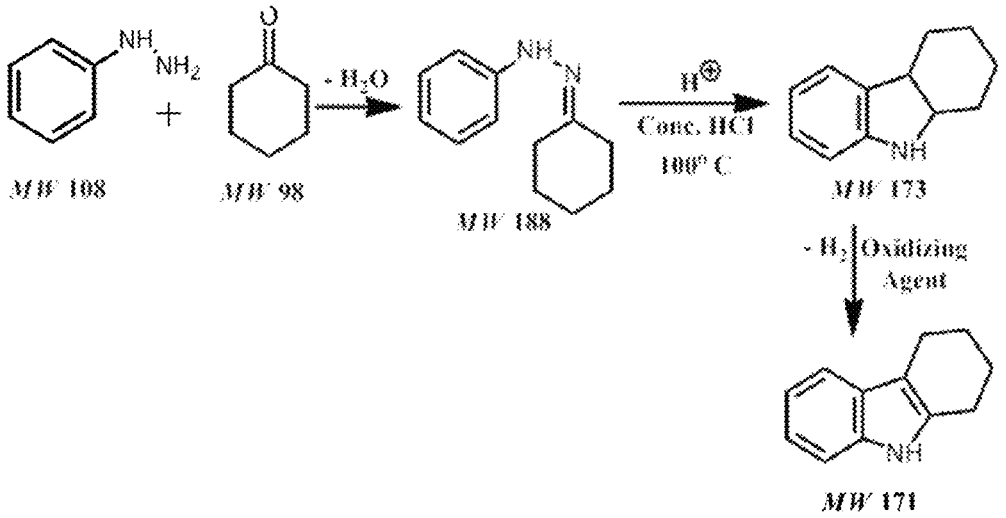
FIG. 10 shows the Borsche-Drechsel cyclization reaction.
Figure 11:
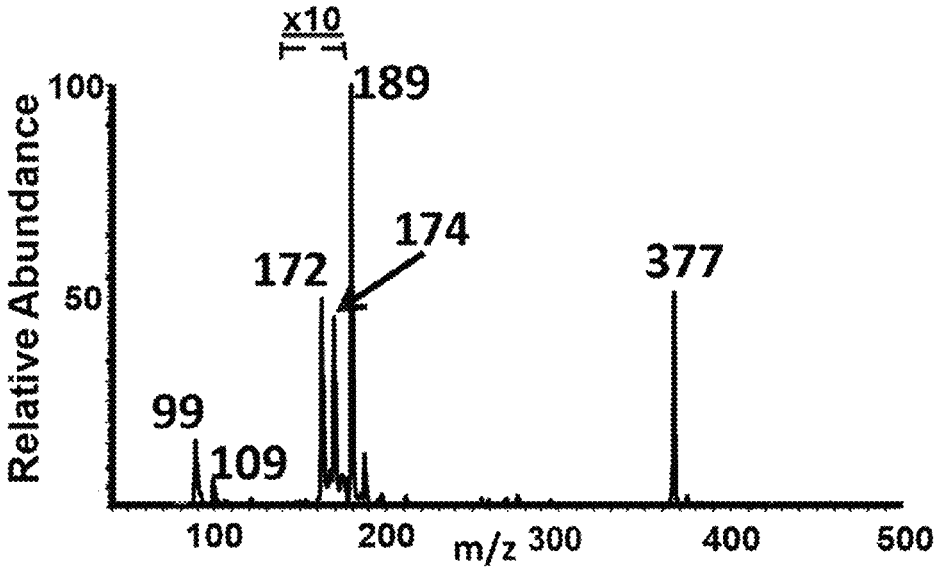
FIG. 11 shows the contained-ES-MS showing protonated Borsche-Drechsel cyclization product at m/z 172 generated from phenylhydrazine and cyclohexanone after HCl vapor was introduced into the cavity.

The Borsche-Drechsel cyclization (FIG. 10) is achieved conventionally under bulk solution-phase conditions by heating the reaction mixture in the presence of concentrated hydrochloric acid. The hexahydrocarbazole product (MW 173) can be converted via dehydrogenation into the tetrahydrocarbazole product (MW 171). Herein, 1 mL of methanol solution containing 2 μL each of the two reactants, phenylhydrazine (MW 108, 2160 ppm) and cyclohexanone (MW 98, 1622 ppm), was sprayed and analyzed using the contained-ES apparatus. When on-line reaction monitoring was performed on this mixture, the protonated form of the condensation product, cyclohexanone phenylhydrazone (m/z 189) was predominantly generated without introducing acid vapor into the reaction cavity. However, the protonated dihydrocabazole product ion (m/z 174) was not detected, indicating that observable cyclization had not occurred. Likewise, nanospray analysis of the bulk solution-phase reaction (60 min) mixture without acid produced no cyclization product at m/z 174. The desired cyclization product did result when allowing HCl vapor into the reaction cavity of the contained-ES apparatus (FIG. 11). This contained-ES mass spectrum was recorded 60 seconds after ES droplet accumulation time at a solvent flow rate of 2 μL/min. The tetrahydrocabazole reaction product (m/z 172) was also observed under the charged droplet environment in the absence of oxidizing agents. This experiment indicates this strategy can be used to study uncommon reactions under mild starting conditions. The small scale synthesis has some advantages over bulk phase methods in terms of limited use of unfriendly organic reagents, and the opportunity to discover new reaction pathways. The observation of the product (m/z 172) in the absence of oxidizing agent can be due to a combined effect of increased collision, oxidation at ESI emitter, and pH effect. Therefore, this reaction may occur through a different mechanism than the one illustrated in FIG. 10.

Example 7

Figure 12:
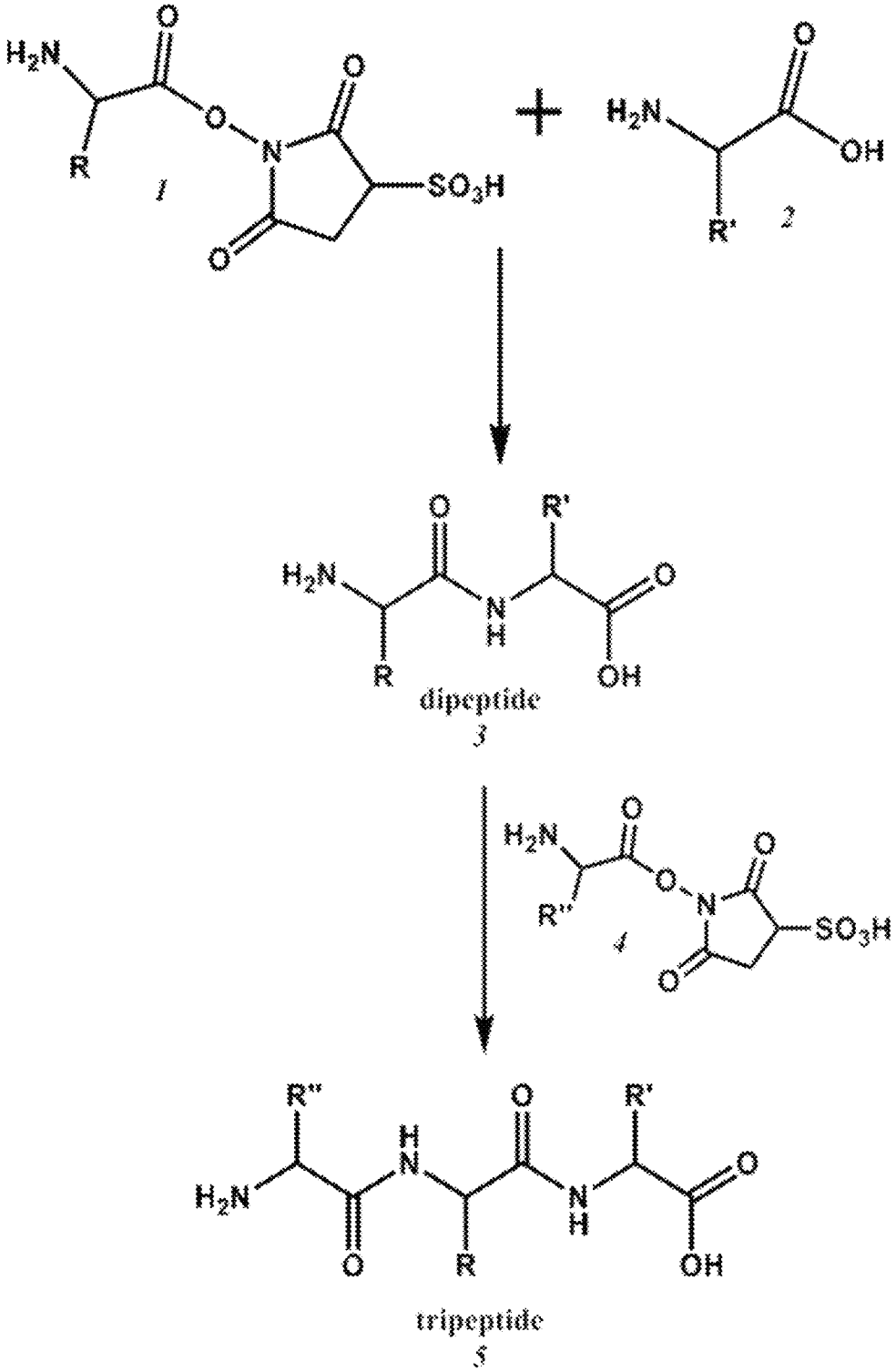
FIG. 12 shows the reactions leading to peptide bond formation, and the sequential production of formation of a dipeptide and a tripeptide in a single spray experiment.

Activated carbonyl carbons in ester functional groups can react spontaneously with free amines to produce peptide bonds under charged micro-droplet environment at ambient surfaces (Sparrapan R et al. *J. Mass Spectrom,* 2006, 41(9), 1242-1264). However, no reaction product was recorded when a similar experiment was conducted under reactive desorption electrospray ionization (DESI) conditions, suggesting that the reagent resident time in the droplet can be important for this reaction, and perhaps, longer reaction times than the millisecond time scale of the DESI process are needed. The contained-ES apparatus can offer the reaction time needed for peptide bond formation, and the apparatus can be used for accelerated peptide synthesis (FIG. 12).

This experiment can: accelerate the rate of peptide bond formation, reduce waste production, and limit protection/deprotection steps. Reaction of the NHS-modified amino acid (1, FIG. 12) with a second amino acid of choice should yield a clean un-protected dipeptide (2, FIG. 12). This reaction can be performed by pre-mixing two amino acids, and spraying the resultant solution using the contained-ES apparatus. Appropriate droplet containment time can be employed during the electrospray process. The dipeptide reaction product (3) can be formed in the cavity of the contained-ES apparatus, and the N-terminus of this dipeptide can be reacted further with another NHS-activated amino acid (4) by directing the released droplets onto a surface pre-coated with (4). This reaction can produce a tripeptide (5) at the reaction surface, in a single spray experiment. In some examples, the apparatus can allow the combination of more than three amino acids before the final droplets arriving at the collector surface.

First, experiments can be conducted using amino acids with no reactive side groups (e.g., glycine, alanine, etc.); in this case, no side reactions are expected since the N-terminus is the only free amine group available for reaction with NHS-activated ester moiety. Second, appropriate containment conditions (e.g., time, pressure, acid vs. base vapor, etc.) can be developed for amino acids containing reactive amine groups in their R residue (e.g., lysine, arginine, etc.) so that preferential protonation occurs at the most basic site, and thus leaving the N-terminus for reaction. Also, activating the C-terminus of the amino acid having a reactive side group can permit its selective reaction with the N-terminus of the second amino acid. In some examples, appropriate protecting groups can be utilized.

Figure 13A:
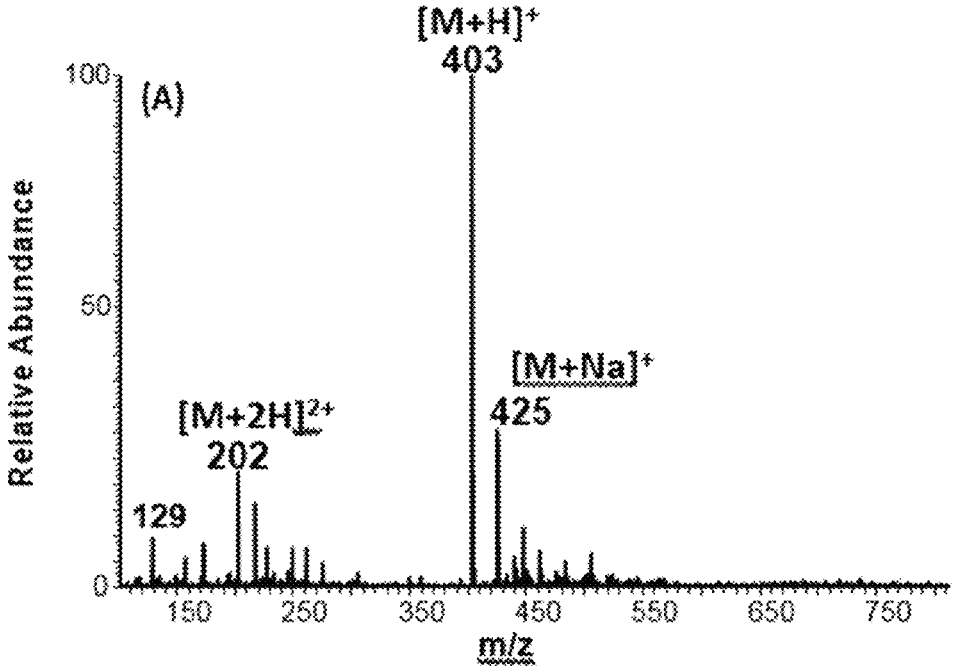
FIG. 13A shows the contained-ES mass spectra obtained for pure 100 ppm KKK (MW 402). Headspace vapor of HCL was allowed in the apparatus; 3 is the cross-linked product, and 2 is the intermediate covalently modified product. Peaks at m/z 413 and 595 are unrelated background ions.
Figure 13B:
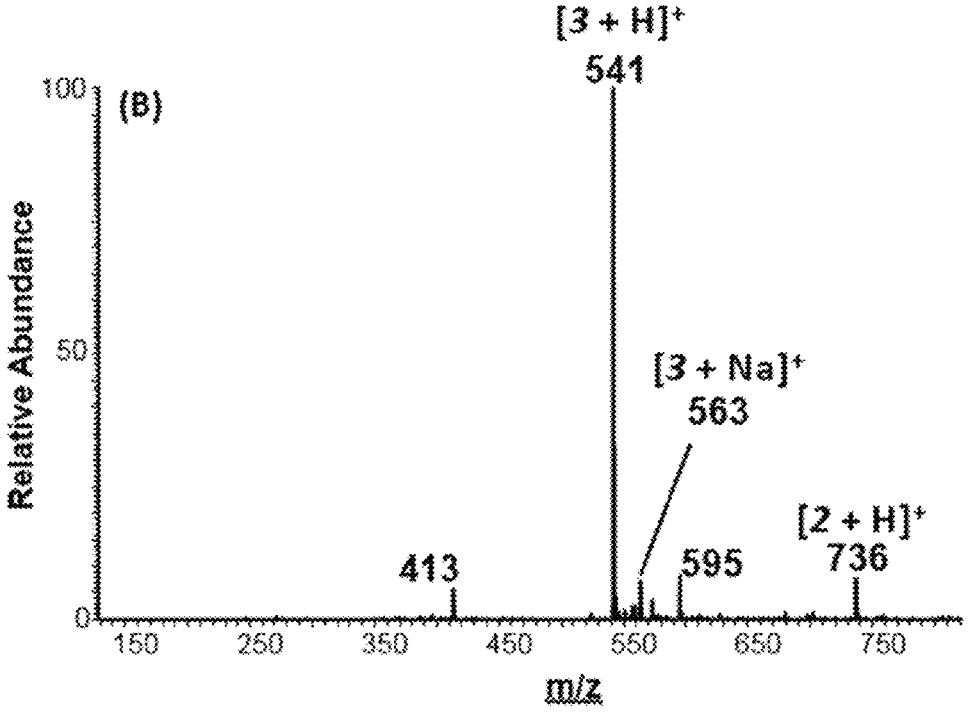
FIG. 13B shows the contained-ES mass spectra obtained for a reaction mixture of suberic acid bis(3-sulfo-N-hydroxysuccinimide ester) (SBS, 50 ppm) and KKK (100 ppm) prepared in methanol/water (50/50) solution. Headspace vapor of HCL was allowed in the apparatus; 3 is the cross-linked product, and 2 is the intermediate covalently modified product. Peaks at m/z 413 and 595 are unrelated background ions.

Experiments have shown that an activated carbonyl groups in suberic acid bis(3-sulfo-N-hydroxysuccinimide ester) reacts favorably with amine groups under the contained-ES spray condition (FIG. 13A and FIG. 13B).

Example 8

Bio-conjugation and cross-linking technologies have provided a means to investigate protein-protein (/peptide) interactions. Commercially available cross-linking reagents have a wide range of characteristics, including functional group specificity, homo- and hetero-bifunctionality, variable spacer length, and cleavable linkages. Herein, the development of methods that can enable effective capture of transient protein/peptide complexes, improvement of the selectivity of the cross-linking process, and quenching strategies are investigated.

Most protein-protein bindings are transient and occur only briefly. It is therefore necessary for the cross-linking reagent to react faster to enable "freezing" of these momentary contacts. The charged micro-droplet environment can serve to facilitate the cross-linking process. Cross-linking of amine groups in oligolysine peptides (Kn, n=3, 5) using a homo-bifunctional cross-linker, suberic acid bis(3-sulfo-N-hydroxysuccinimide ester) (SBS) sodium salt is effective under the charged micro-droplet environment at ambient surfaces (Sparrapan R et al. *J. Mass Spectrom,* 2006, 41(9), 1242-1264). The fact that this droplet reaction resulted in exclusive intra-molecular cross-linking indicates the reaction is fast.

FIG. 13B is an example of accelerated KKK cross-linking using the contained-ES apparatus. Here, equal aliquots of 100 ppm KKK (M) and 50 ppm SBS solutions prepared in methanol/water (50/50, vol/vol) were mixed and electrosprayed using the contained-ES apparatus in type II mode. The reaction between KKK and SBS proceeded to give intra-molecular cross-linked product (3, m/z 541) with the collection of a small amount of the intermediate product (2) at m/z 736. Notice that all KKK reactants (typical mass spectrum shown in FIG. 13A) were consumed during the spray process—indicated by the absence of peaks at m/z 202 (M+2H)2+ and 403 (M+H)+ in FIG. 13B. This charged droplet-based peptide cross-linking process can be further optimized for other functional groups (e.g., sulfhydryls, carboxyls, carbonyls, or hydroxyls). The length of the cross-linker can also be optimized allow inter-molecular cross-linking The addition of homo- or hetero-bifunctional cross-linkers to protein mixtures can result in many protein conjugates, some of which are not directly involved in the target protein-protein interactions. Photo-activate cross-linkers have been used to improve the selectivity of the cross-linking process, especially for cell lysates (Garcia-Amor J et al. *J. Mater. Chem.,* 2011, 21, 1094-1101; Leszyk J et al. *Biochemistry.* 1987, 26(22), 7042-7). Performing photo-activation under the charged-droplet reaction environment can provide a means to achieve selective and rapid cross-linking at an ambient surface. This method can be optimized for visible-light mediated cross-linking. Selected cross-linkers can react only in the presence of an applied light; meaning that the cross-linking process can be quenched/terminated simply by removing the light source. This can allow high throughput screening of target analytes at ambient surfaces. In this case, an array of analytes can be created. The delivery of reactants (as droplets) and light source at the reaction spot can be synchronized for a specified time. This photo-sensitized cross-linking process uses a small sample volume. Furthermore, most bio-molecules are transparent to visible light, and this photo-sensitized cross-linking occurs at ambient surface, which makes the processing and analysis of the cross-linked product straightforward.

Example 9

Online Modification of Charged Micro-Droplet Environment with Acid Vapor Eliminates Matrix Effects in Electrospray Ionization Mass Spectrometry Electrospray ionization (ESI) has emerged as a powerful tool for bioanalysis, proteomics, and drug discovery. However, ion suppression effects are still a concern in ESI-MS. Traditionally, matrix effects are eliminated by physical separation of the analyte from the matrix via liquid chromatography (LC). Because all possible mechanisms related to ion suppression occur in the charged droplet environment, it is logical to consider methods that overcome ion suppression primarily during droplet or ion formation.

In this approach, online modification of electrospray droplets was achieved using the contained-ESI ion source. The reactivity of the charged droplets could be altered to improve the ease of detection of various analytes (in the presence of matrices) without separation or enrichment. Extended droplet modification could allow for covalent bond formation to occur.

Proposed Mechanism

Figure 14A:
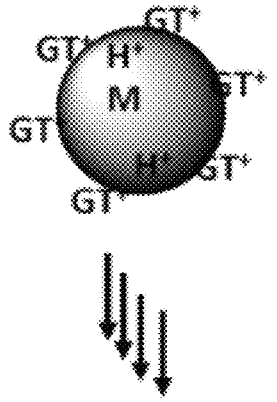
FIG. 14A shows the proposed mechanism for the elimination of the matrix effect in conventional ESI, in the absence of acid; x and y represent the number of the respective ions, where x>>y; M represents cortisone; GT represents Girard T reagent; and $X^-$ represents a counter anion.
Figure 14B:
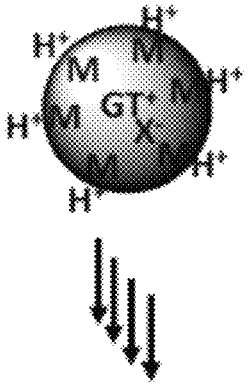
FIG. 14B shows the proposed mechanism for the elimination of the matrix effect in contained-ES, in the presence of acid and at low $N_2$ as pressure; x and y represent the number of the respective ions, where x>>y; M represents cortisone; GT represents Girard T reagent; and $X^-$ represents a counter anion.
Figure 14C:
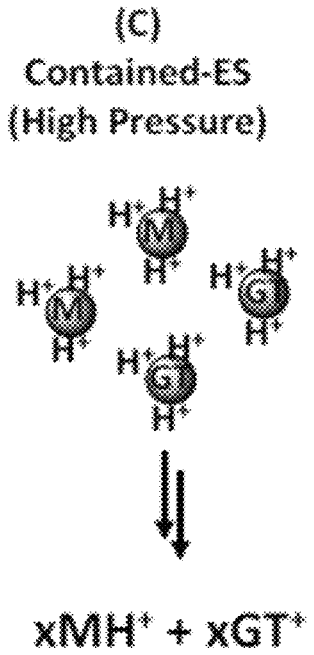
FIG. 14C shows the proposed mechanism for the elimination of the matrix effect in contained-ES, in the presence of acid and at high $N_2$ gas pressure; x and y represent the number of the respective ions, where x>>y; M represents cortisone; GT represents Girard T reagent; and $X^-$ represents a counter anion.

FIG. 14A-FIG. 14C is a scheme illustrating the proposed mechanism for the elimination of matrix effects in ESI-MS by modifying the environment of the charged micro-droplet using contained-ESI. In this case, the environment of the charged micro-droplet is modified using acid vapor. A mixture of cortisone and Girard T reagent are illustrated as proposed components of the sample. In the scheme, x and y represent the number of the respective ions generated, where x>>y; M represents cortisone; GT represents Girard T reagent; X— represents a counter anion. FIG. 14A illustrates the proposed makeup of ions produced using conventional ESI in the absence of acid. FIG. 14B illustrates the proposed makeup of ions produced using contained-ESI in the presence of acid and at low $N_2$ gas pressure (low carrier gas pressure). FIG. 14C illustrates the proposed makeup of ions produced using contained-ESI in the presence of acid and at high $N_2$ gas pressure (high carrier gas pressure).

Evaluation of Systems that do not Compete for Protons

Figure 15A:
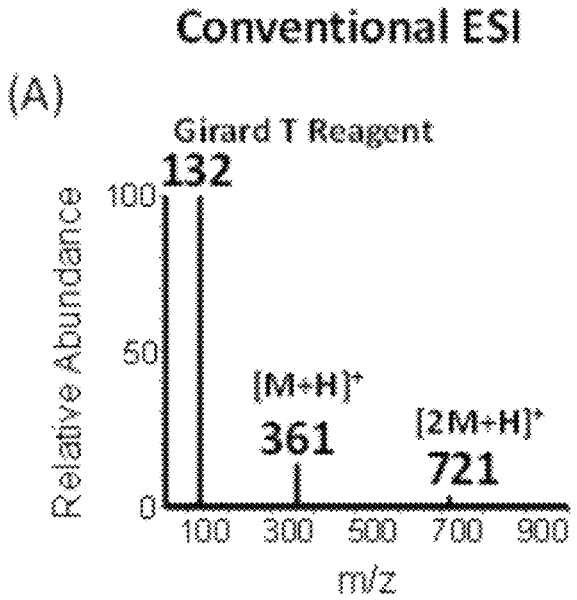
FIG. 15A shows the mass spectra for mixtures of Girard T reagent (MW 132) and cortisone (MW 360) prepared in a 1:1 molar ratio and analyzed using a conventional ESI ion source.
Figure 15B:
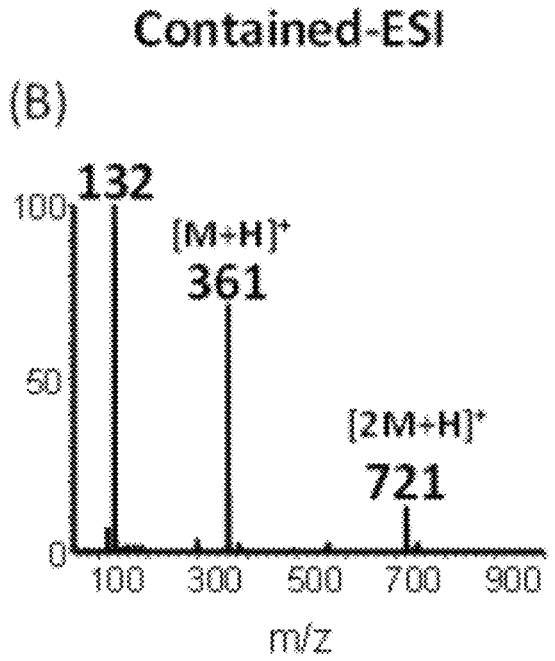
FIG. 15B shows the mass spectra for mixtures of Girard T reagent (MW 132) and cortisone (MW 360) prepared in a 1:1 molar ratio and analyzed using a contained-ESI ion source. The observed relative abundances of ions reflects the relative analyte concentrations in the prepared mixtures.
Figure 15C:
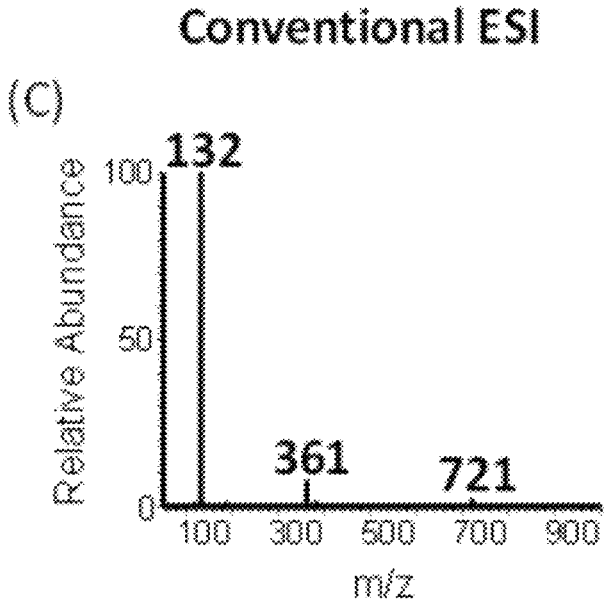
FIG. 15C shows the mass spectra for mixtures of Girard T reagent (MW 132) and cortisone (MW 360) prepared in a 1:3 molar ratio and analyzed using a conventional ESI ion source.
Figure 15D:
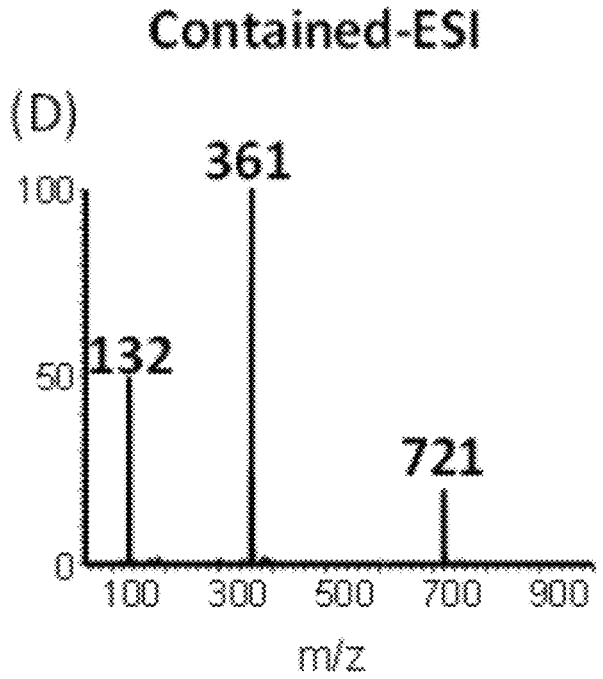
FIG. 15D shows the mass spectra for mixtures of Girard T reagent (MW 132) and cortisone (MW 360) prepared in a 1:3 molar ratio and analyzed using a contained-ESI ion source. The observed relative abundances of ions reflects the relative analyte concentrations in the prepared mixtures.

Girard T reagent (MW 132) and cortisone (MW 360) mixtures were prepared in 1:1 (FIGS. 15A and 15B) and 1:3 (FIGS. 15C and 15D) molar ratios. The samples were then analyzed using conventional ESI (FIGS. 15A and 15C) and contained-ESI sources. In the case of the contained-ESI samples, the relative abundances of the observed ions correspondence to the analyte concentration in the sample mixture.

Figure 16A:
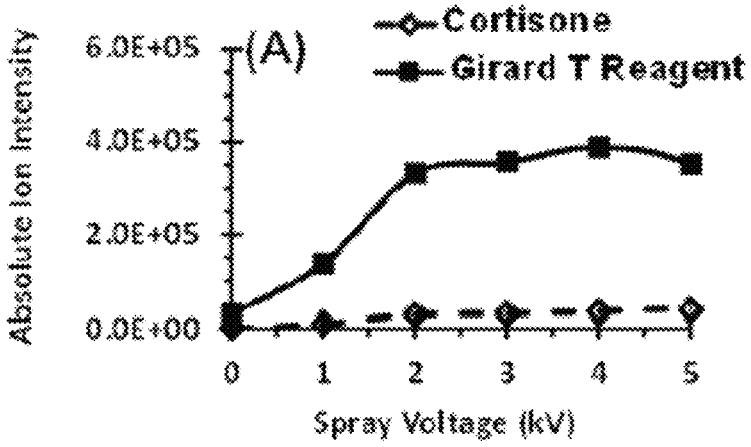
FIG. 16A shows the effect of spray voltage on the ion intensity when an equimolar ($10\times10^{-5}$ M) mixture of cortisone and Girard T reagent was analyzed with a conventional ESI ion source, in the absence of acid, where 100 psi of nebulizer gas was used.
Figure 16B:
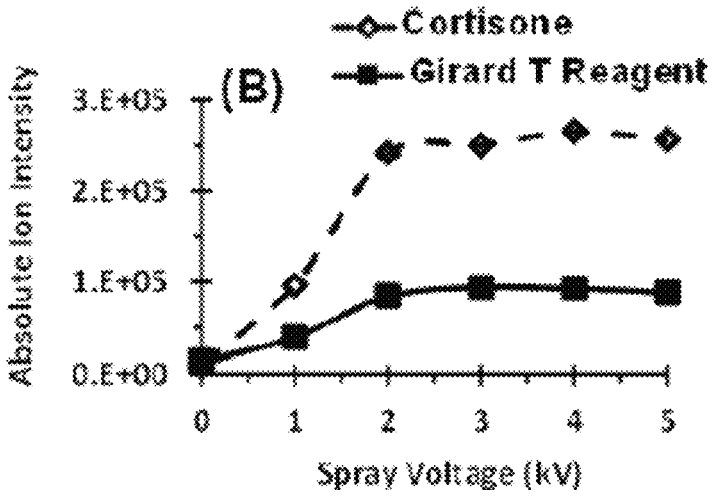
FIG. 16B shows the effect of spray voltage on the ion intensity when an equimolar ($10\times10^{-5}$ M) mixture of cortisone and Girard T reagent was analyzed with a contained-ES apparatus in the presence of acid vapor, where 100 psi of nebulizer gas was used.
Figure 16C:
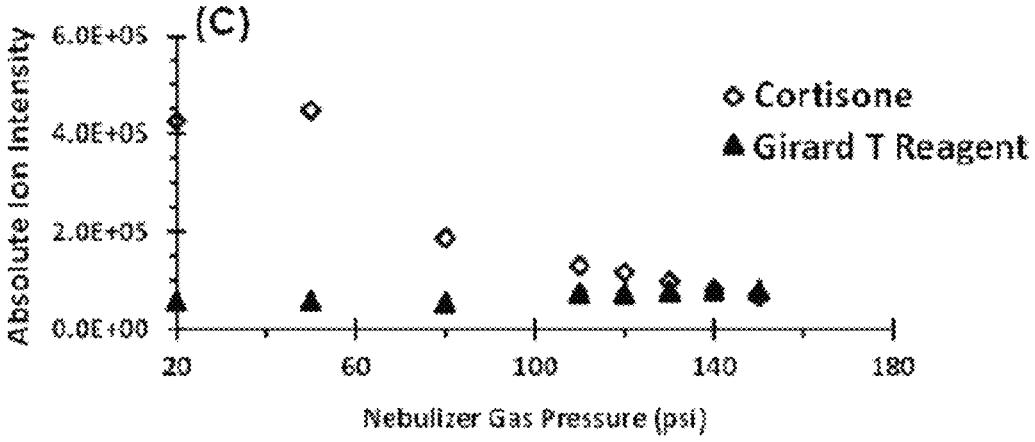
FIG. 16C shows effect of nitrogen nebulizer gas pressure on the ion yield when an equimolar ($10\times10^{-5}$ M) mixture of cortisone and Girard T reagent was analyzed with a contained-ES apparatus, in the presence of acid vapor.

The effect of spray voltage on ion intensity was also evaluated. An equimolar ($10\times10^{-5}$ M) mixture of cortisone and Girard T was analyzed using a conventional ESI source in the absence of acid (FIG. 16A) and a contained-ESI source in the presence of acid vapor (FIG. 16B). 100 PSI of nebulizer gas pressure ($N_2$) was used in both experiments. The effect of nebulizer gas pressure on ion intensity when using the contained-ESI source in the presence of acid vapor was also evaluated. The results are shown in FIG. 16C.

Evaluation of Systems that Compete for Protons

Figure 17A:
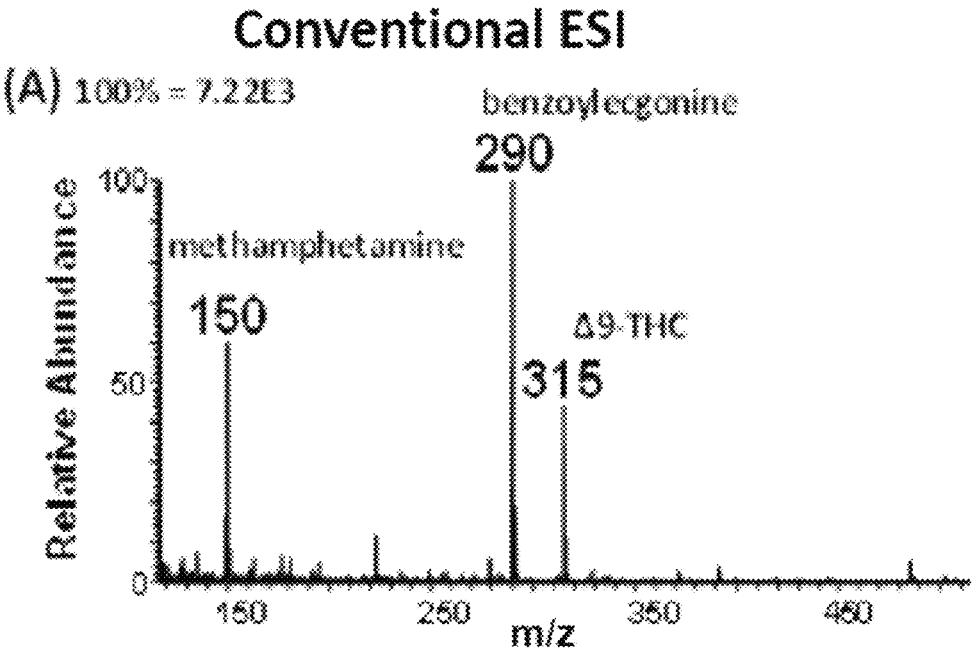
FIG. 17A shows the mass spectra obtained after the analysis of a solution containing an equimolar (0.5 μM) mixture of methamphetamine, benzoylecgonine, and Δ9-tetrahydrocannabinol (Δ9-THC) using a conventional ESI, with HCl heated to 50° C.
Figure 17B:
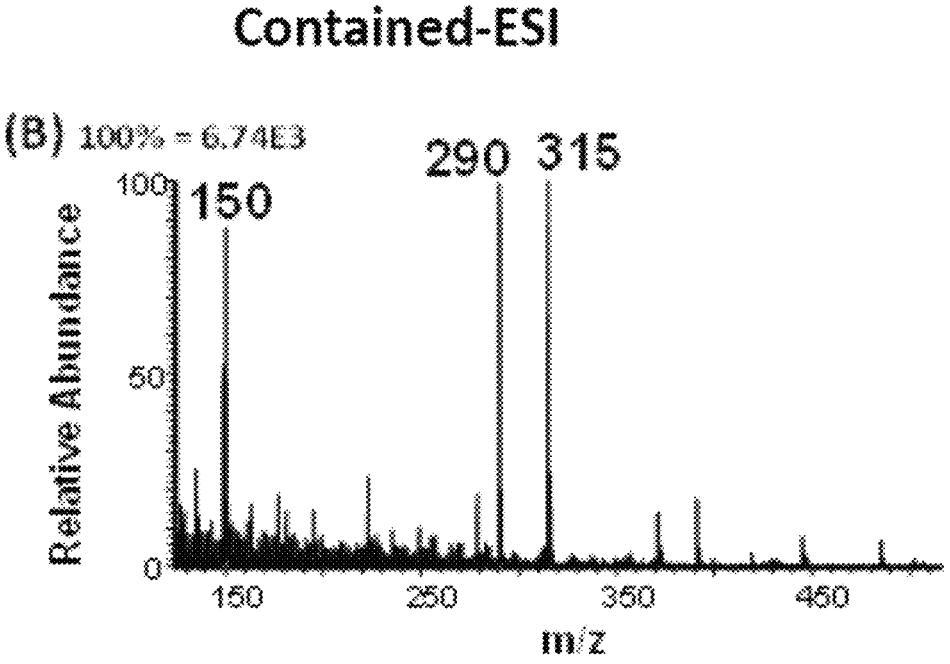
FIG. 17B shows the mass spectra obtained after the analysis of a solution containing an equimolar (0.5 μM) mixture of methamphetamine, benzoylecgonine, and Δ9-tetrahydrocannabinol (Δ9-THC) using a contained-ES, with HCl heated to 50° C.
Figure 18A:
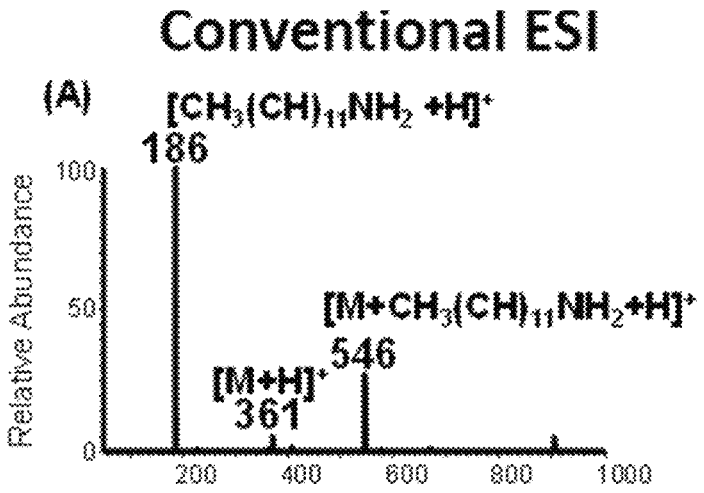
FIG. 18A shows the mass spectra obtained following the analysis of two separate solutions containing an equimolar ($10\times10^{-5}$ M) mixture of dodecyl amine and cortisone (M), using conventional ESI, in the presence of acid.
Figure 18B:
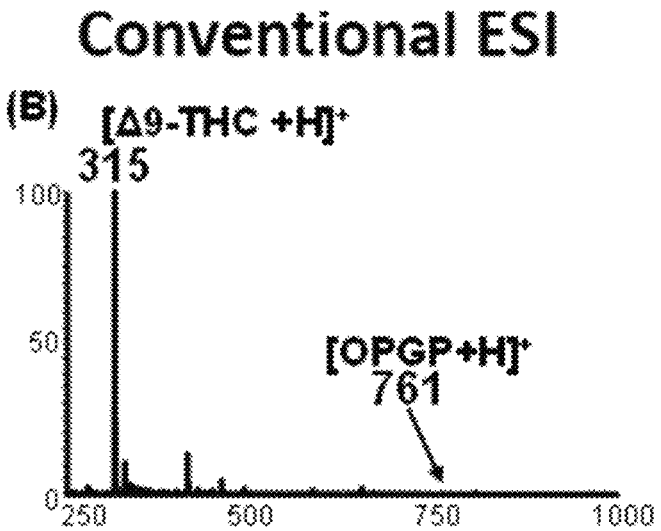
FIG. 18B shows the mass spectra obtained following the analysis of two separate solutions containing an equimolar ($10\times10^{-5}$ M) mixture of Δ9-tetrahydrocannabinol (Δ9-THC) and 2-oleoyl-1-palmitoyl-sn-glycero-3-phosphocholine (OPGP) using conventional ESI, in the presence of acid.
Figure 18C:
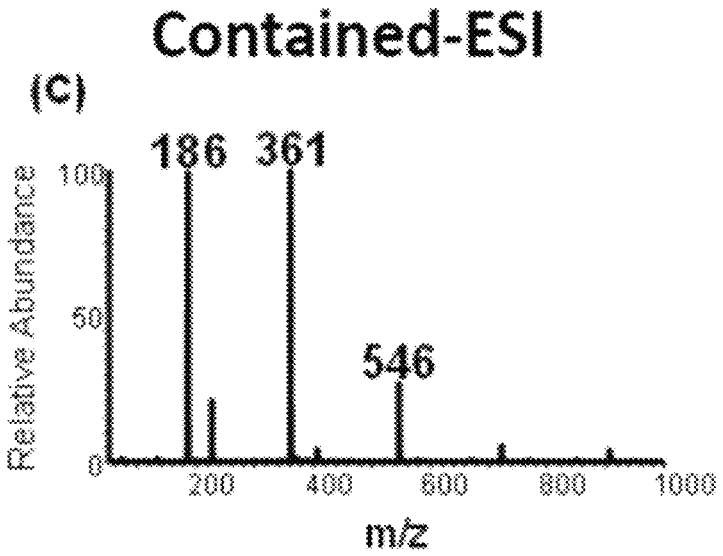
FIG. 18C shows the mass spectra obtained following the analysis of two separate solutions containing an equimolar ($10\times10^{-5}$ M) mixture of dodecyl amine and cortisone (M) using contained-ESI, in the presence of acid.
Figure 18D:
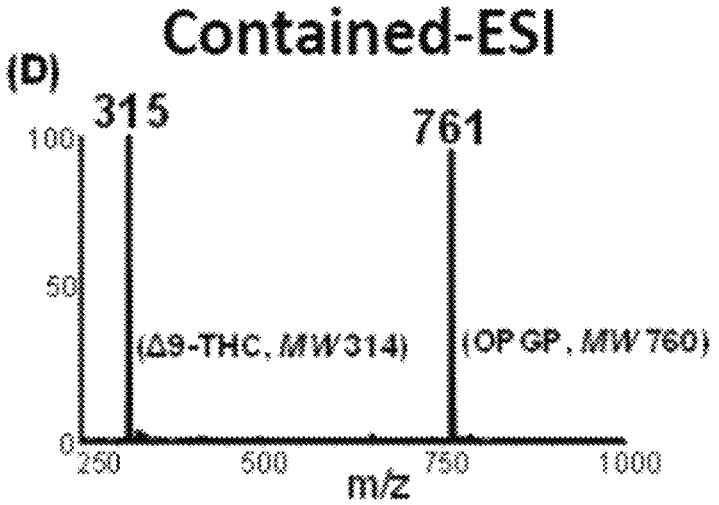
FIG. 18D shows the mass spectra obtained following the analysis of two separate solutions containing an equimolar ($10\times10^{-5}$ M) mixture of Δ9-tetrahydrocannabinol (Δ9-THC) and 2-oleoyl-1-palmitoyl-sn-glycero-3-phosphocholine (OPGP) using contained-ESI, in the presence of acid.

FIGS. 17A-17B illustrate mass spectra obtained after the analysis of solution containing an equimolar (0.5 μM) mixture of methamphetamine, benzoylecgonine, and Δ9-tetrahydrocannabinol (Δ9-THC) using conventional ESI (FIG. 17A) and (FIG. 17B) contained-ES in the presence of acid vapor (HCl) heated to 50° C. FIGS. 18A-18D illustrate mass spectra obtained following the analysis of two separate solutions containing an equimolar ($10\times10^{-5}$ M) mixture of dodecyl amine and cortisone (M) (FIGS. 18A and 18C) and Δ9-tetrahydrocannabinol (Δ9-THC) and 2-Oleoyl-1-palmitoyl-sn-glycero-3-phosphocholine (OPGP) (FIGS. 18B and 18D) using conventional ESI (FIGS. 18A and 18B) and contained-ESI (FIGS. 18C and 18D) in the presence of acid.

Summary and Conclusions

These results demonstrate that using contained-ESI, ion suppression effects could be eliminated (or minimized) without separation of the analyte from the matrix and/or other interfering analyte(s). Online modification of charged droplets occurs on a millisecond time scale. This allows for coupling of the contained-ESI adaptor to LC systems, which operate on a longer time scale (e.g., which operate within minutes). Using these contained-ESI method, ESI-MS could be used to produce mass spectra that reflect analyte concentration in a sample.

Example 10

Online Manipulation of Protein Charge State by Contained-Electrospray Ionization Highly charged, unfolded proteins can yield better sequencing information. Unfortunately, solution-phase denaturing is not compatible with LC systems. Contained-ESI apparatus can perform online protein denaturation and manipulate the charge state distribution (CSD) of multiply charged species during ES ionization. Using the contained-ES ion source, ES charged droplets can be exposed to an acid vapor present in a nebulizing gas (carrier gas). CSD can be influenced by varying the nebulizing gas pressure. Online modification of charged droplets occurs on a millisecond time scale. This allows for coupling of the contained-ESI adaptor to LC systems, which operate on a longer time scale (e.g., which operate within minutes). As a consequence, the contained-ESI systems can be utilized in LC-ESI-MS systems.

Methodology

Figure 19A:
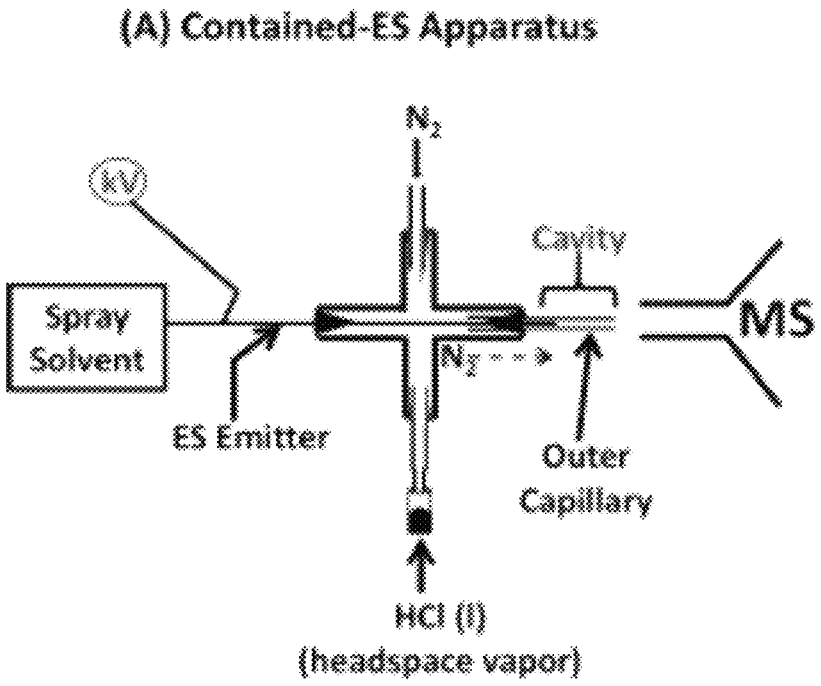
FIG. 19A shows the experimental apparatus for the contained electrospray (ES) process.
Figure 19B:
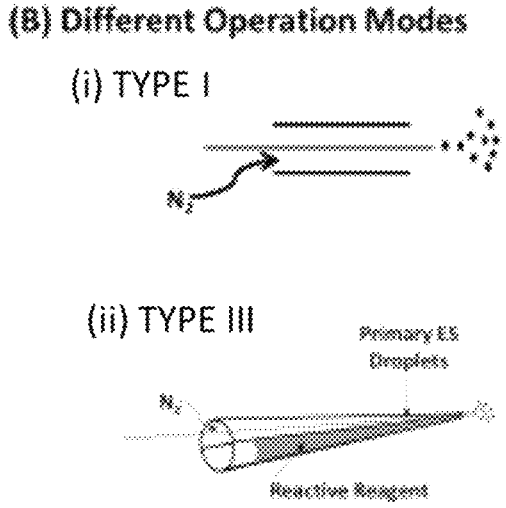
FIG. 19B shows the different modes of operation for the contained-ES apparatus: (i) Type I and (ii) Type III operational modes are used with volatile and non-volatile reagents, respectively.

Two different contained-ESI systems were used. The experimental apparatus used for these analyses are illustrated in FIGS. 19A and 19B. The apparatus includes inputs for the analyte solution, the $N_2$ nebulizing gas, and a headspace of a reactive gas (e.g., HCl). The apparatus includes a sample outlet for continuous droplet modification and release after the application of DC (4 kV) voltage. FIG. 19B illustrates two modes of operation for this apparatus. In Operation Mode Type I, the output is the ES emitter (100 μm) that is inserted through an outer (250 μm) capillary. In Operation Mode Type III, the output is the ES emitter that is inserted through a glass theta capillary, with one chamber filled with the non-volatile reagent. Type I and Type III operational modes were used with volatile and non-volatile reagents, respectively.

Analysis of Myoglobin

Myoglobin exists in two forms: holomyoglobin (with hemegroup, MW 17.6 kDa) and apomyoglobin (with hemegroup lost, MW 17 kDa). Myoglobin easily denatures, in the presence of acid and at high charge states, to lose the hemegroup. Under contained-ES ionization conditions, the shift to higher charge states occurred quicker than the time (<100 ms) required for the heme (MW 620) group to escape the unfolding protein. The equation below was used to calculate the average weighted average charge state for each sample $$q_{avg} = \frac{\sum_{i}^{N} q_i W_i}{\sum_{i}^{N} W_i}$$

where q=charge of the ith charge state, W=intensity of ith charge state, and N=number of observed charge states.

Figure 20A:
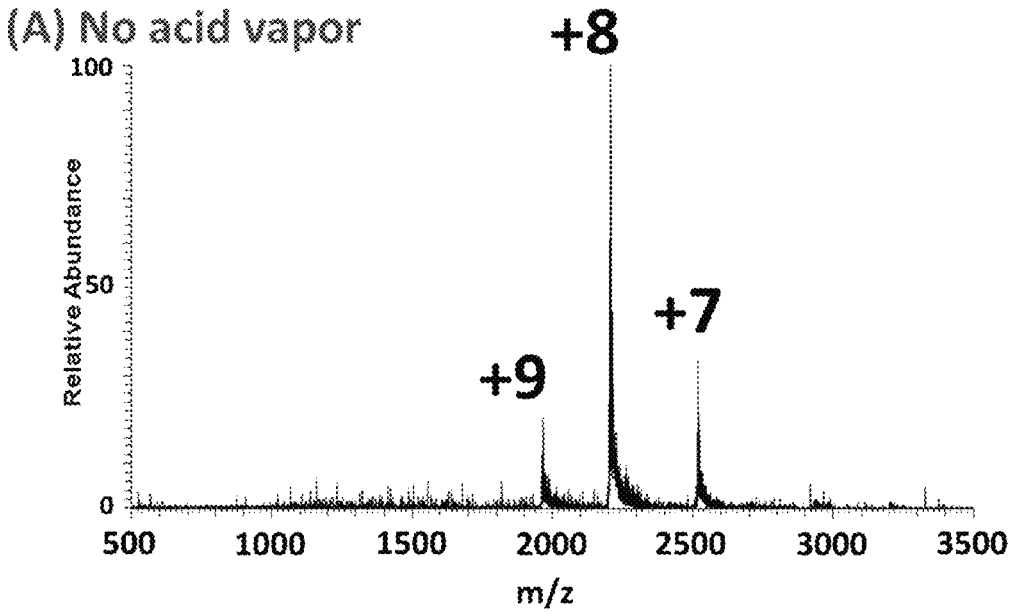
FIG. 20A shows the analysis of myoglobin (20 μM in $MeOH/H_2O$, 20/80 solution) using the contained-ES ion source with no acid vapor.
Figure 20B:
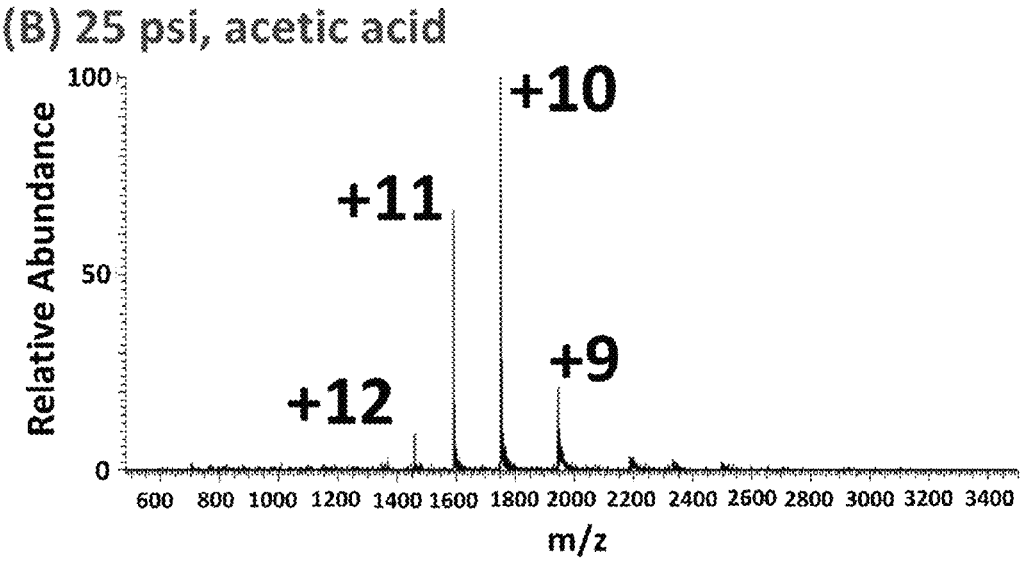
FIG. 20B shows the analysis of myoglobin (20 μM in $MeOH/H_2O$, 20/80 solution) using the contained-ES ion source with 25 psi acetic acid.
Figure 20C:
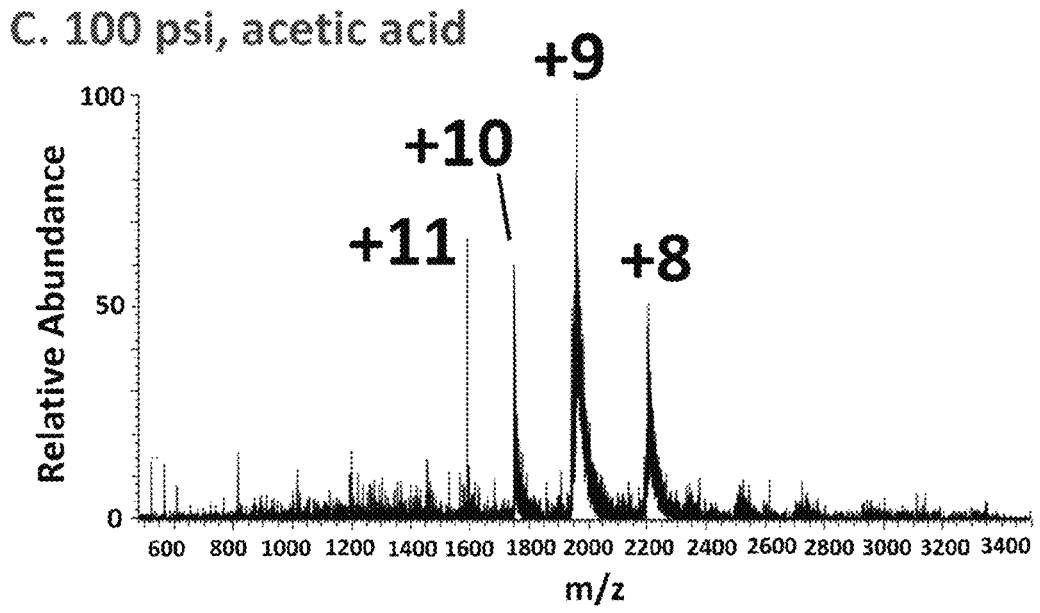
FIG. 20C shows the analysis of myoglobin (20 μM in $MeOH/H_2O$, 20/80 solution) using the contained-ES ion source with 100 psi acetic acid.

ESI-MS spectra of myoglobin (20 μM in $MeOH/H_2O$, 20/80% solution) were collected using the contained-ES ion source. Spectra collected in the absence of acid vapor (FIG. 20A, 20 PSI nebulizer gas pressure), in the presence of acetic acid vapor at low nebulizer gas pressure (FIG. 20B, 25 PSI nebulizer gas pressure), and in the presence of acetic acid vapor at high nebulizer gas pressure (FIG. 20C, 100 PSI nebulizer gas pressure) are shown in FIGS. 20A-20C. The observable weight average charge states for these examples are included in Table 1 below.

TABLE 1

Observed weight average charge state for example ESI-MS spectra obtained using contained-ES ion source.

| Acid | Nebulizer Pressure (PSI) | $q_{avg}$ |
|---|---|---|
| None | 20 | 7.92 |
| Acetic Acid | 25 | 10.3 |
| Acetic Acid | 100 | 9.36 |

In the absence of acid vapor, there was no observable shift in CSD with changes in $N_2$ nebulizer gas pressure. Exposure of ES droplets to acetic acid using the contained-ES ion source increased the charge by over 2.4 units. See FIG. 20B and Table 1. The m/z analysis indicates that myoglobin was detected in its holoform. This suggests that denaturation and ionization occurred more rapidly than the loss of the heme unit.

Analysis of Tetralysine

Figure 21A:
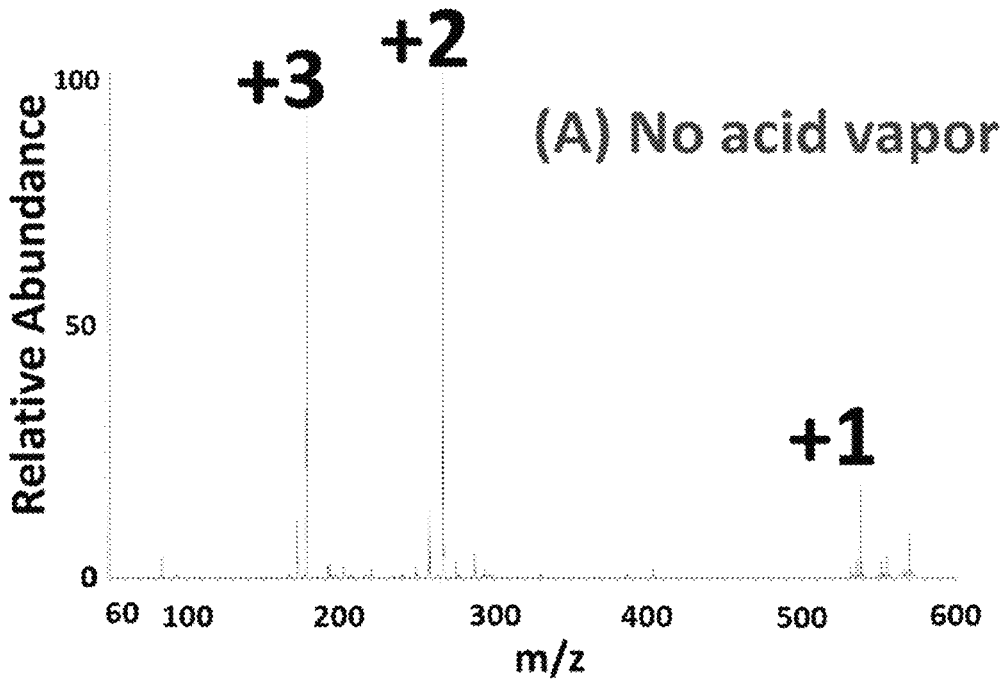
FIG. 21A shows the contained-ES analysis of a tetralysine peptide (20 μM in $MeOH/H_2O$, 50/50 solution) with no acid vapor.
Figure 21B:
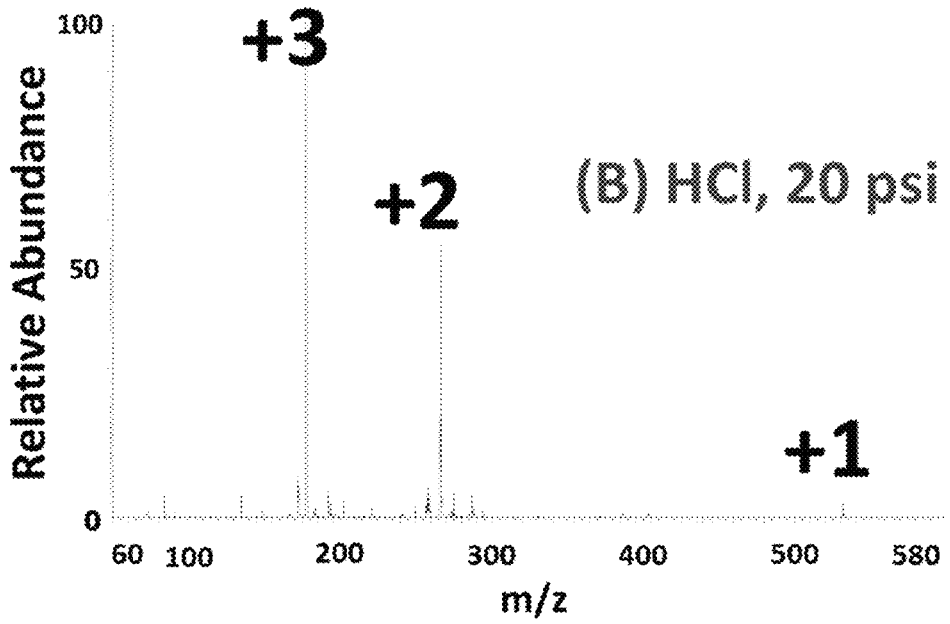
FIG. 21B shows the contained-ES analysis of a tetralysine peptide (20 μM in $MeOH/H_2O$, 50/50 solution) with 20 psi HCl.
Figure 21C:
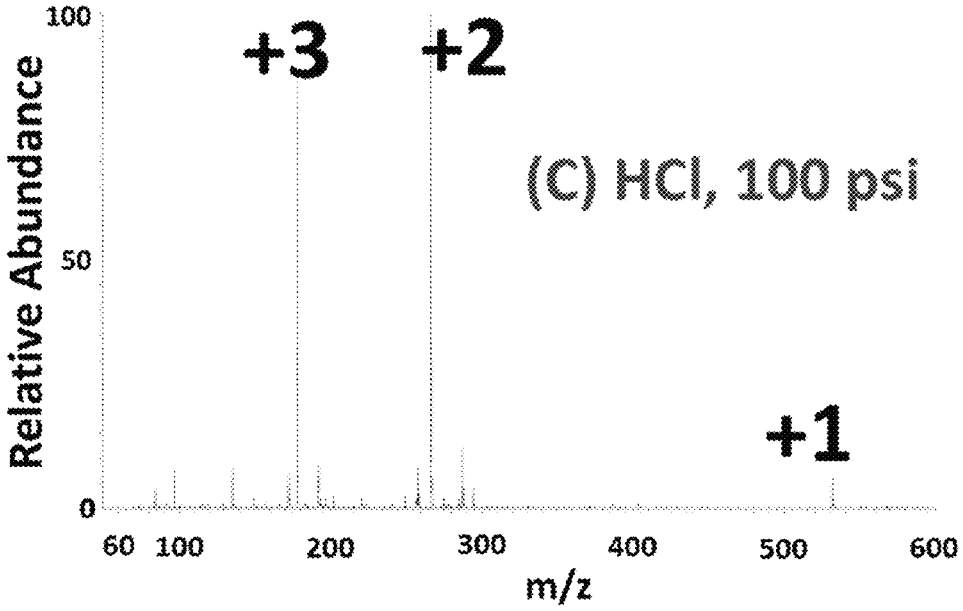
FIG. 21C shows the contained-ES analysis of a tetralysine peptide (20 μM in $MeOH/H_2O$, 50/50 solution) with 100 psi HCl.

Tetralysine is a peptide with MW of 530 Da. ESI-MS spectra of tetralysine (20 μM in MeOH/$H_2O$, 50/50 solution) were collected using the contained-ES ion source (5 μL/s flow rate; 5 kV spray voltage). Spectra collected in the absence of acid vapor (FIG. 21A), in the presence of HCl vapor at low nebulizer gas pressure (FIG. 21B, 20 PSI nebulizer gas pressure), and in the presence of HCl vapor at high nebulizer gas pressure (FIG. 21C, 100 PSI nebulizer gas pressure) are shown in FIGS. 21A-21C. In the absence of acid, +2 was the major charge state observed in the mass spectra. Upon exposure to HCl at low pressure, the favored peak in the mass spectra shifted to the +3 charge state. Upon exposure to HCl at high pressure, the HCl vapor was suppressed, and +2 was again the most abundant charge state observed in the mass spectra.

Figure 21D:
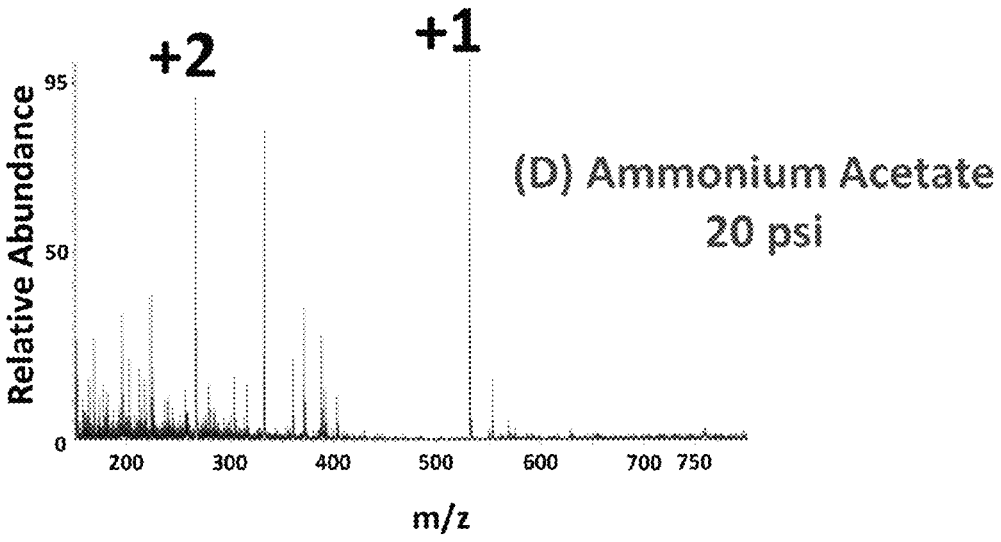
FIG. 21D shows the contained-ES analysis of a tetralysine peptide (20 μM in $MeOH/H_2O$, 50/50 solution) with 20 psi ammonium acetate.
Figure 21E:
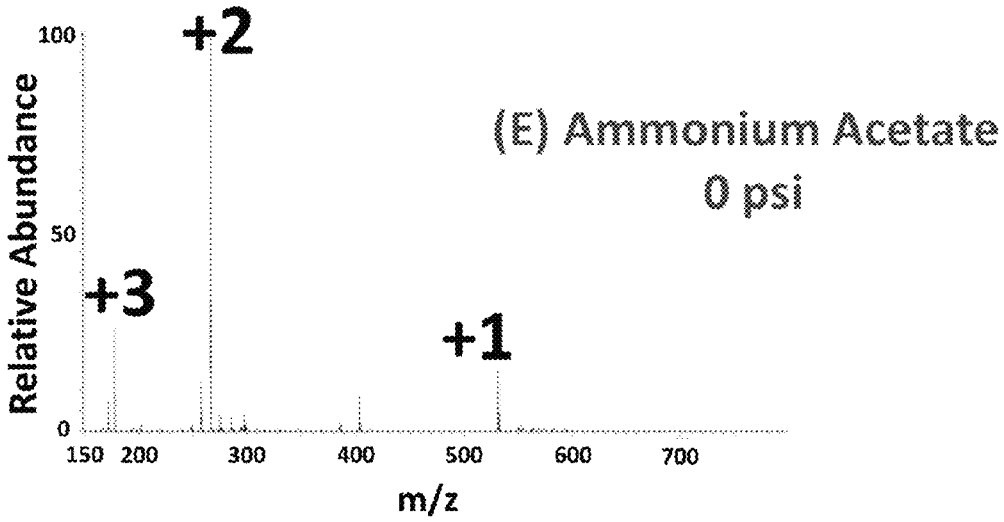
FIG. 21E shows the contained-ES analysis of a tetralysine peptide (20 μM in $MeOH/H_2O$, 50/50 solution) with 0 psi ammonium acetate.

Using Operation Mode Type III, spectra were collected using non-volatile ammonium acetate instead of HCl. Spectra collected in the presence of ammonium acetate (FIG. 21D, 20 PSI pressure; and FIG. 21E, 0 PSI pressure) are shown in FIGS. 21D-21E. At 20 PSI, the +1 and +2 charge states were brought to almost equal intensity, and the +3 charge state was not observed.

Summary and Conclusions

These results demonstrate that contained-ESI allows for the facile manipulation of CSD, including the CSD of both proteins and peptides. In particular, CSD can be manipulated simply by varying nebulizer gas pressure. Using these systems, droplets can be contacted with both volatile and non-volatile reagents. The contained-ESI systems can be interfaced with an LC system, such that the LC system provides the reactive fluid in the system. This can obviate the need for the theta capillary. Using these methods, denaturation and ionization of the protein can occur more rapidly than the loss of a non-covalently attached counterpart of the protein (e.g., a cofactors).

Example 11

The confined environment of charged micro-droplets to can be used to control the product distributions of photochemical reactions. In this way, micro-droplets can serve to drive reactions of industrial importance in a manner not possible in bulk solution, thus directing the energy of light to the formation of commercially valuable chemicals. Reactants which coexist in the charged droplet can be ionized and micro-solvated at the droplet surface; both properties can lead to reaction rates typical of gas-phase ion/molecule reactions. The reactivity of ionic species in the dispersed charged droplets at atmospheric pressure more closely resembles solution-phase reactions than the typical mass spectrometry (MS) ion/molecule reactions performed under reduced pressure. The characteristics of this accelerated reaction rate after the confined reagents are stimulated with photons are discussed herein.

The combined effects of electric fields utilized for charged droplet generation, the concentration effect achieved by solvent evaporation from the resultant charged droplets, and the droplet exposure to highly intense and coherent visible laser light source can enable the production of unique reactive photochemical species for pathways that might be difficult to access in traditional bulk-phase conditions. Experiments have demonstrated that the charged micro-droplet environment can enable the in-situ generation of highly reactive species from $[Ru(bpy)_3]^{2+}$ (bpy=2,2'-bipyridine) complexes for dehydrogenation of amines, including the conversion of tetrahydroquinolines to quinolines. This visible light-mediated photo-redox catalysis occurs at atmospheric pressure, in the presence of oxygen. This feature forms the basis for aerobic oxidation of amines typically performed at ~100° C. under molecular oxygen conditions. As such, a new catalytic pathway for the transformation of tetrahydroquinolines into quinolines which operates at room temperature and atmospheric pressure, and in the presence of visible light is discussed herein. This droplet-based catalytic process is also discussed for other heterocyclic organic compounds.

Currently, there is no effective way to rapidly screen and discover new photochemical reactions. A contained-electrospray emitter capable of ion generation and reaction in a single step can enable rapid manipulation of reaction conditions. The contained-electrospray method can be used as a versatile mass spectrometric platform to investigate, for example, radical reactivity under confined environment. The accelerated photo-catalytic pathway of quinoline preparation will be characterized by using a transmission-mode desorption electrospray ion (TM-DESI) source, which involves rapidly moving charged droplets of microseconds lifetimes. This can capture reaction intermediates involved in tetrahydroquinolines to quinolines conversion.

The dehydrogenation of primary, secondary, and tertiary amines can be studied under the mild charged micro-droplet reaction conditions to study the interfacial oxidation of amines. Oxidation of amines to the corresponding imines are among the most useful and common reactions in industrial processes. This transformation is currently achieved (on industrial scale) via toxic metal oxidants. The use of oxygen as oxidant is a recent advancement, and the aerobic oxidation of amines can be advanced further by implementing catalytic strategies that enable (i) accelerated reaction rates (seconds reaction times), (ii) low pressures of $O_2$ (ambient air), (iii) avoidance of costly or toxic additives (use of picomoles of reagents, and transition from low abundant Pt, Ru, and Ir complexes to high abundant Cu and Fe complexes to metal-free reactions system).

An aim in catalysis is to develop new modes of small molecule activation. Visible light photo-redox catalysis has emerged as one such approach. Herein, unmodified ruthenium and iridium bipyridyl (bpy) complexes, and organic dyes such as eosin Y were used for the oxidation of amines, under the charged micro-droplet reaction condition. The oxidized imine products are versatile synthetic intermediates and today, metal oxidants such as dichromate ions, permanganate ions, manganese dioxide, silver oxide, and lead tetraacetate are still used for these transformations in spite of the undesirable economic and environmental concerns.

A limitation associated with the use of photo-chemical reactions is the inability of most organic molecules to absorb visible wavelengths of light. The use of ultraviolet wavelengths is common but, generally speaking, laboratory studies of photo-initiated organic reactions by exploiting UV light suffer from the following disadvantages: (i) specialized UV reactors using xenon or mercury lamps are expensive, (ii) UV wavelengths for organic photochemistry are not abundant in the solar spectrum, and (iii) UV is difficult to implement on a large scale.

Visible light photo-catalysis can be expanded by combining other stimuli (e.g., electrical discharge) with photon absorption. Experiments discussed herein are designed to facilitate rapid and real-time screening of different experimental conditions, using only picomole ($10^{-12}$ moles) quantities of reagents, and thereby allowing relatively easy evaluation of the effect of each stimulus in a short time period. These experiments rely on the ability to generate micro-solvated species and to substantially instantaneously study their reactivity under the confined droplet or thin liquid film environment.

Figure 24:
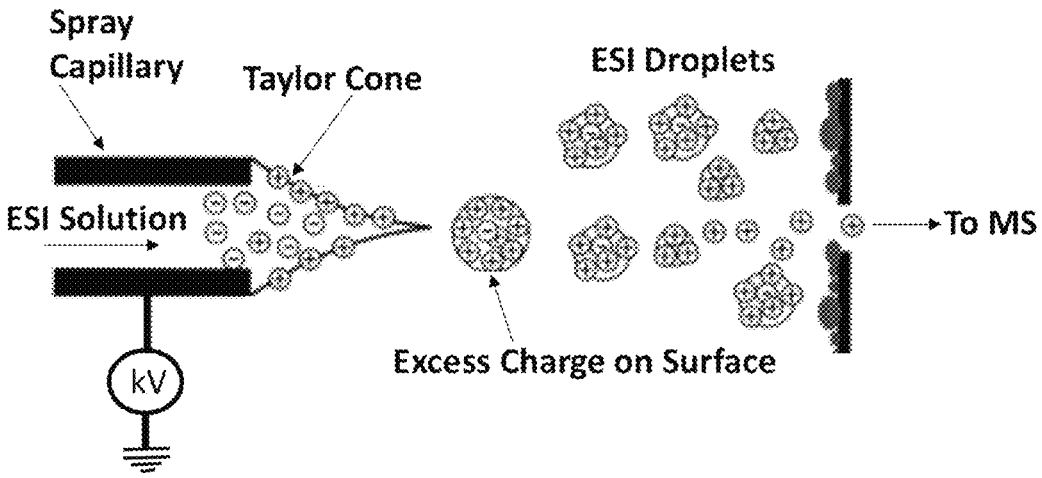
FIG. 24 is a schematic representation of electrospray ionization (ESI) (MS=mass spectrometer).

The electrospray ionization (ESI) mechanism is shown schematically in FIG. 24. In electrospray ionization, a sample solution is pumped through a metal capillary on which a DC high voltage (2-5 kV) has been applied. The applied voltage produces charge separation at the liquid surface and as a result, a Taylor cone is formed as the solution reaches the tip of the capillary. At Rayleigh limit (i.e., when electrostatic repulsion equals surface tension of solution) the Taylor cone ejects droplets that contain an excess charge at their surface. Gas-phase ions are formed by two mechanisms: (i) coulomb fission mechanism which assumes that the increased charge density due to solvent evaporation causes large droplets to divide into smaller and smaller droplets, which eventually consist only of single ions; (ii) ion evaporation, which imply dry ions are released from the droplets because of increased charge density.

Exposure of photons to charged particles (e.g., electrospray ion (ESI) plume) is a common mass spectrometric experiment, but it is typically used for sample ionization or ion dissociation. However, mass spectrometry has not been used to study photo-catalytic pathways at atmospheric pressure. Atmospheric pressure photoionization (APPI) is the closest analog, where a mixture of samples from electrospray ionization (ESI) is fully evaporated prior to its introduction into the photoionization chamber in which ~10 eV photons are emitted from a krypton discharge lamp; chemical ionization is reported to contribute to the atmospheric pressure photoionization process.

Herein, the catalytic dehydrogenation of tetrahydroquinolines to quinolones, a difficult oxidation process, is discussed. For example, one of the most efficient approaches to achieving this transformation is through the use of mesoporous graphite carbon nitride (mpg-$C_3N_4$) as photo-catalyst under molecular oxygen (0.5 Mpa) with concomitant light irradiation (wavelength >420 nm) for at least 4.5 hours at a relatively high temperature (100° C.). Traditional aerobic oxidation of tetrahydroquinolines using transition metal complexes usually take at least 20 h. Aerobic oxidation represents an emerging alternative to the traditional procedures based on metal oxidants in which oxygen (or air) can be used as a cheaper and less polluting stoichiometric oxidant. As exemplified above (even with mpg-$C_3N_4$ catalyst), several challenges exist in current transition metal-catalyzed aerobic oxidation methods including (i) the need for low pressures of $O_2$ especially in flammable organic solvents, (ii) mild reaction conditions, (iii) low catalyst loadings, and (iv) avoidance of costly or toxic additives.

Reactive catalytic species can be generated in ambient air when charged droplet-containing off-the-shelf ruthenium polypyridyl complexes are exposed to blue visible light. Both homogeneous and heterogeneous catalytic aerobic oxidation methods that involve ruthenium compounds have been developed for amines and alcohols. The activity of $RuCl_2(PPh_3)_3$ was reported to increase when ionic liquids are used as solvents. A ruthenium-porphryin complex (trans-[Ru(tmp)$(O)_2$]) which converts both aromatic and aliphatic amines to the corresponding nitriles was generated by in situ oxidation of [Ru(tmp)CO] through the exposure to excess peracids in benzene. In combination with a hydrogen acceptor (e.g., quinone) as co-catalyst, and dioxygen/Co(salen) as oxidant, ruthenium-based compounds have been used in a multi-catalytic oxidation of alcohols and amines. In the latter case, the requirement of high loading of the hydrogen acceptor has led to the rational design of o-quinone-based Ru catalysts for amine oxidation.

Methodologies by which activated forms of commercial ruthenium and iridium bipyridyl complexes will be generated in-situ and under ambient conditions, without extensive synthesis, are discussed herein. Low pH values can be achieved with ordinary acids when the reaction is performed under the charged droplet environments. Reactive oxygen species can be generated when the charged liquid droplets are exposed to corona pulses. These and other stimuli can be used to modify photo-catalysts, and the resultant species can be characterized by mass spectrometry.

As noted, the use of individual stimulants such as photons and electrical discharge to modify chemical species under the charged droplet environment have been reported. However, a study that focuses on the combined effects of these stimuli has not been reported. In general, containment of reagents in micro-droplets can provide rapid mixing, control of interfacial properties, control of reaction time up to microseconds, the capacity to perform accelerated chemical synthesis, and the ability to deliver reagents/products to desired locations for collection or characterization by a variety of analytical techniques. Traditionally, droplet-based photo-chemical reactions have been conducted in microfluidic channels and micellar systems. Advances made over the past decade in the preparation and handling of chemical samples inside modern mass spectrometers can be used to accelerate common reactions of industrial importance in charged droplets. Charged micro-droplets produced in electrospray ionization represents a general approach by which solution phase reaction systems can be interrogated on-line by mass spectrometry. The electrospray ionization sampling process does not cause further reaction or modify the chemical species present in the original solution.

The contained-electrospray emitter can generate reactive electrospray droplets. Existing electrospray-based experimental most similar to those described herein are found in: reactive desorption electrospray ionization (DESI), extractive electrospray ionization (EESI), and theta capillary-based nano-electrospray ionization (theta nano-ESI). The underlying principle for these experiments has been to separately deliver the analyte and the modifying reagent through two different emitters or chambers (sometimes surfaces are used, as in the case of reactive desorption electrospray ionization). This type of experimental set-up requires optimization of an array of experimental variables including sampling angle and distances, which often differ among sample types. These geometrical constraints have limited the widespread use of these techniques. Theta nano-electrospray ionization is an exception; it uses a single glass capillary having two separate but parallel chambers. Mixing of analyte solution and modifying reagents occurs at the glass tip, during Taylor cone formation of the electrospray process. In all cases, the extent of reaction is achieved by changing the concentration of the modifying reagent. Such an approach mimics solution-phase reaction conditions and makes it difficult to study different reaction conditions in short time periods.

In the contained-electrospray approach discussed herein, two concentric capillaries are used, which eliminate geometrical effects during analysis. The inner capillary can be moved freely relative to the outer capillary. This property allows for control over the extent and type of droplet modification (including the induction of micro-discharge, exposure to reactive gases and liquids, and photons for chemical reactions).

The photo-redox oxidation of tetrahydroquinolines was studied using the apparatus shown in FIG. 25, where the amine and the photo-catalyst were contained in a single barrel glass capillary (this experimental set-up was developed to mimic the outlet of the contained-electrospray emitter described later). Charged micro-droplets containing the reactants were generated when a DC voltage of 1.2 kV was applied to the solution. Substantially synchronized application of the high voltage and the laser source can enable on-line analysis of the photo-redox reaction. Upon the application of the laser, electron transfer from the amine to the LUMO (lowest unoccupied molecular orbital) of the excited photo-catalyst can allow the production of free radical cations (2, FIG. 26) from the amine.

Four pathways are available to this radical cation under the traditional bulk phase photo-chemical reaction conditions: (i) back electron transfer from 2 to Ru (II) complex, which has been identified as a major side reaction competing against the other productive downstream reactions of 2; (ii) hydrogen atom abstraction from 2 to produce iminium ion 4; (iii) deprotonation of amine radical cation 2 to form α-amino radical 3, which is converted to iminium ion 4 via a second one-electron oxidation; and (iv) cleavage of C—C bond alpha to the nitrogen atom and yielding a neutral radical and an iminium ion 5.

Figure 27:
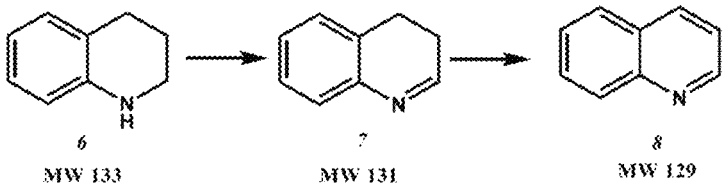
FIG. 27 shows the conversion of tetrahydroquinoline to quinoline.
Figure 28:
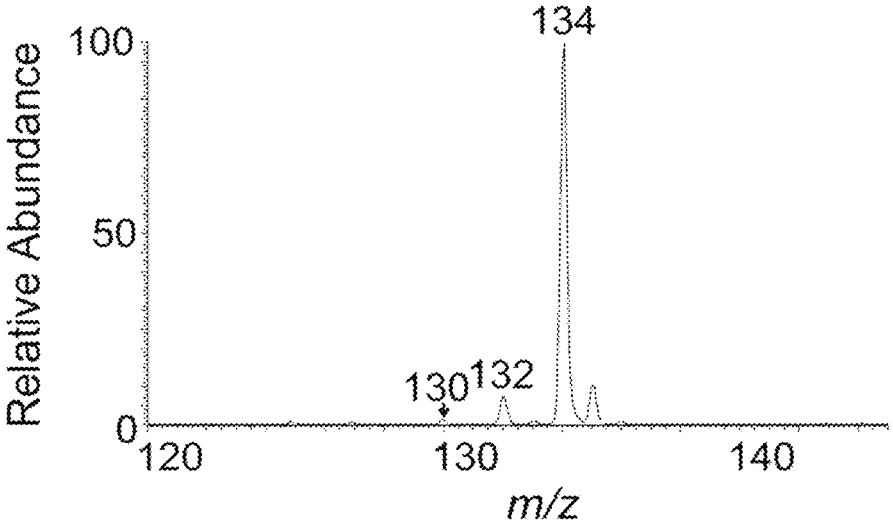
FIG. 28 is a mass spectrum showing analysis of a tetrahydroquinoline and $Ru(bpy)_3Cl_2$ mixture when visible light is off.
Figure 29:
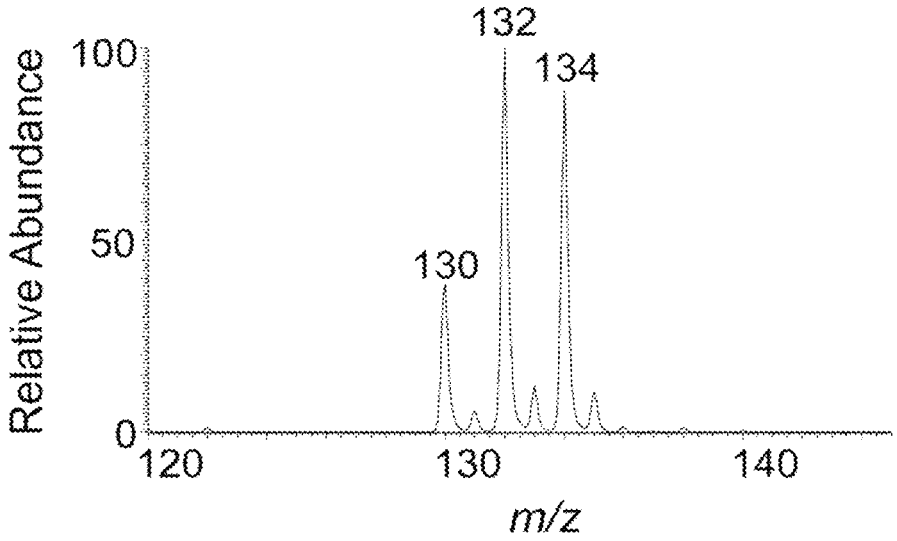
FIG. 29 is a mass spectrum showing analysis of a tetrahydroquinoline and $Ru(bpy)_3Cl_2$ mixture when at the onset of visible light exposure.

Herein, an accelerated pathway has been identified which involves several successive eliminations of H atoms (or $H_2$). In an experiment using the setup shown in FIG. 25, quinolines (FIG. 27) were easily generated from tetrahydroquinolines (THQ) after the mixture of THQ and $[Ru(bpy)_3]^{2+}$ were briefly exposed to blue visible light (wavelength=452 nm and power=5 mW). Mass spectrometry analysis of the THQ/$[Ru(bpy)_3]^{2+}$ mixture before visible light exposure showed only the protonated THQ at m/z 134 (FIG. 28). New ion peaks corresponding to protonated species of 7 and 8 were detected at m/z 132 and 130, respectively, immediately after switching on the laser source (FIG. 29). Only species 7 (m/z 132) would be expected within the timeframe of this experiment. Appearance of the species at m/z 130 suggests that a new reaction condition exists in the charged micro-droplet environment. The observation of intense ions at m/z 130 and 132 at the onset of light exposure lends support to the proposal that the contained-electrospray and transmission-mode desorption electrospray ion emitters can allow for rapid screening of photo-chemical reactions.

Figure 30:
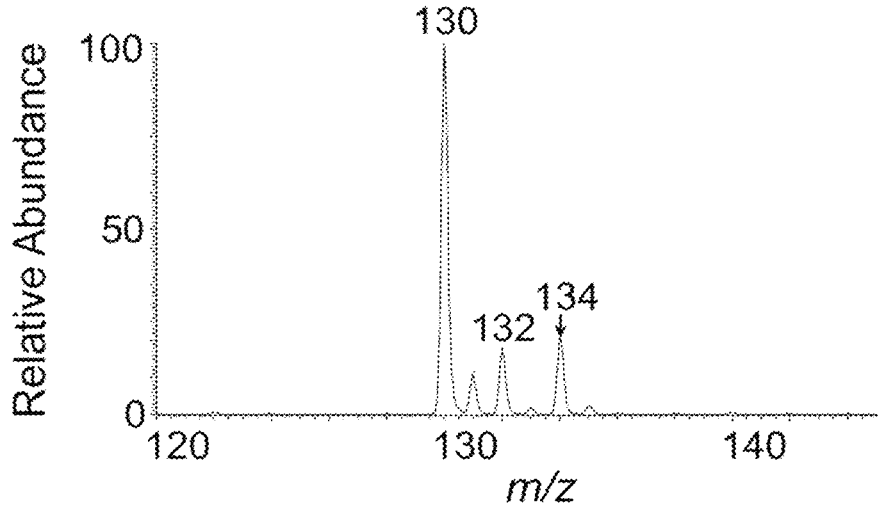
FIG. 30 is a mass spectrum showing analysis of a tetrahydroquinoline and $Ru(bpy)_3Cl_2$ mixture after 1 minute of visible light exposure.

When the reaction mixture was continuously exposed to the visible light for just 1 minute (FIG. 30), protonated quinolines 8 (m/z 130) became the predominant species in the reaction mixture; two minutes of laser exposure time resulted in complete depletion of species at m/z 132 and 134. This experiment was performed in ambient air, outside the mass spectrometer, with no heating or nebulizer gas. These results indicates that performing reactions in liquid thin films, during which the confined reagents will be exposed to photos and electrical discharge, can allow access to different reaction pathways.

Figure 31:
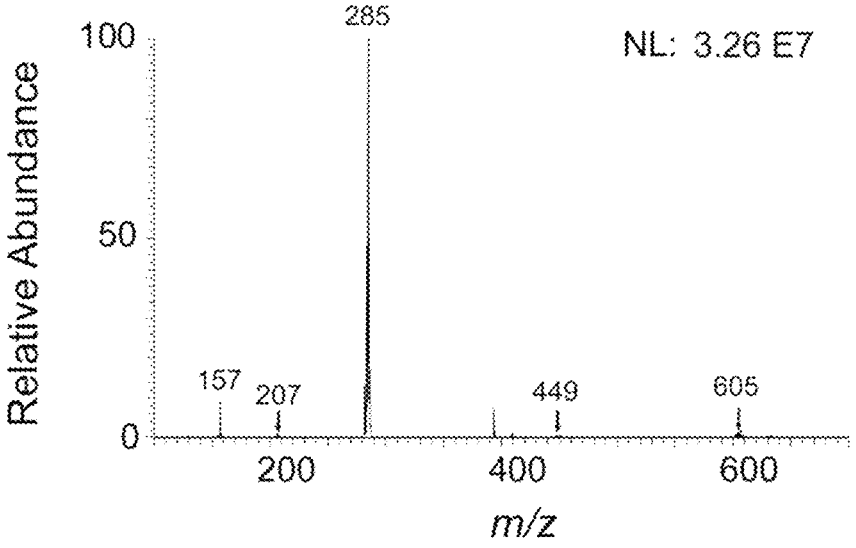
FIG. 31 is a mass spectrum showing the analysis $Ru(bpy)_3Cl_2$ without blue visible light (452 nm; 5 mW); ion at m/z 157 is uncoordinated bipyridine ligand.
Figure 32:
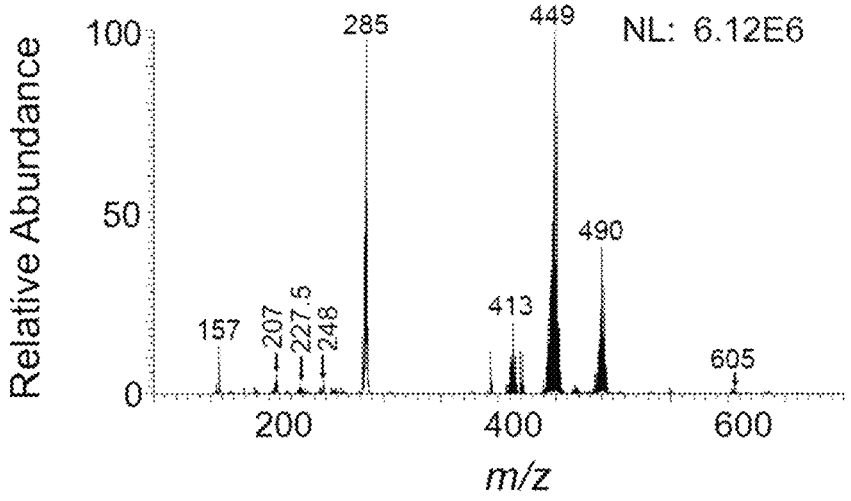
FIG. 32 is a Mass spectrum showing the analysis $Ru(bpy)_3Cl_2$ with blue visible light (452 nm; 5 mW); ion at m/z 157 is uncoordinated bipyridine ligand.

To investigate possible changes that the photo-catalyst might undergo after exposure to visible light, a solution of $Ru(bpy)_3Cl_2$ was exposed to blue visible light, and subsequently analyzed by mass spectrometry after application of the DC potential to the solution. For the purposes of comparison, the same solution was analyzed in the absence of the visible light (FIG. 31), in which the predominant species was the doubly charged $[Ru(bpy)_3]^{2+}$ ion at m/z 285. As can be observed, new ion peaks were detected at m/z 413, 449, and 490 when the solution was exposed to the blue visible light (FIG. 32). The most abundant ion ($[RuCl(bpy)_2]^+$; m/z 449) was formed via a substitution of a chloride anion in solution with one bipyridyl ligand (MW 156). The chemical formula and structure was confirmed using tandem mass spectrometry (MS/MS), accurate mass measurements (<2 ppm error), and isotope distribution. Likewise, similar experiments have confirmed the identities of ions at m/z 413 and 490 to be $[Ru(bpy)_2]^+$ and $[Ru(bpy)_2(CH_3CN)Cl]^+$, respectively.

Figure 33:
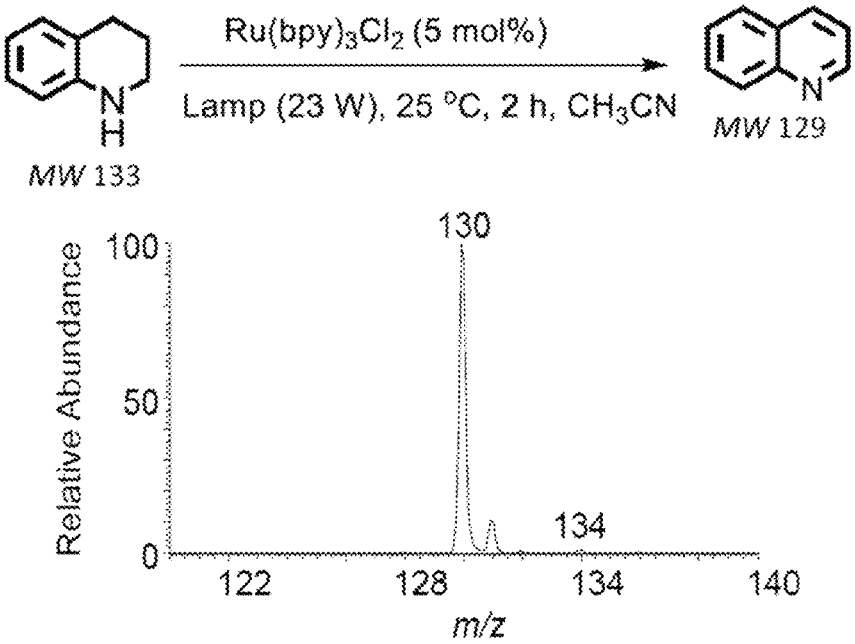
FIG. 33 is a Mass spectrum showing analysis of bulk solution-phase dehydrogenation of 1,2,3,4-tetrahydroquinoline. Reaction conditions are listed scheme above, and the mass spectrum was recorded after 2 h reaction in ambient air.
Figure 34:
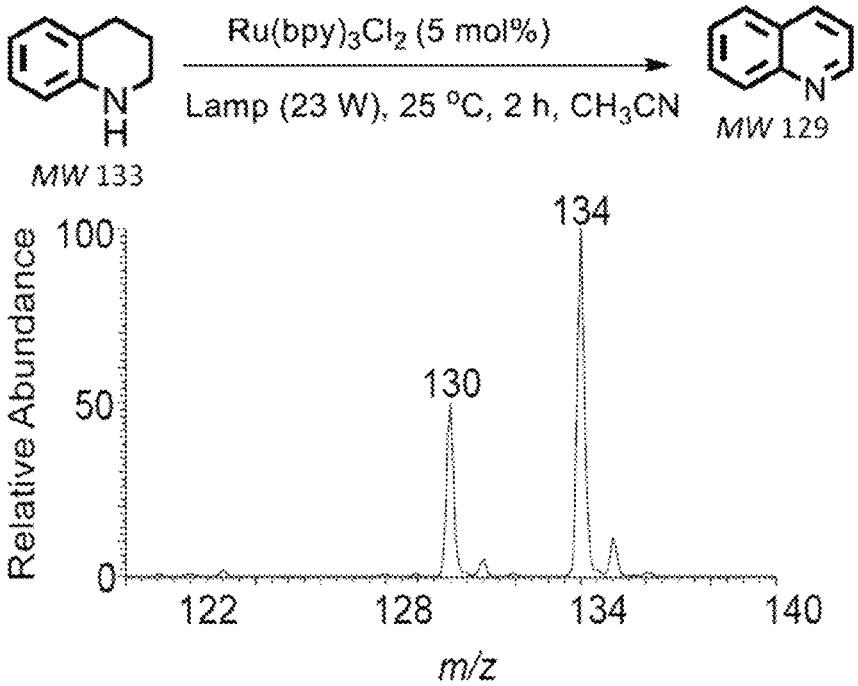
FIG. 34 is a mass spectrum showing analysis of bulk solution-phase dehydrogenation of 1,2,3,4-tetrahydroquinoline. Reaction conditions are listed scheme above, and the mass spectrum was recorded after $N_2$ was bubbled in solution for 2 min followed by 2 h of reaction under air tight conditions.
Figure 35:
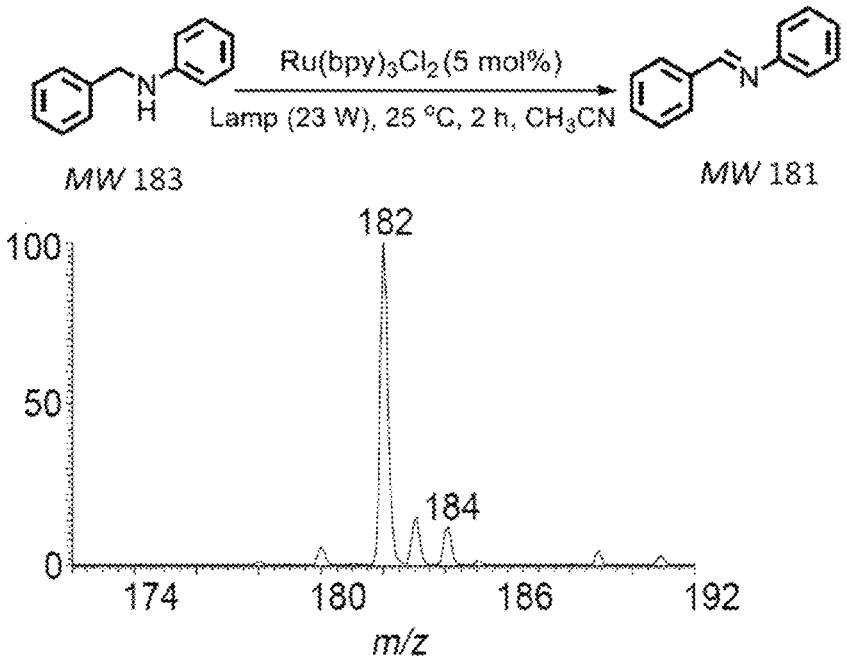
FIG. 35 is a mass spectrum showing analysis of bulk solution-phase dehydrogenation of N-benzylaniline. Reaction conditions are listed scheme above, and the mass spectrum was recorded after 2 h reaction in ambient air.
Figure 36:
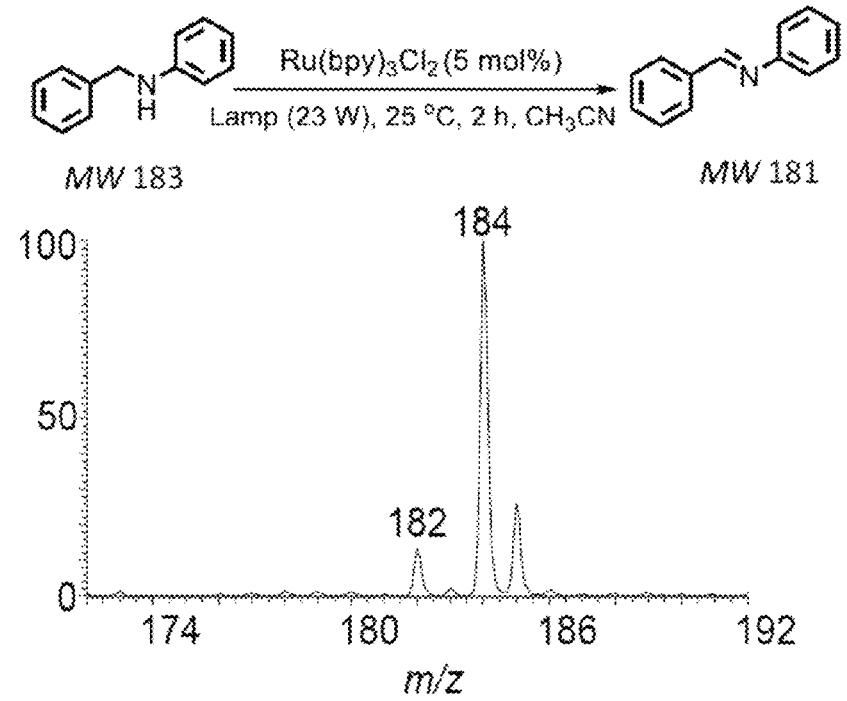
FIG. 36 is a mass spectrum showing analysis of bulk solution-phase dehydrogenation of N-benzylaniline. Reaction conditions are listed scheme above, and the mass spectrum was recorded after $N_2$ was bubbled in solution for 2 min followed by 2 h of reaction under air tight conditions.

Because oxygen may play a role in this electrospray-based photo-catalysis, its effects were investigated in the corresponding bulk-phase reaction. For this, the charged micro-droplet and laser experiment was transferred to a solution-phase reaction condition in which the $[Ru(bpy)_3]^{2+}$/amine reaction mixture was exposed to a 23 W energy saving Lamp for 2 hours. Two experiments were performed: first, the entire reaction was conducted in air; second, nitrogen gas ($N_2$) was bubbled through the solution, after which the reaction mixture was exposed to light under air tight conditions. The results show that the photo-redox catalysis was almost completed after 2 h for the reactions conducted in air (FIG. 33 and FIG. 35). On the contrary, a substantial amount of the starting amine remained unreacted (FIG. 34 and FIG. 36) when the mixture was first exposed to $N_2$ gas to remove dissolved oxygen.

This experiment shows that the use of laser in the droplet-based reaction offers accelerated reaction rates. Under the electrospray condition, product is observed within seconds of light exposure, whereas the 23 W lamp affords reaction products after an hour of illumination. Several factors could be responsible for this rate enhancement including the intensity of the highly coherent laser, charged, surface, and concentration effects. Experiments are proposed to investigate each effect individually.

The results also indicate that oxygen is important in the current photo-redox reaction. In this experiment, only 50% and 10% dehydrogenated products were recorded, respectively, for 1,2,3,4-tetrahydroquinoline and N-benzylaniline after bubbling $N_2$ through reaction mixture for just two minutes. These results, however, do not elucidate the exact role of oxygen. There are two possibilities: (i) the removed oxygen may have affected the regeneration of the photo-catalyst and thus affecting the reaction yield, described in FIG. 26, or (ii) the active species is the reactive oxygen species, the amount of which is reduced after removing dissolved oxygen. The results also indicate that droplet reaction conditions are transferable to bulk solution-phase. These results demonstrate that, unlike vacuum-based experiments, these newly discovered catalytic pathways can be directly transferable to solution-phase conditions, which can be beneficial for large-scale chemical synthesis. This observation also suggests that reagents are effectively confined during electrospray.

The methods and systems discussed herein can "process" ions at atmospheric pressure, where processing includes ion formation, ion stimulation, ion reaction, and product collection. These methodologies can be used to advance understanding of the fundamentals of photo-redox catalysis, and ion chemistry at interfaces and atmospheric pressure. While the methods discussed herein concerns the stimulation of chemical species and the study of the chemistry of the resultant micro-solvated ions, the reactions can be scaled up by multiplexing electrospray ionization emitters.

Figure 37:
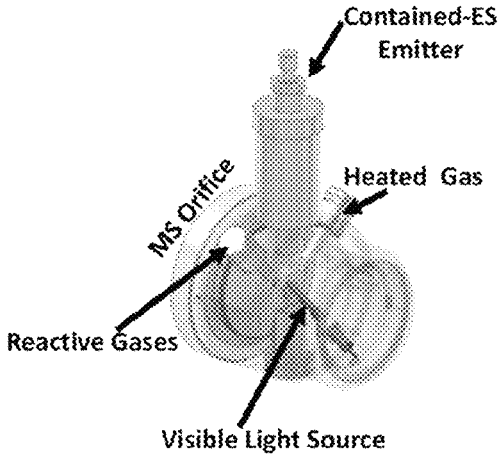
FIG. 37 is a schematic 3D CAD drawing of apparatus for generating charged droplets, and their subsequent modification with various stimuli: heat, visible light, electrical energy and reactive gases (MS=mass spectrometer; ES=electrospray).
Figure 38:
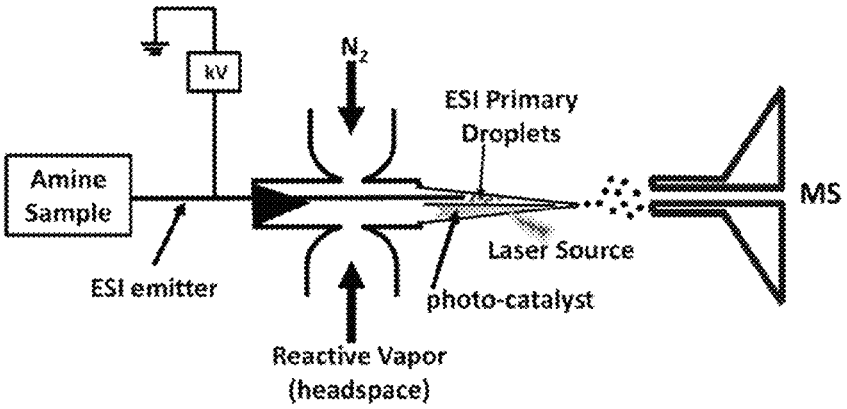
FIG. 38 is a schematic representation of the experimental set-up for the contained-electrospray ionization (ESI) emitter for independent photo-redox studies (MS=mass spectrometer).

FIG. 37 shows a proposed contained-electrospray emitter capable of ion generation and reaction in a single step for rapid investigation and optimization of photo-redox reactions. The core of this apparatus is the contained-electrospray emitter, which can enable rapid and in-situ control of various reaction conditions. The performance of the contained-electrospray emitter can be optimize independently by using the experimental set-up shown in FIG. 38. This emitter has two related operational functions: (i) confinement of reactants in charged droplets, and (ii) manipulation and control of the droplet reaction environment with a variety of stimuli (photons, electrical discharge, and heat).

In addition, the contained-electrospray emitter can allow operation in multiple modes through the use of reconfigurable outlets using theta glass and stainless steel capillaries. This capability can allow the oxidation process to be studied in both rapidly moving charged droplets and within a dynamic thin liquid film. Analysis of reactive species resulting from these systems can be achieved via mass spectrometry (MS). The mass spectrometer is only used to detect and characterize the reaction products and intermediates. The interfacial oxidation of the selected organic compounds occurs in the charged micro-droplet environment prior to their transfer to the mass spectrometer.

Figure 25:
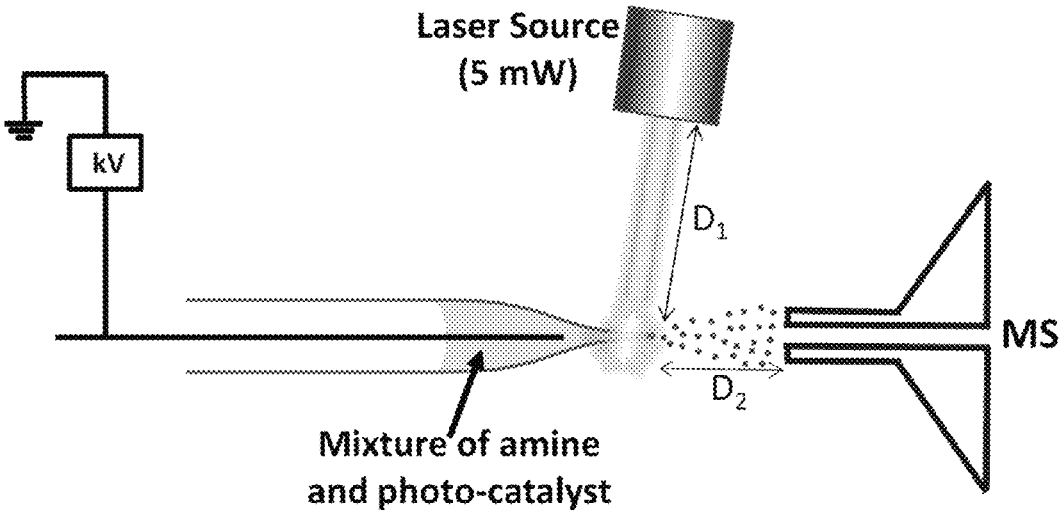
FIG. 25 is a schematic representation of a simplified experimental set-up representing the outlet portion of the contained-electrospray apparatus for studying the effect of charge (or electrical potential) and photo-catalyst on amine oxidation (MS=mass spectrometer).
Figure 26:
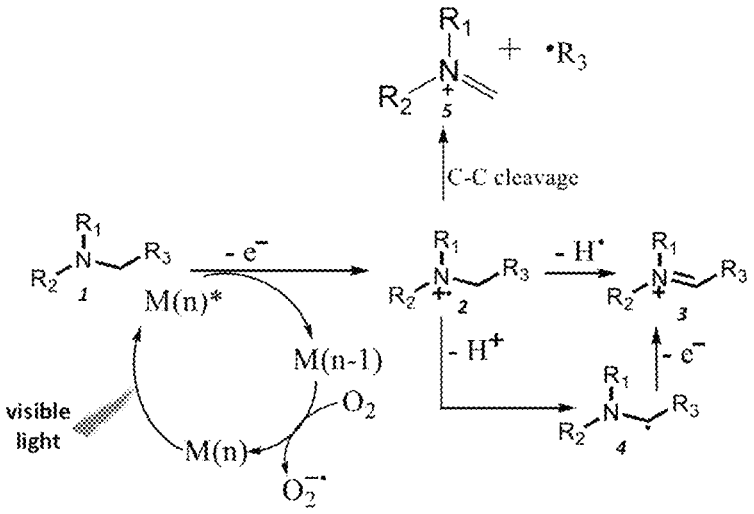
FIG. 26 shows three traditional reaction pathways available to a photo-chemically generated amine radical, 2.

The contained-electrospray emitter can comprise a cross Swagelok element, which can enable up to four inputs: delivery of a sample (e.g., an amine sample) through the electrospray ionization emitter, nebulizer gas (e.g., $N_2$, $O_2$, He, air), reactive liquid reagents (e.g., photo-catalyst), and headspace vapor (e.g., from HCl). In-situ modification of the primary electrospray ionization droplets can occurs after applying a DC high voltage (kV) to the electrospray emitter. There is only one outlet, which can provide effective mixing and reagent modification, while at the same time allowing rapid release of the modified droplets/reactants simply by increasing flow rate or nebulizer gas pressure. In addition, the outlet can be re-configurable to allow transparent and conductive capillaries to be used on the same emitter:

The electrospray emitter can be inserted into one of the chambers in the theta glass capillary as shown in FIG. 25. Here, non-volatile liquid reagents (e.g., $[Ru(bpy)_3]^{2+}$, metal halides, and/or organic dye) can be used as photo-catalysts. The transparent glass capillary allows exposure of the photo-catalyst to photons for excitation before confinement in the charged droplets. Unlike other setups where amine and photo-catalyst are premixed, here the reactants can be brought into contact in the charged droplet only after Taylor cone formation. This can allow for evaluation of effects due to reagent confinement.

In some examples, the glass capillary can be replaced with a metal capillary, such as a stainless steel metal capillary. The use of the metal capillary can allow heat and electrical discharge to be applied during reaction. In these examples, headspace vapor of reactive reagents (e.g., acids) can also be used to modify the droplet environment, and the effect of visible light on the reactivity of the rapidly moving charged droplets can be assessed. The C—H bonds in many organic compounds (including hydrocarbons) can be activated in the presence of corona discharge. Likewise, activated complexes can be generated from simple metal halides, for example, in the presence of basic ligands and reactive oxygen species from the discharge. The electrochemical properties from electrospray, especially at low solvent flow rates, can also be expected to have some effect.

A goal of the methods and systems discussed herein is the simplification of instrumentation for studying ion reactions and the removal of certain technicalities (e.g., ion isolation and trapping) associated with gas-phase ion experiments. The devices discussed herein (FIG. 37) can serve this purpose for known and previously characterized reagents. Furthermore, the contained-electrospray setup (FIG. 38), can allow reaction conditions to be changed in-situ during the droplet reactions. A simplified experimental setup (FIG. 25), designed to represent only the outlet portion of the contained-electrospray emitter, allows investigation of the effect of electrical potential and visible light exposure time.

Figure 39:
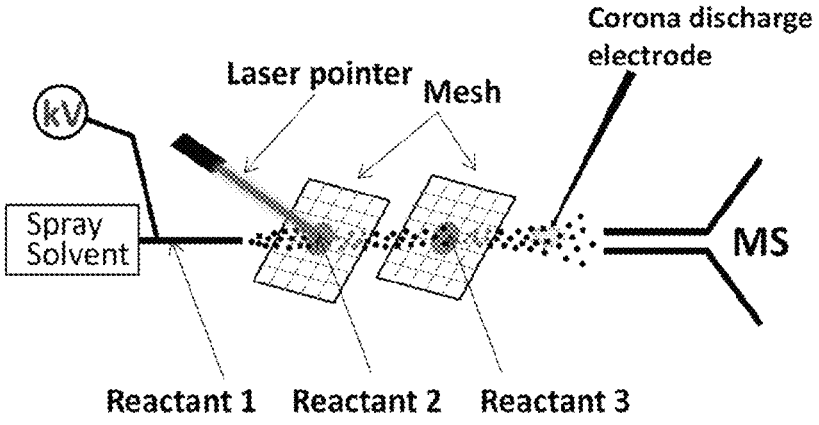
FIG. 39 is a schematic representation of the experimental set-up of transmission-mode desorption electrospray ionization (TM-DESI) for studying multi-component photo-redox reactions using ambient mass spectrometer (MS).

Because visible light reactions such as the conversion of tetrahydroquinoline to quinoline involve short-lived radical species, rapidly moving charged micro-droplets can be suitable for radical capture and studies. A transmission-mode desorption electrospray ionization experimental setup (FIG. 39) can be used for this purpose and to study reaction mechanisms of amine oxidation in the charged micro-droplet environment. Obtaining detailed molecular mechanistic information for multicomponent reaction systems such as photo-redox catalysis under traditional bulk-phase condition is difficult not only because reaction intermediates have short lifetimes, but they also exist at low concentrations within the complex reaction mixture. By using the transmission-mode desorption electrospray ionization experimental setup, reactants can be separated such that their effects on reaction yield, rate, and selectivity can be independently studied. Unlike the conventional desorption electrospray ionization, which is arranged in the reflective mode, the transmission-mode desorption electrospray ionization system is arranged in the transmission mode to eliminate geometrical effects. The analyte is deposited onto a mesh surface, which is in turn positioned between the electrospray emitter and the mass spectrometer. The analyte is sampled through the cavities (~150 μm) of the mesh by the high velocity (~100 m/s) electrospray droplets and transported to the mass spectrometer. The traditional transmission-mode desorption electrospray ionization experiment employed a single mesh surface.

In the transmission-mode desorption electrospray ionization system, several surfaces of mesh can be stacked between the electrospray emitter and mass spectrometer (FIG. 39) to achieve reagent separation. This configuration is particularly suited for the capture of reaction intermediates involved in tetrahydroquinolines to quinolines conversion because several competing pathways can lead to the observed oxidation quinoline product. These pathways can be distinguished by changing the order of reagent introduction. This can be achieved by changing the position of the mesh surfaces, laser sources, and/or corona discharge. Reactive oxygen species produced during photo-catalyst regeneration can play a role in amine oxidation, under the droplet environment. Hence, the transmission-mode desorption electrospray ionization mass spectrometry experiment setup to can be an effective tool to study this effect by generating the reactive oxygen species from electrical/corona discharge. Organic dyes can also be used for this same purpose. This can be studied in a cooperative manner in which the effect of the organic dye can be superimposed on that of transition metal complexes; in this case, two laser sources can be used and the order of photo-catalyst excitation (position and time) can be explored. Like reactions conducted using the experimental setup shown in FIG. 25, results from the transmission-mode desorption electrospray ionization experiments can be transferred to the contained-electrospray emitter for optimization and refinement.

The strengths of the transmission-mode desorption electrospray ionization setup can be found in its ability to minimize both interaction time between reactants, and resident time for reagent in the droplets. Interacting/resident times of less than microseconds can be achieved on the transmission-mode desorption electrospray ionization setup, with nitrogen nebulizer gas pressure of 150 psi. Given the high sensitivity of mass spectrometers, this time scale can be sufficient to detect low abundant intermediates, which often persist for less than 1 s. Isobaric species can be differentiated in tandem mass spectrometry and high resolution measurements. The transmission-mode desorption electrospray ionization can be used to directly monitor changes in photo-catalysts, and to capture complexes of reactants and solvent species. For example, results from experiments involving transmission-mode desorption electrospray ionization have shown the presence of solvent complexes, and an oxidized $[O+Ru(bpy)_3]^{2+}$ catalyst. This species can be important in the tetrahydroquinolines to quinolines conversion. Reaction mechanisms and intermediates that can be involved in the coupling of discharge-induced oxidation can be studied with photo-redox catalysis.

An intense signal for $[RuCl(bpy)_2]^+$ at m/z 449 (FIG. 31 and FIG. 32) was identified when $[Ru(bpy)_3]^{2+}$ was exposed to blue visible light. The systems and methods discussed herein can be used to evaluate the role of $[RuCl(bpy)_2]^+$ and other chloride coordinated Ru-bipyridyl complexes in the oxidation of tetrahydroquinoline.

Figure 40:
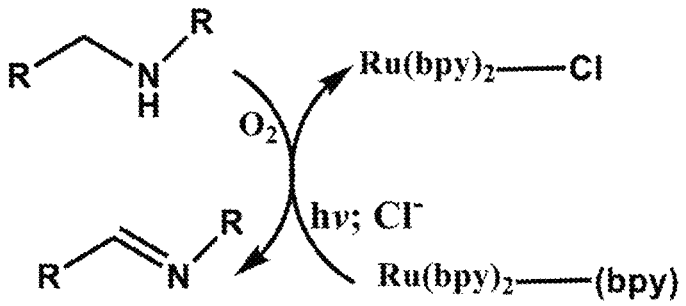
FIG. 40 shows a possible mechanism for the aerobic oxidation of amines by $[RuCl(bpy)_2]^+$.

One possible function of $[RuCl(bpy)_2]^+$ can be realized from the fact that the chloride ligand in $[RuCl(bpy)_2]^+$ is a better leaving group than the bipyridyl ligand and this property can facilitate the coordination of the reactant amine to the transition metal through substitution. In fact, it has been reported that coordinated amine ligands can be irreversibly oxidized in the presence of oxygen (FIG. 40) under ambient conditions. This mechanism can be investigated by using the contained-electrospray and the transmission-mode desorption electrospray ionization methodologies. The use of the contained-electrospray emitter (FIG. 38) can allow control of reagent mixing, droplet speed and environment. The amine to be oxidized can be electrosprayed, and the resultant charged droplets can be exposed to excited photo-catalysts that are kept in one chamber of the theta capillary. By changing the type and pressure of nebulizer gas, the effect of oxygen can be studied (after placing the emitter in an oxygen tight container). Experiments on oxygen effects have shown a decrease in reaction yield, but no coordinated amine-Ru intermediates were detected. This can be investigated further by performing experiments on the transmission-mode desorption electrospray ionization set-up, where the droplets are much smaller, with microseconds contact time between reagents contained in the electrospray ionization primary droplet and reagents coated on the mesh surface. Results from these experiments can be validated by utilizing cis-Bis(2,2'-bipyridine)dichlororuthenium(II) hydrate (commercially available) as the starting photo-catalyst for tetrahydroquinoline oxidation.

Figure 41:
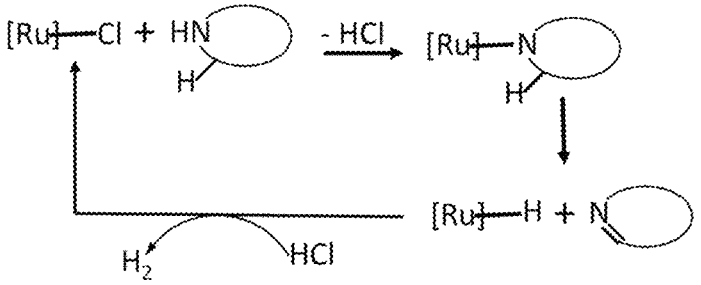
FIG. 41 shows a possible mechanism for amine oxidation involving $[RuCl(bpy)_2]^+$.

An alternate route to amine oxidation involving the chloro-substituted Ru-complexes can comprise the elimination of HCl after amine coordination (FIG. 41). In this case, oxygen can have little or no effect on reaction yield, but the amine-Ru intermediate can be present. In this case, the presence of an organic acid (e.g., $CF_3CH_2OH$) can facilitate chloride dissociation, and hence enhanced reaction yield. The contained-electrospray emitter can be used to study this mechanism because of its ability to modify the droplet environment with headspace vapor, at different vapor pressure achieved in-situ by changing nebulizer gas pressure. This can be done systematically to study the effect of different reagents having different acidities, and in the presence of various nebulizer gases, including $H_2$. A more stable hydride intermediate (Ru—H) can be present under acidic reaction conditions, which can enable efficient coordination and elimination of dehydrogenated amine. The effect of heat can also be evaluated by controlling the number of solvent molecules. This can be accomplished by heating/cooling the nebulizer or via the use of an external heating gun as shown in FIG. 37.

A third mechanistic possibility is that the chloro-coordinated complexes $[Ru(bpy)_2(CH_3CN)Cl]^+$ and $[RuCl(bpy)_2]^+$ may be byproducts. In this event, oxygen-centered radicals can be the main active species for amine oxidation. According to FIG. 24, $O_2$ species are generated during the illumination; hydrogen atom abstraction capacity for such reactive oxygen species is well-known, even from alkanes. This subject has been studied extensively in gas-phase experiments, which typically involve oxygen-centered radical species present at surfaces. Proton-coupled electron transfer reactions have also been reported that usually culminate in the formation of $[M^{(n-1)+}—OH]$, an active species in heterogeneous catalysis of amines. Although insights have been gained from these gas-phase studies, the bare transition-metal ions/complexes typically have oxidation states that are unusual in condensed-phase chemistry.

Figure 42:
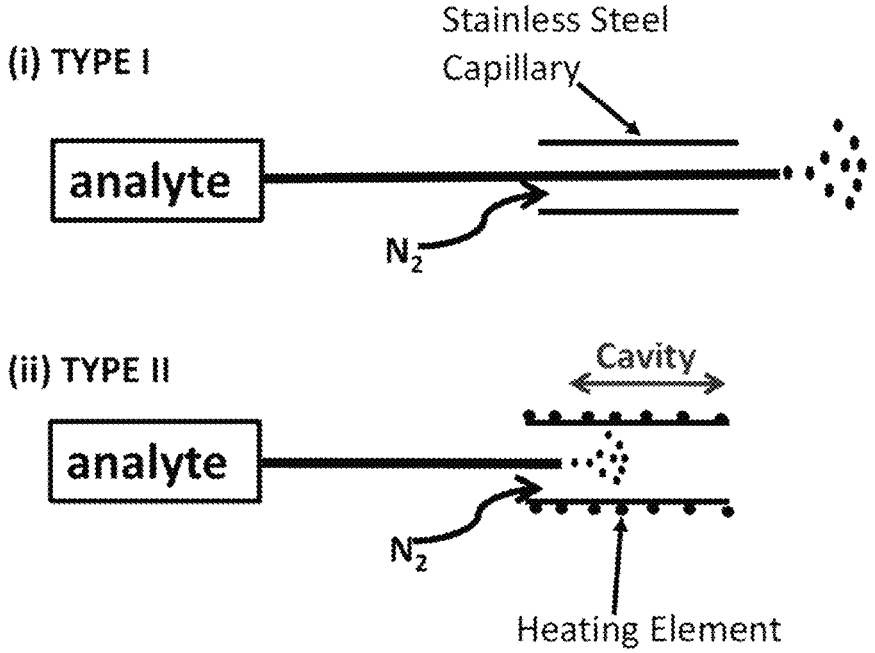
FIG. 42 is a schematic representation of two different operational modes are proposed for the outlet of the pressurized/contained-electrospray apparatus when using stainless steel capillary, shown as Type I in panel (i) and Type II in panel (ii). This figure represents the exit portion of FIG. 25 in which the theta glass capillary is replaced here with stainless steel capillary, with Type II having the cavity.

Similar studies using micro-solvated species can be conducted by re-configuring the contained-electrospray emitter by replacing the glass exit capillary (FIG. 38) with a stainless steel capillary to study the effect of reactive oxygen species on amine oxidation, under the influence of electrical discharge. This experiment can utilize the device shown in FIG. 37, and a movable inner electrospray emitter, inserted into the stainless steel outer capillary (FIG. 42). In the Type II mode (FIG. 42, panel ii), the grounded outer stainless steel capillary can enable the induction of electrical/corona discharge, which can increase the concentration of reactive oxygen species. These species can be dissolved into the incoming charged micro-droplets for in-situ modification of confined reagents. As already explained, the pressurized contained-electrospray emitter is designed to allow headspace of other reactive reagents to be used simultaneously during droplet generation. Experiments have shown that the charged electrospray droplets can capture vapor phase analytes and transfer them over large distances. Accelerated chemical reactions have been observed during the transfer period. The presence of the cavity allows the conversion of the primary electrospray ionization droplets into a thin liquid film so to increase reagent resident time during which accelerated reactions occur. The exposure of the resultant thin liquid film to heat can enable control of solvent effects.

The above argument presupposes that amine oxidation will be studied both with and without visible light illumination. To be certain of this reaction direction, the effect that radical scavengers (e.g., benzoquinone) have on the amine oxidation when using $[Ru(bpy)_3]^{2+}$ with blue visible light will first be investigated. Benzoquinone can trap superoxide anions by an electron transfer mechanism, and reduced reaction yield is expected if $O_2$ is an active species in droplet-based amine oxidation. 5,5-Dimethyl-1-Pyrroline-N-Oxide (DMPO) will also be employed as a spin trapping reagent. In this case, DMPO is can react with O- and N-centered radicals present in the reaction system to form stable adducts that can be detected by mass spectrometry. These experiments can provide both molecular and kinetic information. Based on the results from these experiments, the effect electrical discharge can be studied using Type II mode of operation (FIG. 42). Imposing electrical discharge on illumination and studying the combined effect can be used to investigate the possibility of utilizing highly abundant first row transition metal (e.g., copper and iron) complexes as catalyst for amine oxidation.

For example, in-situ preparation of active catalysts from simple salts (e.g., $CuBr_2$) and free base/ligands (e.g., 2,2'-bipyridine) is of interest. For example, a previous report on a systematic investigation of the effect of different components in the Cu salt/bpy catalytic system showed better performance under basic (e.g., N-methylimidazole (NMI)) and stable radical (e.g., 2,2,6,6-tetramethylpiperidinyloxy (TEMPO)) conditions. Spectroscopic investigation suggested the presence of $[Cu(bpy)(NMI)O_2]^+$ and oxygen-bound dimer, $[Cu(bpy)(NMI)(O_2)Cu(bpy)(NMI)]^{2+}$, all indicating the importance of reactive oxygen species. Through negative mode electrospray, the compositional complexity of this catalytic system can be simplified. Solvent effects can be studied systematically. The fact that reactive chemical species can be generated under the charged micro-droplet environment indicates that other first row transition metal salts, including those of Ni and Fe, can be investigated. The systems and methods described herein can be used to vary a multitude of reaction conditions within a short time period. For this, various selected halides can be electrosprayed from different solvent compositions. Effects from confinement, photon and electrical discharge can generate different micro-solvated $[ML_n]^{n+}$ species (L=halide, $H_2O$, $CH_3CN$, $OCH_3$, $OHCH_3$, etc.) with various oxidation states, some of which can have catalytic activities. For example, a metal-hydrido species $[HNi(OH)]^+$ (to be differentiated from $[Ni(H_2O)]^+$) was generated by electrospraying a solution ($MeOH/H_2O$) of $NiI_2$, and was found to be highly active towards $CH_4$ activation.

By selecting appropriate photo-catalysts, the entire visible spectrum can be investigated for development of metal-free photo-catalytic strategies for dehydrogenation. Several off-the-shelf organic dyes (Table 2) can be used to assess the susceptibility of amines. Given the limitations of organic dyes as photo-catalysts, including thermal instabilities, poor efficiencies, and slow reaction rates, droplet reaction can facilitate their reactivity. Evaporative cooling and reagent concentration that results after pure solvent evaporation from the charged droplets can accelerate organic dye photo-catalysis.

TABLE 2

Absorption and redox properties of various organic dyes.

| Organic Dye | $\lambda_{max}$ (nm) | E° (V) |
|---|---|---|
| Eosin Y | 539 | −1.06 |
| Fluorescein | 450 | −1.22 |
| Alizarin red S | 420 | −0.28 |
| Nile red | 543 | −1.02 |
| Perylene | 524 | −0.80 |
| Rhodamine B | 524 | −0.80 |
| phthalocyanines | 600-750 | — |

In principle, excited organic dye can interact directly with an amine reactant through an electron transfer reaction. Alternative pathways can include electron transfer reactions involving either water or oxygen molecules to generate oxidized products such as OH., $O_2.^-$, and $^1O_2$. Just like electrical discharge, organic dyes can be combined with organometallic photo-catalysts to provide a cooperative photo-redox pathway through which elusive chemical reactions can be realized.

Herein the effect of each photo-catalyst (organic versus organometallic) can be studied on the contained-electrospray (fitted with glass theta capillary) and transmission-mode desorption electrospray ionization experimental setups. By changing the size of the theta glass capillary tip, the effect of droplet size can be investigated. The transmission-mode desorption electrospray ionization setup can be used to detect reactive intermediates when using the organic and organometallic photo-catalysts in combination.

Figure 43:
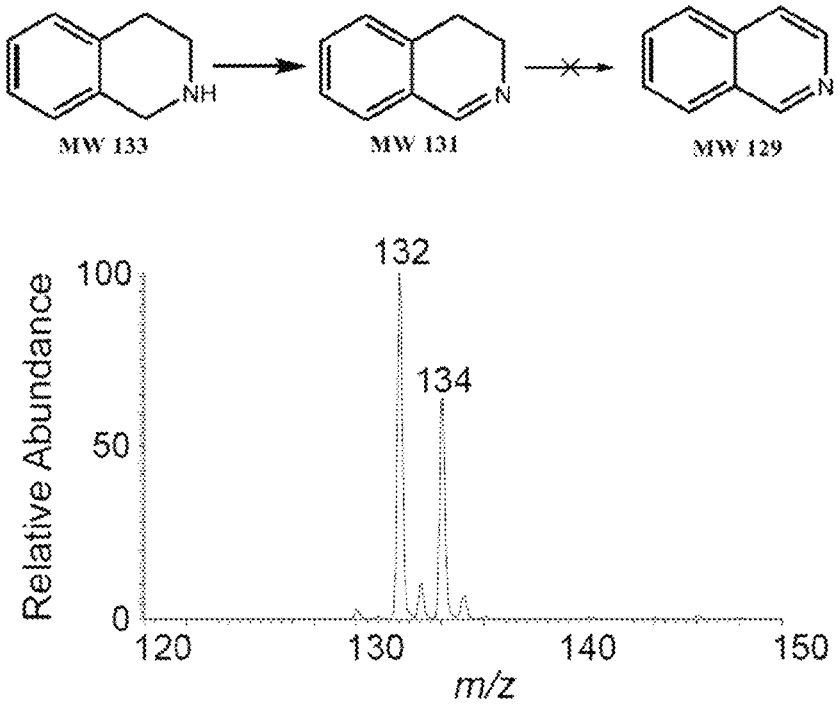
FIG. 43 is a mass spectrum showing analysis of a 1,2,3,4-tetrahydroisoquinoline and $Ru(bpy)_3Cl_2$ mixture at the onset of visible light exposure.
Figure 44:
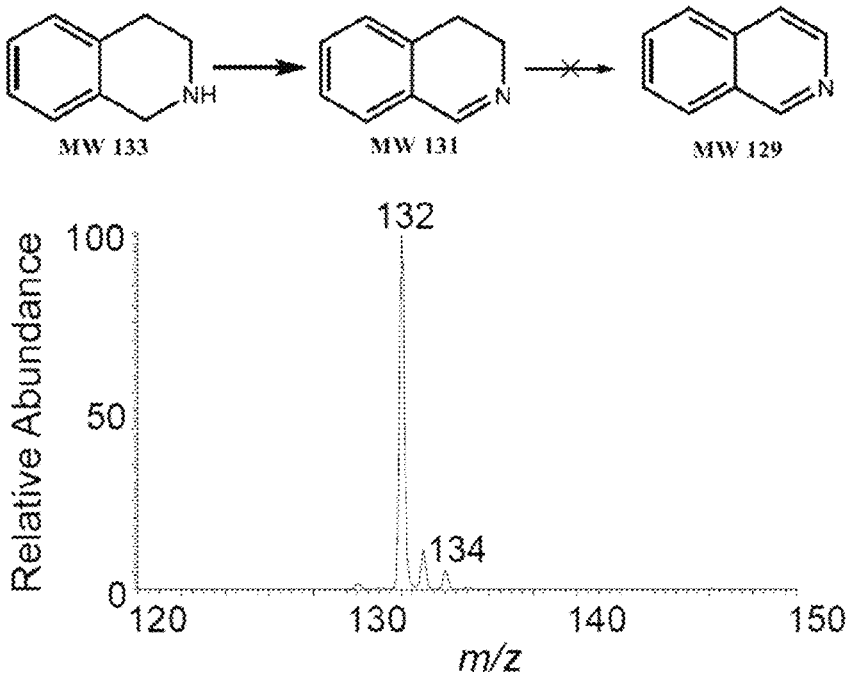
FIG. 44 is a mass spectrum showing analysis of a 1,2,3,4-tetrahydroisoquinoline and $Ru(bpy)_3Cl_2$ mixture after 2 minute of visible light exposure.

The reactivity of other amines (primary, secondary, and tertiary) can be investigated to determine possible limitations of the current photo-catalytic pathway. For example, the dehydrogenation of 1,2,3,4-tetrahydroisoquinoline (structural isomer of 1,2,3,4-tetrahydroquinoline, THQ) was investigated using the electrospray-based photo-redox reaction condition. In the presence of $[Ru(bpy)_3]^{2+}$ and blue laser light, only the imine reaction product (MW 131) was observed, and not the corresponding isoquinoline (FIG. 43 and FIG. 44).

Figure 45:
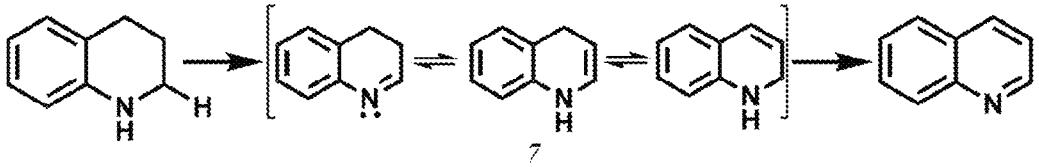
FIG. 45 shows the tautomerizaiton of dihydroqionoline generated from THQ enables further oxidation.
Figure 46:
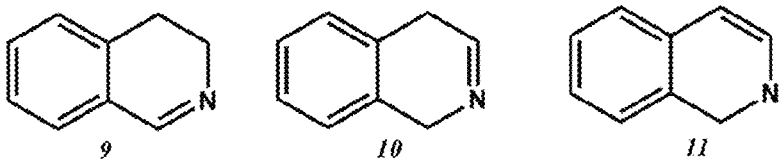
FIG. 46 shows isomers of dihydroisoquinoline.

It is currently not clear as to why tetrahydroisoquinoline reacts differently when compared with the THQ isomer. The imine (dihydroqionoline) formed from THQ (7, FIG. 45) can undergo tautomerization to provide free lone pairs of electron on the nitrogen atom for further oxidization. On the contrary, the movement of the double bond in the imine produced from the tetrahydroisoquinoline is restricted by the stability at the allylic position, and the resultant lone pairs of electrons on the nitrogen occupy a stable hybridized $sp^2$ orbital that make further oxidation difficult. This can be studied by utilizing various isomers of dihydroisoqionoline (FIG. 46) and evaluating their susceptibility to dehydrogenation.

Figure 47:
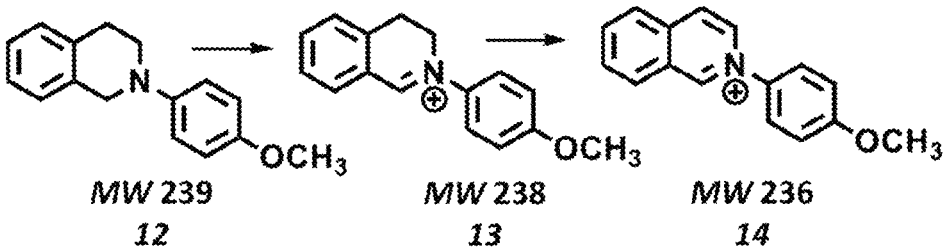
FIG. 47 shows tuning the reactivity of tetrahydroisoquinolinines through N-phenyl substitution.
Figure 48:
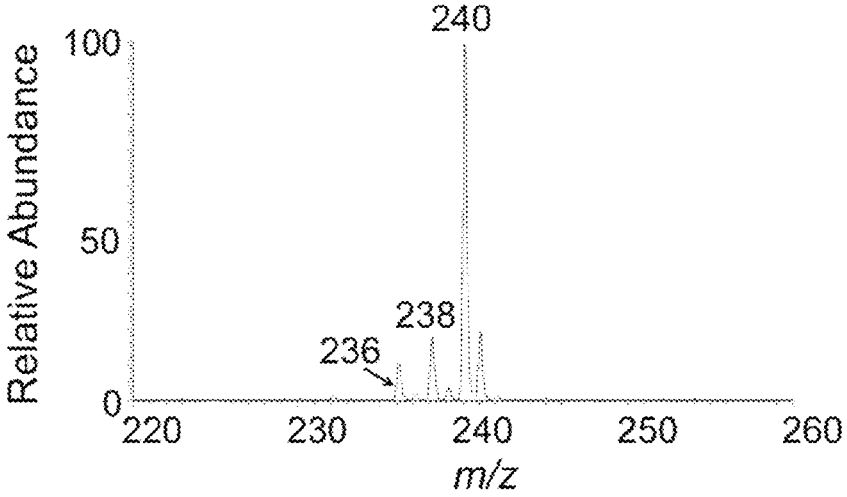
FIG. 48 is a mass spectrum showing analysis of a 12/$[Ru(bpy)_3]^{2+}$ mixture when visible light is off.
Figure 49:
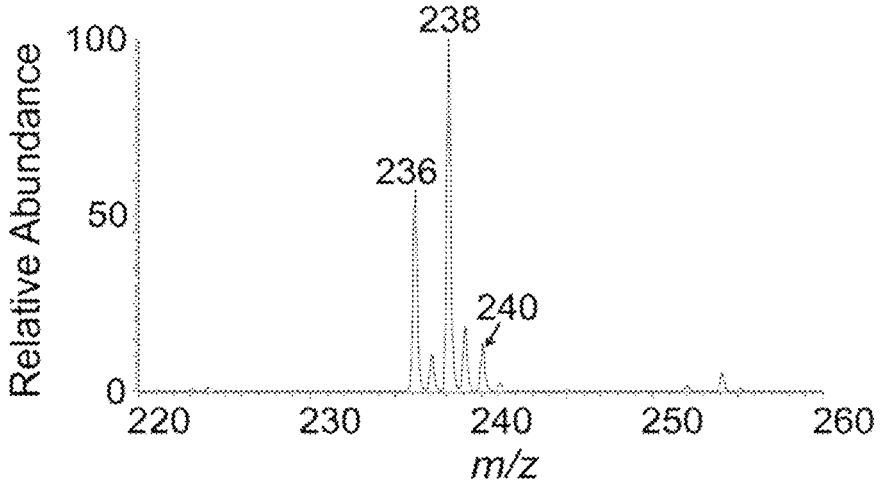
FIG. 49 is a mass spectrum showing analysis of a 12/$[Ru(bpy)_3]^{2+}$ mixture at the onset and of visible light exposure.
Figure 50:
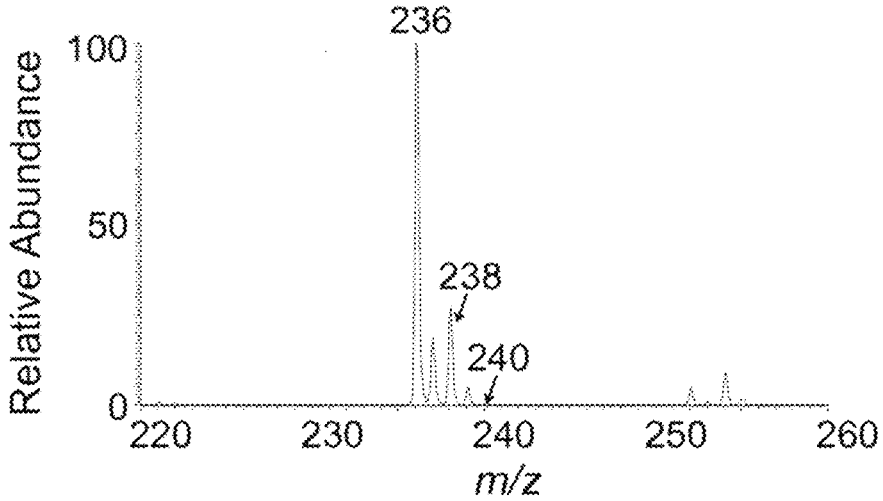
FIG. 50 is a mass spectrum showing analysis of a 12/$[Ru(bpy)_3]^{2+}$ mixture after 1 minute of visible light exposure.

The effect of electron withdrawing and donating groups can be used to tune the reactivity of tetrahydroisoquinolines by varying the electron density on the nitrogen. For example, electron withdrawing (EW) and donating (ED) groups can be placed on an N-substituted phenyl tetrahydroisoquinolines derivative. Data is shown in FIG. 48, FIG. 49, and FIG. 50 for 12 [2-(4-methoxyphenyl)-1,2,3,4-tetrahydroisoquinoline; FIG. 47], where the isoquinoline reaction product 14 (m/z 236) was generated after a brief exposure to visible light, in the presence of $[Ru(bpy)_3]^{2+}$ photo-catalyst. In this case, the N-substituted 4-methoxyphenyl group increases the electron density at the nitrogen and enables further oxidation from 13 to 14. This induction effect can be studied by varying the position (ortho, meta and para) and type of groups on the phenyl substituent (e.g., electron withdrawing groups such as halides, —CN, and —$NO_2$, versus electron donating groups such as —$NH_2$, —OH, —OR).

The generality and selectivity of the method can be evaluated by studying the behavior of other heterocyclic organic compounds including, for example, indolines and tetrahydroquinoxalines, tetrahydrofuran, tetrahydrothiophenes, azetidines, imidazolidines/pyrazolidines, oxazolidine/isoxazolidines, dioxolane and dithiolane. Three main pathways exist for the oxidation of primary amines: (i) imine (R—C═N—H) formation, (ii) nitrile (R—C≡N) formation, and (iii) oxidative coupling (R—C═N—R). Standard samples of primary amines can be used to evaluate which pathway is operative under the charged micro-droplet environment. The reaction conditions can be tuned using the contained-electrospray emitter to establish selectivity and inter-convertibility among these pathways.

One limitation of ambient ionic/droplet reactions can be the relative inability to utilize highly purified species, and thereby making it difficult to specifically characterize all factors. Such challenges can include (i) the decoupling and measurement of the effect of heat generation during the excitation of the photo-catalyst, and (ii) differentiation between surface and concentration effects. To address some of these difficulties, he amount of heat produced can be estimated, for example, by using an infrared pyrometer; reaction yield can be assessed as a function of laser power; the photo-redox reaction can be studied by combining photo-catalyst and laser sources that are out of absorption range; and droplet content can be excited as a function of droplet speed and distance to mass spectrometer. Additionally, a phase Doppler particle analyzer can be used, for example, to determine the effect of droplet size on light absorption, heating and reaction rate. Charge effects can be studied by implementing sonic spray ionization on the contained-electrospray emitter, where reduced charged density on micro-droplets can affect reaction rate.

Other controlled investigations can include: using isotopically-labeled reagents ($D_2O$, $CH_3OD$, $CD_3OD$) to identify the source of the reactive oxygen species by tracing the intake of hydroxyl species during the oxidation and identifying structural/energetic features which control the hydroxyl source; passing charged droplets through the photo-chemical reaction chamber with various velocities and monitoring the products quantitatively to investigate reaction kinetics; and using known quenchers and the exclusion of molecular oxygen from the reaction to investigate the participation of the excited states in the reactions.

The molecular information and fundamental ion chemistry knowledge obtained using the systems and methods described herein will not only increase understanding of amine photo-redox catalysis, but it has the potential to generate new techniques that can provide complementary information to those based on the spectroscopic methods. The ability to perform dehydrogenation in the charged droplets is beneficial to $H_2$ generation.

As an apparatus for performing chemical reactions, the device(s) discussed herein can allow for rapid screening of various reaction conditions in a single stage mass spectrometer. The field of ambient ionic chemistry is set to grow in the near future, not only because of the simple instrumentation requirements, but also because the charged droplets can serve as a reaction vessel for discovering chemical phenomena. The droplet environment lies at the interface between solution-phase and gas-phase, and the ability to create and modify their reactivity can be studied using various stimuli. Chemical reactions that occur within organic layer at an interface can govern a wide array of environmentally and technologically important processes, including electrochemistry, aerosol photo-oxidation, cloud chemistry, corrosion, and heterogeneous catalysis. Free radicals, formed at these interfaces, can play roles in the chemistry as initiators or propagators of surface reactions or as reactive intermediates. The contained-electrospray emitter discussed herein can provide a way to examine the chemistry of organic free radicals in the charged micro-droplet environment, which comprises gas-phase species and ions trapped inside of the droplet or at air/liquid interfaces.

Chemistry performed in charged micro-droplets can be more efficient than the corresponding bulk solution-phase reactions. Various applications are possible, including nanostructure fabrication on ambient surface, catalysis, proteomics, chemical synthesis, and studies of reaction mechanisms. Herein, the development of electrospray-based devices for rapid screening of photo-chemical reactions using only small quantities was discussed. This development can provide an effective way to screen and discover photo-catalyzed reactions; simplification of analytical instrumentation can enable different approaches that facilitate identification of reaction pathways, and the expansion of toolbox for chemical reactions.

Example 12

Ion soft landing (SL) was extended from vacuum to ambient conditions in a process called ambient ion (droplet) soft landing. In ambient ion soft landing, ions of known mass and composition are independently deposited from air onto a surface at a specified location under atmospheric pressure conditions. The ions derived from ambient ion soft landing experiments were used as reagents for organic reactions at ambient surfaces in a solvent-free environment.

Because the ionic reactions were conducted outside the mass spectrometer, the reaction products could be characterized in-situ using analytical techniques such as surface enhanced Raman spectroscopy, atomic force and fluorescence microscopy, and ex-situ by mass spectrometry and spectrofluorimetry after washing from surface, all requiring no instrument modification.

Micro-solvated ions were also selected for organic reactions at ambient surfaces using the ambient soft landing apparatus. Surface reactions were extended to include charged micro-droplets generated by nano-electrospray (nanospray) ionization. A multiplexed array consisting of ten nanospray emitters was developed for peptide cross-linking at ambient surface. Under the charged droplet condition, cross-linking of oligolysine $K_n$ (n=3, 5) peptides by a NHS-based cross-linker was achieved nearly instantaneously and quantitatively in less than 60 seconds. The droplet reaction was also extended to neutral thin films. Like the charged micro-droplet, reaction rate enhancement was achieved in thin films created by drop-casting of reaction mixtures on an ambient surface and allowed the resulting drop to dry in the open laboratory environment. This thin-film approach was tested using the aza-Michael addition (two component reaction) and Mannich condensation (multi-component reaction). Preparative electrospray was implemented for C—C bond formation using the Claisen-Schmidt condensation as a test reaction. Up to 1.47 mg of product was collected in less than 3 minutes of electrospray time, which corresponded to a total conversion of 92% of starting analyte (compare to 8.4% conversion for 10 min bulk solution-phase reaction).

Example 13

Figure 51:
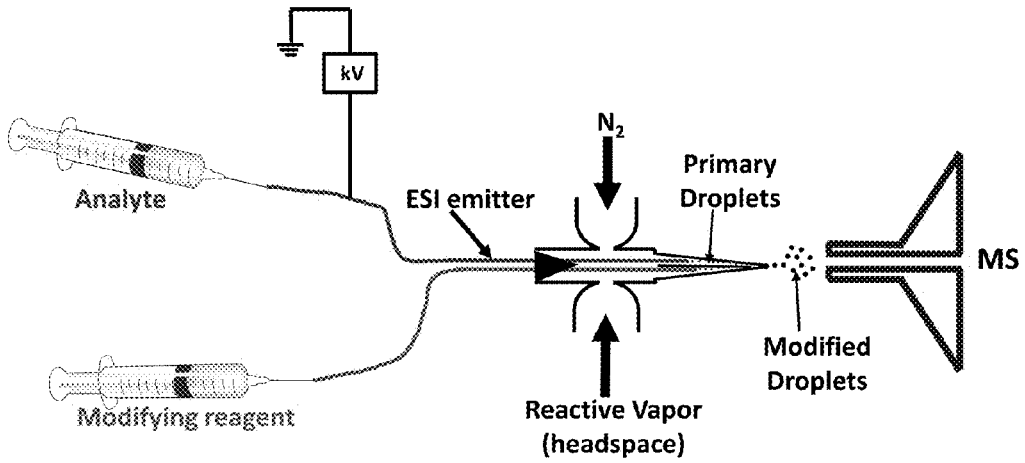
FIG. 51 is a schematic representation of a contained-electrospray apparatus fitted with two co-axial capillaries, inserted into a glass theta capillary. DC high voltage (kV) can be applied to one or both of the ESI emitters. Primary droplets generated by the two capillaries are carried by the nitrogen ($N_2$) nebulizer gas toward the exit of the theta capillary where mixing occurs. Headspace vapor can also be used to enhance modification. The modified droplets are then transmitted into the mass spectrometer (MS) for analyte characterization.

Also discussed herein is an additional mode of the contained electrospray apparatus. In Type III mode of the contained-electrospray ionization, a theta glass capillary is used to replace the outer silica capillary. This configuration can enable the use of liquid modifying reagents, instead of headspace vapor. Two operational modes are possible here: (i) the liquid modifying reagent can be filled directly into one chamber of the theta capillary, while the electrospray emitter is inserted into the second chamber. (ii) In a new operation mode, two electrospray emitters are used (FIG. 51), one containing the analyte and the other containing the liquid modifying reagent. This configuration allows continuous use of the modifying reagent for extended period of time, enabling coupling to liquid chromatography.

The compositions and methods of the appended claims are not limited in scope by the specific compositions and methods described herein, which are intended as illustrations of a few aspects of the claims. Any compositions and methods that are functionally equivalent are intended to fall within the scope of the claims. Various modifications of the compositions and methods in addition to those shown and described herein are intended to fall within the scope of the appended claims. Further, while only certain representative compositions and methods disclosed herein are specifically described, other compositions and methods also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated.

The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed. Other than where noted, all numbers expressing geometries, dimensions, and so forth used in the specification and claims are to be understood at the very least, and not as an attempt to limit the application of the doctrine of equivalents to the scope of the claims, to be construed in light of the number of significant digits and ordinary rounding approaches.

Unless defined otherwise, all technical and scientific terms used herein have the same meanings as commonly understood by one of skill in the art to which the disclosed invention belongs. Publications cited herein and the materials for which they are cited are specifically incorporated by reference.

What is claimed is:

1. An apparatus comprising:

an electrospray emitter comprising (i) a sample capillary extending from a sample inlet to a sample outlet; and (ii) a voltage source conductively coupled to the sample capillary and configured to apply a voltage to the sample capillary; and an element comprising (i) a conduit coaxially disposed around the electrospray emitter thereby forming a chamber extending between the conduit and the sample capillary and terminating in a gas outlet;

(ii) a carrier gas inlet fluidly connected to the chamber; and (iii) a working gas inlet fluidly connected to the chamber;

wherein the chamber is configured to provide a path for fluid flow from the carrier gas inlet and the working gas inlet to the gas outlet.

2. The apparatus of claim 1, wherein the carrier gas inlet is integrally formed with the conduit.

3. The apparatus of claim 1, wherein the working gas inlet is integrally formed with the conduit.

4. The apparatus of claim 1, wherein the sample capillary can be translocated between a retracted position and an extended position, wherein when the sample capillary is in the retracted position, the conduit extends beyond the sample outlet of the sample capillary such that the sample outlet is disposed within the chamber; and wherein when the sample capillary is in the extended position, the sample outlet of the sample capillary extends beyond the gas outlet such that the sample outlet is disposed outside of the conduit.

5. The apparatus of claim 1, wherein the element further comprises a working fluid source terminating in a working fluid outlet, wherein the working fluid outlet is fluidly connected to the gas outlet, to the chamber at a point along the chamber between the sample outlet and the gas outlet, or a combination thereof.

6. The apparatus of claim 1, wherein the element further comprises an auxiliary gas inlet fluidly connected to the chamber.

7. The apparatus of claim 6, wherein the auxiliary gas inlet is integrally formed with the conduit.

8. The apparatus of claim 1, wherein the apparatus further comprises a liquid chromatographer positioned to inject a sample into the sample inlet.

9. The apparatus of claim 1, wherein the apparatus further comprises an analyzer positioned to receive a sample from the sample outlet.

10. The apparatus of claim 9, wherein the analyzer comprises a mass spectrometer.

11. A method comprising, providing an apparatus comprising an electrospray emitter comprising (i) a sample capillary extending from a sample inlet to a sample outlet; and (ii) a voltage source conductively coupled to the sample capillary and configured to apply a voltage to the sample capillary; and an element comprising (i) a conduit coaxially disposed around the electrospray emitter thereby forming a chamber extending between the conduit and the sample capillary and terminating in a gas outlet;

(ii) a carrier gas inlet fluidly connected to the chamber; and (iii) a working gas inlet fluidly connected to the chamber;

wherein the chamber is configured to provide a path for fluid flow from the carrier gas inlet and the working gas inlet to the gas outlet;

injecting a liquid sample into the sample inlet of the apparatus, forming a droplet of the liquid sample at the sample outlet;

injecting a working gas into the working gas inlet and a carrier gas into the carrier gas inlet, thereby contacting the droplet with the working gas and the carrier gas; and ejecting the droplet from the sample outlet.

12. The method of claim 11, wherein the liquid sample comprises a solvent and an analyte.

13. The method of claim 11, wherein the liquid sample comprises a biological sample.

14. The method of claim 11, wherein the liquid sample is injected at a flow rate of from 2 μL/min to 5 μL/min.

15. The method of claim 12, wherein the ejected droplet comprises an ionized form of the analyte.

16. The method of claim 11, wherein the working gas comprises an acid, a base, an oxidizer, or a combination thereof.

17. The method of claim 11, wherein ejecting the droplet comprises adjusting a pressure at which the working gas is injected, adjusting a pressure at which the carrier gas is injected, adjusting a flow rate at which the liquid sample is injected, adjusting the voltage applied to the sample capillary, or a combination thereof.

18. The method of claim 11, wherein the sample capillary can be translocated between a retracted position and an extended position, and wherein the method further comprises translocating the sample capillary between the retracted position and the extended position.

19. The method of claim 11, further comprising exposing the ejected droplet to electromagnetic radiation.

20. The method of claim 11, further comprising exposing the droplet to electromagnetic radiation prior to ejecting the droplet.

21. The method of claim 11, further comprising injecting the ejected droplet into an analyzer.

22. The method of claim 21, wherein the analyzer comprises a mass spectrometer.

23. An apparatus comprising:

an electrospray emitter comprising (i) a sample capillary extending from a sample inlet to a sample outlet; and (ii) a voltage source conductively coupled to the sample capillary and configured to apply a voltage to the sample capillary; and an element comprising (i) a conduit coaxially disposed around the electrospray emitter thereby forming a chamber extending between the conduit and the sample capillary and terminating in a gas outlet, wherein the sample capillary is in a retracted position wherein the conduit extends beyond the sample outlet of the sample capillary such that the sample outlet is disposed within the chamber;

(ii) a carrier gas inlet fluidly connected to the chamber, wherein the chamber is configured to provide a path for fluid flow from the carrier gas inlet to the gas outlet; and (iii) a working fluid source terminating in a working fluid outlet, wherein the working fluid outlet is fluidly connected to the gas outlet, to the chamber at a point along the chamber between the sample outlet and the gas outlet, or a combination thereof.

* * * * *